US007571984B2

(12) United States Patent
Kinpara

(10) Patent No.: US 7,571,984 B2
(45) Date of Patent: Aug. 11, 2009

(54) DROP DISCHARGE HEAD AND METHOD OF PRODUCING THE SAME

(75) Inventor: Shigeru Kinpara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 115 days.

(21) Appl. No.: 11/800,270

(22) Filed: May 3, 2007

(65) Prior Publication Data

US 2007/0206044 A1 Sep. 6, 2007

Related U.S. Application Data

(62) Division of application No. 10/487,012, filed as application No. PCT/JP02/12790 on Dec. 5, 2002, now Pat. No. 7,232,202.

(30) Foreign Application Priority Data

| | | |
|---|---|---|
| Dec. 11, 2001 | (JP) | 2001-376884 |
| Mar. 18, 2002 | (JP) | 2002-073465 |
| Mar. 22, 2002 | (JP) | 2002-081288 |
| May 15, 2002 | (JP) | 2002-139953 |

(51) Int. Cl.
*B41J 2/135* (2006.01)
*B41J 2/015* (2006.01)

(52) U.S. Cl. ..... 347/44; 347/20

(58) Field of Classification Search ..... 347/68, 347/70–72, 20, 44
See application file for complete search history.

(56) References Cited

U.S. PATENT DOCUMENTS

| | | | | |
|---|---|---|---|---|
| 5,818,482 | A | 10/1998 | Ohta et al. | |
| 6,209,994 | B1 | 4/2001 | Furuhata et al. | |
| 6,378,996 | B1 * | 4/2002 | Shimada et al. | 347/70 |
| 6,766,817 | B2 | 7/2004 | Da Silva | |
| 6,808,254 | B2 | 10/2004 | Sakaida et al. | |

FOREIGN PATENT DOCUMENTS

| | | | |
|---|---|---|---|
| EP | 0606767 | A1 | 7/1994 |
| EP | 1005987 | A2 | 6/2000 |
| JP | 60-206655 | | 10/1985 |
| JP | 04166340 | | 6/1992 |
| JP | 05229128 | | 9/1993 |
| JP | 07125198 | | 5/1995 |
| JP | 07178908 | | 7/1995 |
| JP | 8-118662 | | 5/1996 |
| JP | 8-174821 | | 7/1996 |
| JP | 9-277525 | | 10/1997 |
| JP | 10264383 | | 10/1998 |
| JP | 10291322 | | 11/1998 |
| JP | 10296974 | | 11/1998 |
| JP | 11-115182 | | 4/1999 |
| JP | 11348282 | | 12/1999 |
| JP | 2000117977 | | 4/2000 |
| JP | 2001-171129 | | 6/2001 |
| JP | 2001203186 | | 7/2001 |
| JP | 2001260367 | | 9/2001 |
| JP | 2001301165 | | 10/2001 |
| JP | 2001-334675 | | 12/2001 |
| WO | WO98/22288 | | 5/1998 |

* cited by examiner

*Primary Examiner*—An H Do
(74) *Attorney, Agent, or Firm*—Cooper & Dunham, LLP

(57) ABSTRACT

A drop discharge head comprises a channel-forming element that has channel formed therein through which a fluid is conducted to a nozzle.

10 Claims, 43 Drawing Sheets

DROP DISCHARGE HEAD AND METHOD OF PRODUCING THE SAME

CROSS-REFERENCE TO RELATED APPLICATIONS

This application is a divisional of U.S. Ser. No. 10/487,012, filed Feb. 12, 2004, now U.S. Pat. No. 7,232,202 as a Section 371 national stage of PCT/JP02/12790 filed Dec. 5, 2002, the entire contents of each of which are hereby incorporated by reference herein.

TECHNICAL FIELD

The present invention generally relates to a drop discharge head, a method of producing the drop discharge head, an ink cartridge and an ink jet printing device.

BACKGROUND ART

An ink jet printing device, which is used as an image forming device in a printer, a facsimile, a copier, a plotter and the like, is provided with an ink jet printhead as a drop discharge head. The ink jet printhead comprises a nozzle for ejecting the ink drops, an ink channel (also referred to as a lip chamber, a pressure chamber, a pressurized drop chamber, or an ink cavity) connected in fluid communication to the nozzle, and a drive mechanism for pressuring ink in the ink channel. Although the following description is mainly related to an ink jet printhead as a drop discharge head, the drop discharge head comprises a head for discharging a liquid resist as a drop and a head for discharging a DNA piece as a drop.

With a piezoelectric ink jet printhead, the volume change of the ink channel resulting from a deformation of a diaphragm using a piezoelectric element causes the ink drops to be expelled (for example, see JP 61-51734A). With another type of ink jet printhead, the bubbles generated by heating ink in the ink channel using a heating resistance element causes the ink drops to be expelled (for example, see JP 61-59911A). With another type of ink jet printhead, the volume change of the ink channel caused by a deformation of a diaphragm as a result of generating an electrostatic force between the electrode and the diaphragm causes the ink drops to be expelled (for example, see JP 61-51734A).

Among these types of ink jet printheads, the piezoelectric ink jet printhead has advantages especially for color printing, because the potential for degradation of the ink drops due to thermal energy is eliminated (especially, the color ink is more likely to be degraded by heat). Furthermore, flexible control of the amount of ink drops can be accomplished by control of the deformation amount of the piezoelectric vibrator. Accordingly, the piezoelectric ink jet printheads are suited for configuring the ink jet printing device with a capability for high quality color printing.

By the way, in order to accomplish a higher quality of color printing, a higher resolution is demanded. To this end, the sizes of the piezoelectric vibrator and the parts related to the ink channel (for example, the partition walls between pressure chambers) are inevitably reduced and thus increased accuracy is required in fabricating and assembling these parts. Under the circumstances, in order to finely fabricate the complicated parts having microstructures such as a pressure chamber, micromachining techniques in which anisotropic etching is applied to a single crystal silicon substrate are proposed. In this case, the parts (for example, a spacer that is arranged between a nozzle plate and a diaphragm and constitutes the pressure chamber) made from single crystal silicon base have higher mechanical stiffness in comparison with the parts made from a photoresist and thus the overall distortion level of the ink jet printhead due to vibration of the piezoelectric vibrator is reduced. Furthermore, it becomes possible to make the pressure chambers uniform, because the etched wall surfaces of the pressure chambers are normal to the surface of the spacer.

JP 7-178908A discloses a printhead made using a micromachining technique, in which the anisotropic etching is applied to a single crystal silicon substrate with crystal orientation (110) to form the pressure chambers. The potion of the pressure chamber adjacent to its outlet is defined by six wall surfaces, that is to say, the four wall surfaces normal to the single crystal silicon substrate, each of which connects to the neighboring wall surfaces at obtuse angles, and two surfaces connected to the particular one of these four wall surfaces at an obtuse angle, from a cross-sectional view of the single crystal silicon substrate. This traditional technique attempts to avoid stagnation of the bubbles by making the ink flow uniform as soon as possible in the area adjacent to the outlet (i.e., the opening on the nozzle plate side) of the pressure chamber where stagnation of the flow is likely to occur.

JP 7-125198A discloses the printhead made using a micromachining technique, in which the potion of the pressure chamber adjacent to its outlet is defined by five wall surfaces normal to the single crystal silicon substrate, each of which connects to the neighboring wall surfaces at an obtuse angle. Further, one wall surface of the pressure chamber is formed by an extended surface of one wall of the reservoir. This traditional technique attempts to eliminate stagnation of the bubbles in the neighborhood of the opening on the nozzle plate side by communicating between the reservoir and the pressure chamber smoothly and locating the outlet of pressure chamber nearly equidistant from the wall surfaces of the pressure chamber.

JP 10-264383A discloses a printhead comprising an ink cavity (pressure chamber) in which ink is pressurized using the piezoelectric element to be expelled outside. A hydrophilic and alkali-proof film, such as nickel oxide and silicon oxide, is deposited on the inner surface of the ink cavity so as to minimize elution of silicon into inks (especially, in the case of using anionic inks).

JP 11-348282A discloses a printhead made by fastening a first substrate to a second substrate having nozzle bores therein using an adhesive. The first substrate has recesses in a staggered arrangement along the edge of the ink cavity and the reservoir. It becomes possible to prevent redundant adhesive from flowing into an ink channel, because the redundant adhesive flows into the recesses.

However, in the case of making the spacer (the component having the ink channel formed therein) from a silicon substrate by etching, it is difficult to process the silicon substrate into a desired structure, because the etching process is dependent on the crystal orientation of the silicon substrate. Furthermore, the etching results in roughness on the silicon surfaces of the pressure chamber.

The aforementioned printheads according to prior art have failed to reduce the stagnation of the bubbles and the retention of ink to a sufficient degree. Especially, having more than four wall surfaces of the pressure chamber results in a detrimental effect on the ink flow due to the multi-dimensional surface structures and makes it difficult to control the ink flow.

Furthermore, in the case of depositing a film of oxide or titanium nitride (fluid (ink) proof film) on the wall surface of the pressure chamber of the spacer for preventing the elution of silicon into inks, the internal stress of the fluid-proof film causes a distortion (bowing) of the overall spacer. If the other components such as the nozzle plate, the diaphragm in the case of the thermal and electrostatic types of printhead, and a cover for constituting the ink channel (for example, a pressure chamber) are fastened to the spacer, it often leads to faulty bonding between these components and the spacer and thus a decrease in reliability.

SUMMARY

In this disclosure, there are provided a drop discharge head, a method of producing the drop discharge head, and an ink jet priming device that can discharge ink drops with high stability.

It is another and more specific object of the present invention to provide There are also provided in this disclosure a drop discharge head, a method of producing the drop discharge head, and an ink jet printing device that can operate with a high degree of reliability over the long run.

In an aspect of this disclosure, a drop discharge head comprises a channel-forming element made from a silicon substrate, wherein the channel-forming element has a channel formed therein through which a fluid flows to a nozzle, said channel having a surface whose surface roughness Ra is not greater than 2 μm.

This arrangement improves the reliability of the drop discharge head and the stability of drop discharging performance, because it prevents air bubbles from getting snagged on the microscopic asperities of the surfaces of the channel.

In another aspect of this disclosure, a drop discharge head comprises a channel-forming element that is made from a silicon substrate and has a pressure chamber and a nozzle-communicating channel formed therein; and a nozzle plate that is provided on one side of the channel-forming element and has a nozzle connected in fluid communication to the pressure chamber via the nozzle-communicating channel, wherein the nozzle-communicating channel has four corners inside the channel-forming element, while the nozzle-communicating channel has six obtuse angle corners at its outlet on the nozzle plate side.

This arrangement improves the reliability of the drop discharge head and the stability of drop discharging performance, because it prevents adhesive from flowing into the nozzle communicating channel due to capillary action during assembly and thus prevents a deviation of drop trajectory due to adhesive set inside the nozzle communicating channel. Furthermore, this arrangement eliminates difficulties in controlling the fluid flow, since the nozzle-communicating channel doesn't have more than four corners inside the channel-forming element.

Preferably, inside the channel-forming element the nozzle-communicating channel is bounded on its four sides by four surfaces substantially perpendicular to the nozzle plate, while on the nozzle plate side the nozzle-communicating channel is bounded on its four sides by four such perpendicular surfaces and two additional surfaces inclined with respect to the nozzle plate. With this arrangement, it becomes possible to prevent the stagnation of air (or gas) bubbles and fluid flow with the aid of the inclined surfaces and thus prevent a discharge malfunction.

In another aspect of this disclosure, a drop discharge head comprises a channel-forming element that is made from a silicon substrate and has a pressure chamber (diaphragm-side channel 43), a nozzle-communicating channel and a sub-chamber (nozzle-side channel 42) formed therein; a nozzle plate that is provided on one side of the channel-forming element and establishes the sub-chamber together with the channel-forming element and has a nozzle connected in fluid communication to the pressure chamber via the sub-chamber and the nozzle-communicating channel; and a diaphragm that is provided on the other side of the channel-forming element and establishes the pressure chamber together with the channel-forming element and can deform so as to change the volume of the pressure chamber, wherein the nozzle-communicating channel has four corners, while on the nozzle plate side an opening shape of the sub-chamber, in the vicinity of the nozzle, is defined by four lines connected at obtuse angles.

This arrangement improves the reliability of the drop discharge head and the stability of drop discharging performance, because it prevents adhesive from flowing into the nozzle communicating channel due to capillary action and thus prevents a deviation of drop trajectory due to the adhesive accepted inside the nozzle communicating channel. Furthermore, this arrangement eliminates difficulties in controlling the fluid flow, since the nozzle-communicating channel doesn't have more than four corners inside the channel-forming element.

Preferably, on the nozzle plate side in the vicinity of the nozzle the sub-chamber is bounded on its three sides by three surfaces substantially perpendicular to the nozzle plate and an additional surface inclined with respect to the nozzle plate. With this arrangement, it becomes possible to prevent the stagnation of air bubbles and fluid flow with the aid of the inclined surfaces and thus prevent a discharge malfunction.

In another aspect of this disclosure, a drop discharge head comprises a channel-forming element that has a channel formed therein through which a fluid flows to a nozzle and has a first surface on one side and a second surface on the other side, wherein there is substantially no difference in surface area, excluding concave portions, between the first surface and the second surface.

This arrangement improves the reliability of the drop discharge head and can reduce manufacturing cost, because it can make the distortion level less than 2 μm even in the case of a fluid-proof film such as an oxide film or a titanium nitride film being formed on the surface of the channel.

Preferably, a pseudo-channel having a shape similar to the shape of the channel is formed on the first surface side and the pseudo-channel is connected in fluid communication to the outside of the channel-forming element. With this arrangement, it becomes possible to minimize the expansion of air in the pseudo-channel even if heat is applied to the channel-forming element at the bonding process.

In another aspect of this disclosure, a drop discharge head comprises a channel-forming element having a pressure chamber and a nozzle-communicating channel formed therein; and a nozzle plate that is provided on one side of the channel-forming element and has a nozzle connected in fluid communication to the pressure chamber; wherein a pseudo-chamber having a shape similar to the shape of the pressure chamber is formed on then nozzle plate side of the channel-forming element and the depth of said pressure chamber is greater than or equal to 85 μm.

This arrangement improves the reliability of the drop discharge head and the stability of drop discharging performance, because it becomes possible to reduce the distortion level of the channel-forming element and sufficiently supply the ink even at a high discharging frequency in the case of using a high-viscosity fluid.

Preferably, the thickness of the silicon substrate between the pressure chamber and the pseudo-chamber is greater than or equal to 100 μm. With this arrangement, it becomes possible to possible to reduce the distortion level of the channel-forming element and equalize the ink drop speed between driving a single bit and simultaneously driving multiple bits and thus control the ink drop placement with great accuracy.

In another aspect of this disclosure, an ink cartridge comprises the ink jet printhead according to the present invention; and an ink tank that contains ink to be supplied and is integral with the ink jet printhead.

This arrangement improves the reliability and the yield of the ink cartridge, because the drop discharge head according to the present invention can operate with a high degree of reliability and discharge the drops with high stability and accuracy.

In another aspect of this disclosure, an ink jet printing device comprises the ink jet printhead according to the present invention; an ink tank that contains ink to be supplied to the ink jet printhead; a carriage that supports the ink jet printhead and is movable in a main scanning direction; and a sheet feed mechanism for transferring sheets from an input tray to an output tray via a printing area.

This arrangement improves the reliability and the print image quality of the ink jet printing device, because the drop discharge head according to the present invention can operate with a high degree of reliability and discharge the drops with high stability and accuracy.

In another aspect of this disclosure, a method of producing a drop discharge head comprises the steps of providing a silicon substrate; and forming a channel in the silicon substrate by wet etching using a potassium hydroxide solution, wherein the concentration of the potassium hydroxide solution is greater than or equal to 25% and the process temperature is greater than or equal to 80° C.

This arrangement makes it easy to form the channel having a surface whose surface roughness Ra is not greater than 2 μm in producing the channel-forming element from the silicon substrate.

Preferably, a process for preventing the adhesion of air bubbles to the etched surface, such as swaying (tilting back and forth) the silicon substrate and applying supersonic waves to the silicon substrate is included in the step of forming the channel.

With this arrangement, it becomes possible to prevent hydrogen generated during the etching process from adhering to the wall surface and to easily form the channel whose the surface roughness Ra is less than 2 μm.

To achieve the objects, according to another aspect of the present invention, a method of producing a drop discharge head comprises the steps of providing a silicon substrate; and forming a channel-forming element from the silicon substrate having a pressure chamber for containing a fluid to be pressurized, and a nozzle-communicating channel for conducting the pressurized fluid to a nozzle, wherein the nozzle-communicating channel is formed by anisotropic etching of the silicon substrate after forming a non-through hole (internal passage) by dry etching of the silicon substrate. With this arrangement, it becomes possible to improve throughput and the reliability of the drop discharge head.

BEST MODE FOR CARRYING OUT THE INVENTION

In the following, principles and embodiments of the present invention will be described with reference to the accompanying drawings.

Figure 1:
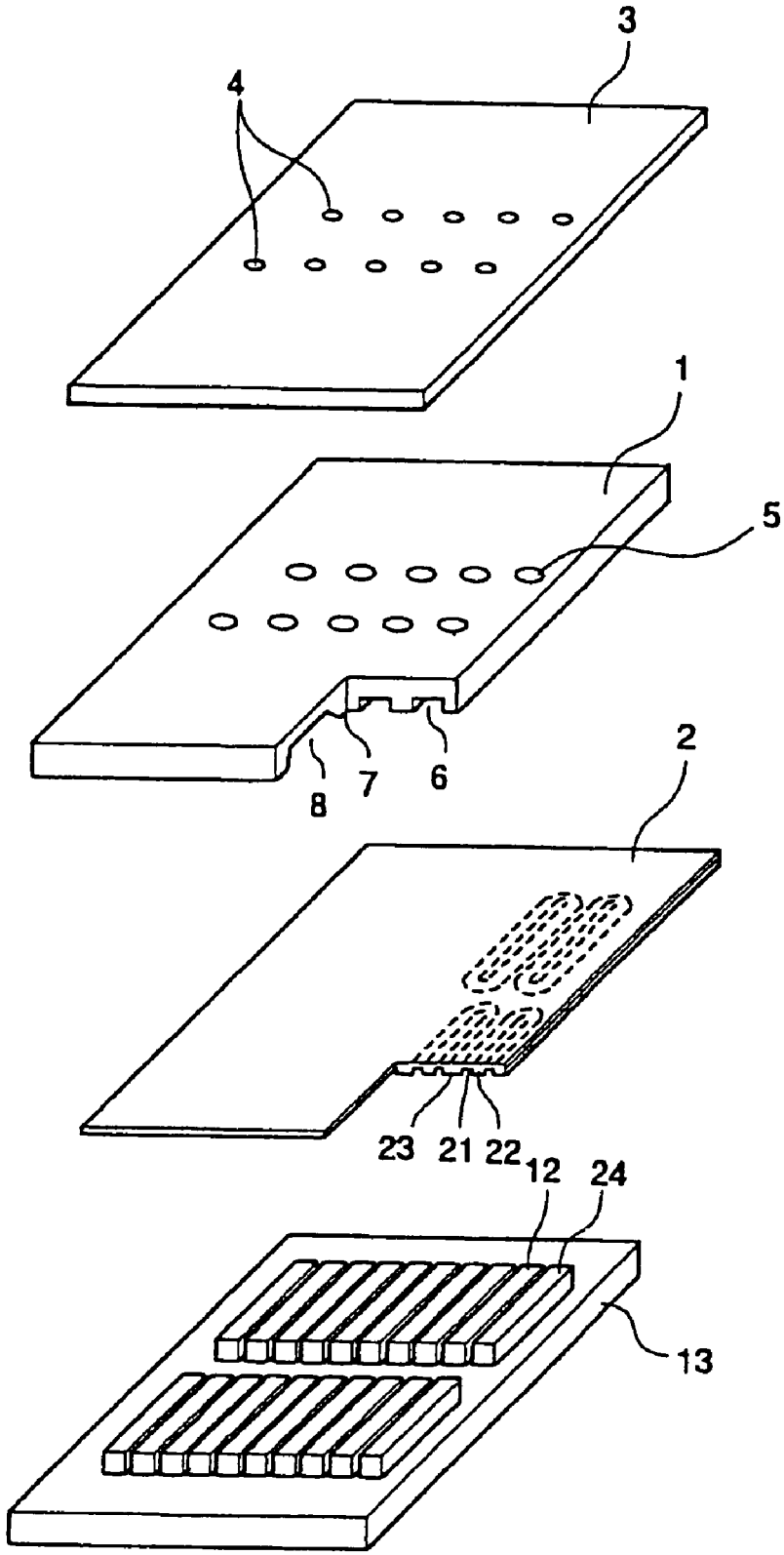
FIG. 1 shows an exploded perspective view of an ink jet printhead according to the present invention.
Figure 2:
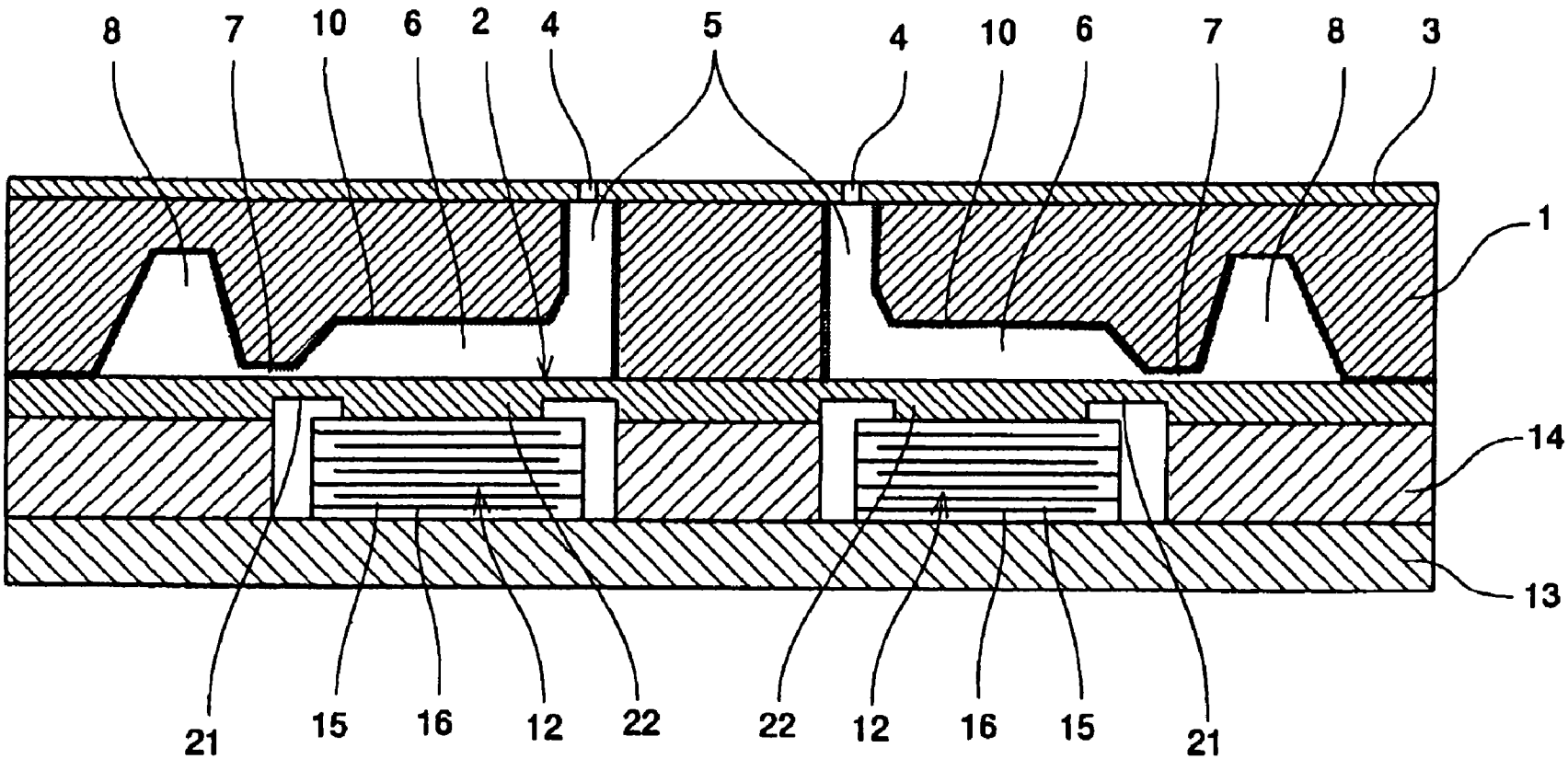
FIG. 2 shows a sectional view taken along a longitudinal direction of the ink jet printhead of FIG. 1.
Figure 3:
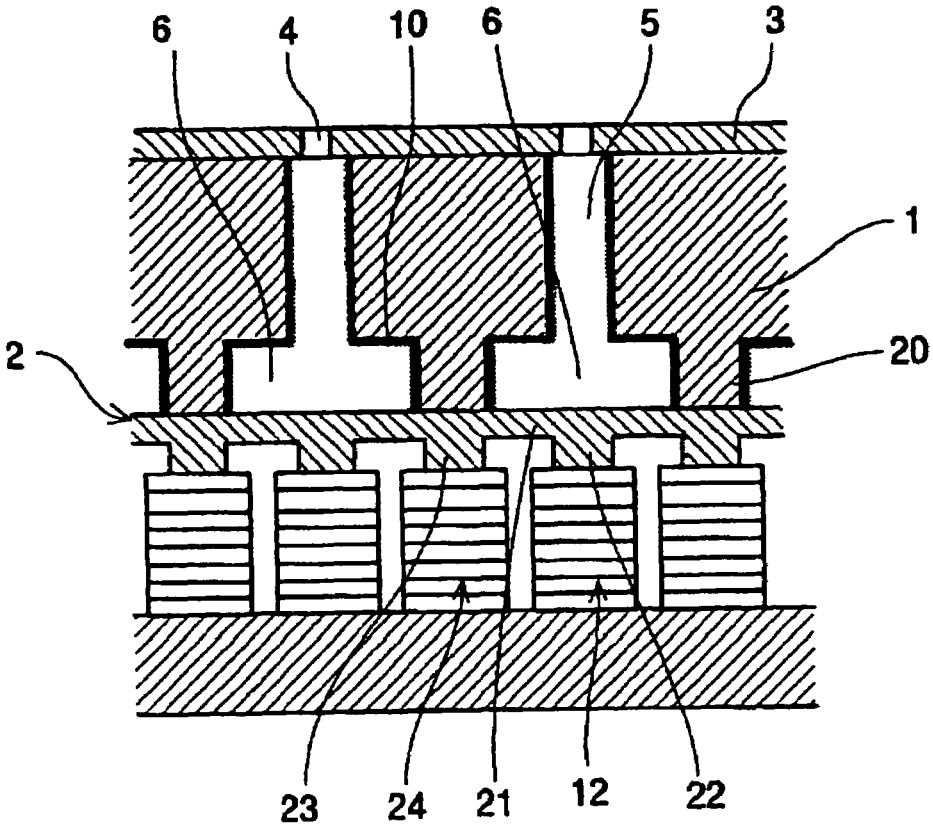
FIG. 3 shows a sectional view taken along lateral direction of the main parts of the ink jet printhead of FIG. 1.
Figure 4:
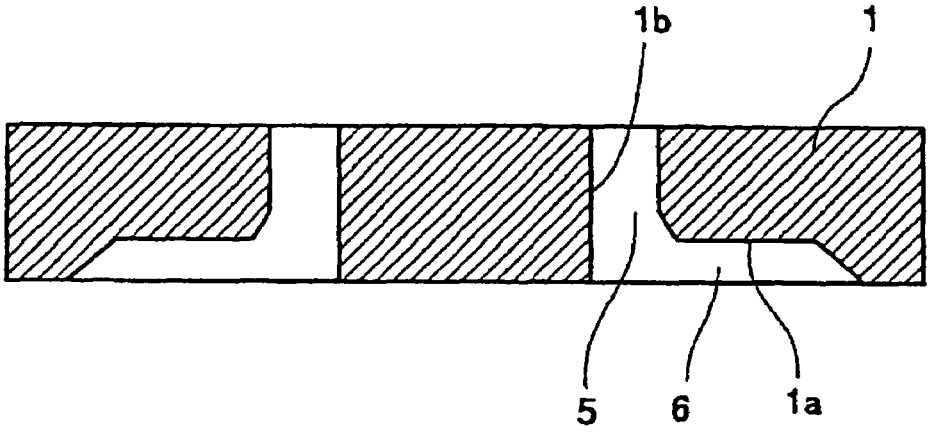
FIG. 4 shows a sectional view of a spacer 1 (channel-forming element) of the first embodiment of the ink jet printhead.

FIGS. 1-4 show the first embodiment of an ink jet printhead as a drop discharge head according to the present invention. FIG. 1 shows an exploded perspective view of the ink jet printhead. FIG. 2 shows a sectional view taken along a longitudinal direction of the ink jet printhead. FIG. 3 shows a sectional view taken along lateral direction of the main parts of the ink jet printhead. FIG. 4 shows a sectional view of a spacer (channel-forming element) of the ink jet printhead.

The ink jet printhead includes a spacer 1 made from the single crystal silicon substrate, a diaphragm 2, a nozzle plate 3, and piezoelectric elements 12. The diaphragm 2 is bonded to the lower surface of spacer 1. The nozzle plate 3 is bonded to the upper surface of the spacer 1. A nozzle bores (nozzles) 4 from which the ink drops are discharged are connected to an ink source via ink channels comprising nozzle communicating channels 5, pressure chambers 6, resistance channels 7, and a reservoir (common ink chamber) 8. The pressure chambers 6, the resistance channels 7 and the reservoir 8 are located between the diaphragm 2 and the spacer 1. The surfaces of the pressure chambers 6, the resistance channels 7, and the reservoir 8 of the spacer 1, which define the surface of ink channels, are covered with a fluid-proof film 10 such as a film of oxide, titanium nitride, and organic resin such as polyamide.

The multi-layered piezoelectric elements 12 are bonded to the lower surface of the diaphragm 2, wherein each of the piezoelectric elements 12 is positioned relative to one of the pressure chambers 6. The multi-layered piezoelectric elements 12 are bonded to a base 13 made from an insulating material such as barium titanate, alumina and forsterite. An intermediate member 14 (not shown in FIG. 1), which is located between the diaphragm 2 and the base 13, is bonded to the base 13. The intermediate member 14 surrounds the rows of piezoelectric elements 12.

The piezoelectric elements 12 may be made by alternately layering a piezoelectric layer 15, such as lead zirconate titanate (PZT) of 10-50 μm thickness, and a internal electrode 16, such as silver palladium (AgPd) of several micrometers thickness. The elements having electromechanical properties are not limited to PZT. The respective internal electrodes 16 are drawn out alternately to either side to electrically connect to a common electrode pattern and an individual electrode pattern formed on the base 13, which in turn electrically connect to a control unit via a flexible printed circuit (not shown). The piezoelectric elements 12 exhibit a deformation in a layered direction (i.e., d33 direction) when a certain drive pulse voltage is applied via the internal electrode 16. The deformation (displacement) of the piezoelectric elements 12 can pressurize the ink in the pressure chambers 6 sufficiently so as to allow the ink to be expelled out of the nozzle bores 4. It is noted that the pressurization of the ink also can be accomplished using the deformation of the piezoelectric elements in the d31 direction. A through hole (not shown) through which the ink from the external ink source (not shown) is conducted to the reservoir 8 is formed in the base 13, the intermediate member 14, and the diaphragm 2.

The structure of spacer 1, that is to say, concave portions corresponding to the pressure chambers 6 and the reservoir 8, and channel portions corresponding to the resistance channels 7, is formed by the anisotropic etching of a single crystal silicon substrate with crystal orientation (110) using an alkaline solution such as a potassium hydroxide (KOH) solution. The nozzle communicating channels 5 are formed by a combination of dry etching and anisotropic etching.

The diaphragm 2 is made of a metal plate of nickel by electroforming. The diaphragm 2 has thin-walled portions 21 formed therein in relation to the pressure chambers 6 so as to facilitate its deformation. The diaphragm 2 also has thick-walled portions 22 formed therein in relation to the piezoelectric elements 12 so as to provide the bonded surface for the piezoelectric elements 12. Further, the diaphragm 2 has thick-walled portions 23 formed therein in relation to partition walls 20 and the upper surfaces of the thick-walled portions 23 (i.e., the planar upper surface of the diaphragm 2) are bonded to the spacer 1 using an adhesive. Support portions 24 are located between the thick-walled portions 23 and the base 13. The support portions 24 are made together with the piezoelectric elements 12 by dicing the piezoelectric element block and have the same structure as the piezoelectric elements 12.

The nozzle plate 3 has the nozzle bores 4 of 10-30 μm in diameter formed therein in relation to the pressure chambers 6. The nozzle bores 4 are aligned in two rows in a staggered arrangement (FIG. 2 shows a straight arrangement for convenience of an explanation). The nozzle plate 3 is made from a metal such as stainless steel and nickel, a combination of the metal and resin such as a polyamide resin film, silicon, and a combination of the materials thereof. The nozzle surface (upper surface in FIG. 3) of the nozzle plate 3 is coated with a water repellency film, using a well-known technique such as a plating film coating and a water-repellent coating, so as to exhibit water repellency against the ink.

With this ink jet printhead, selectively applying a pulse voltage of 20-50V to the piezoelectric elements 12 causes the piezoelectric elements 12 to be deformed in the layered direction (in the case of FIG. 3), thereby causing the diaphragm 2 to be deformed toward the pressure chambers 6. Then, the ink in the pressure chambers 6 is pressurized according to the volume change of the pressure chambers 6 to be expelled out of the nozzle bores 4 as ink drops.

A slight negative pressure within the pressure chambers 6 is generated by the inertia of the ink flow at the time the internal ink pressure decreases due to the discharge of the ink drops. In this state, as the piezoelectric elements 12 are turned to the inactivated state, the diaphragm 2 returns back to its original state, which increases the level of the negative pressure. At that time, the ink from the ink source flows into the pressure chambers 6 via the reservoir 8 and the resistance channels 7 that act as fluid resistance portions. After the vibration of the ink meniscus surface of the nozzle bores 4 is attenuated into a stable state, the subsequent discharge of the ink drops is carried out by applying the pulse voltage to the piezoelectric elements 12.

Referring to FIG. 4, the wall surfaces 1*a* of concave portions corresponding to the pressure chambers 6 of the spacer 1 and the wall surfaces 1*b* of nozzle communicating channels 5 are formed such that the surface roughness (Ra) (Ra: measured surface roughness average) does not exceed 2 μm.

Figure 5B:
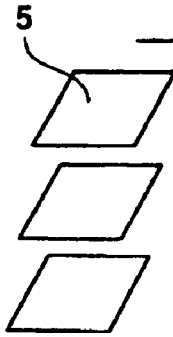
FIG. 5B shows an enlarged detail of the nozzle communicating channels 5.
Figure 5A:
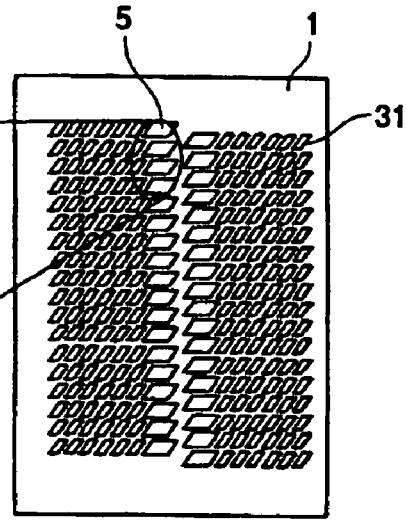
FIG. 5A shows a plan view of the spacer 1 when viewed from the nozzle plate 3 for illustrating the nozzle plate-bonded surface of the spacer 1.
Figure 6B:
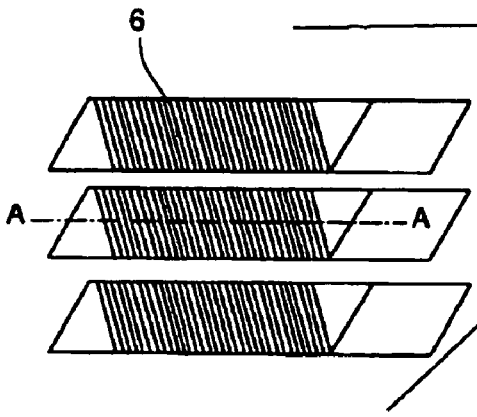
FIG. 6B shows an enlarged detail of the pressure chambers 6.
Figure 6A:
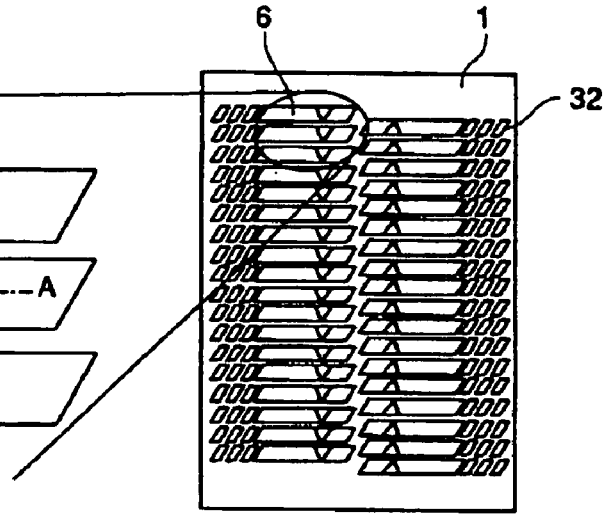
FIG. 6A shows a plan view of the spacer 1 when viewed from the diaphragm 2 for illustrating the diaphragm-bonded surface of the spacer 1.
Figure 7:
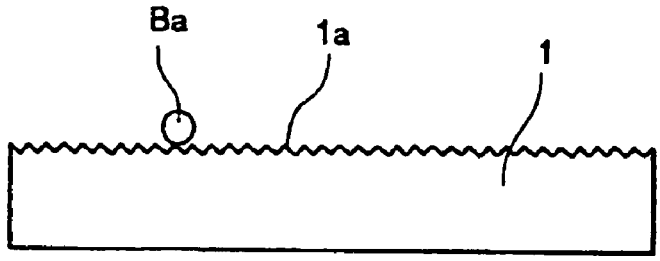
FIG. 7 shows an enlarged sectional view taken along the line A-A of the FIG. 6B.

As for a detailed explanation in this regard, referring to FIGS. 5-10, FIG. 5A shows a plan view of the spacer 1 when viewed from the nozzle plate 3 for illustrating the nozzle plate-bonded surface of the spacer 1 and FIG. 5B shows an enlarged detail of the nozzle communicating channels 5. FIG. 6A shows a plan view of the spacer 1 when viewed from the diaphragm 2 for illustrating the diaphragm-bonded surface of the spacer 1 and FIG. 6B shows an enlarged detail of the pressure chambers 6. FIG. 7 shows an enlarged sectional view taken along the line A-A of the FIG. 6B.

Figure 10:
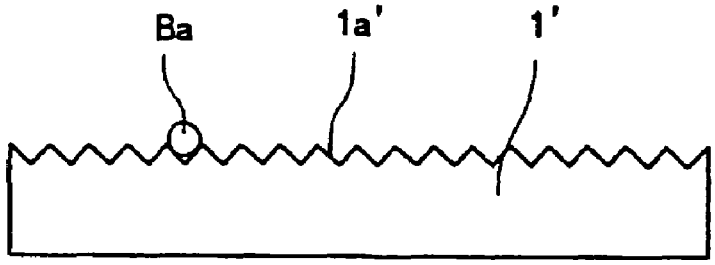
FIG. 10 shows an enlarged sectional view taken along the line B-B of the FIG. 9B.

FIG. 8A shows a plan view of the nozzle plate-bonded surface of the spacer 1' according to a comparative embodiment and FIG. 8B shows an enlarged detail of the nozzle communicating channels 5' of the spacer 1'. FIG. 9A shows a plan view of the diaphragm-bonded surface of the spacer 1' according to a comparative embodiment and FIG. 9B shows an enlarged detail of the pressure chambers 6' of the spacer 1'. FIG. 10 shows an enlarged sectional view taken along the line B-B of the FIG. 9B. Features of the comparative embodiment similar to the features of the first embodiment according to the present invention are described using same reference symbols additionally marked with "'".

The spacers 1,1' have concave portions 31 formed in their nozzle plate-bonded surfaces for accepting redundant adhesive that overflows when the spacers 1,1' are bonded to the nozzle plates 3,3', respectively. The spacers 1,1' also have concave portions 32 formed in their diaphragm-bonded surfaces for accepting the redundant adhesive that overflows when the spacers 1,1' are bonded to the diaphragms 2,2', respectively.

As shown in these figures, according to the first embodiment of the present invention, the wall surfaces 1*a* of the pressure chambers 6 opposed to the diaphragm 2 are formed such that the surface roughness (Ra) does not exceed 2 μm. This surface characteristic is achieved by taking special action for preventing hydrogen generated as a result of the etching from adhering to the wall surfaces. For example, swaying the silicon substrate, creating a mechanical vibration of the silicon substrate, or applying ultrasonic waves to the silicon substrate during the etching process can prevent the adhesion of hydrogen to the wall surfaces.

Therefore, the aforementioned surface roughness of the wall surfaces 1*a* opposed to the diaphragm 2 allows the ink to flow smoothly in the pressure chambers 6 and prevents the bubbles Ba from getting snagged on the microscopic asperities on the surfaces 1*a*, as shown in FIG. 7, and thus prevents the malfunction of the ink jet printhead such as a discharge malfunction. Thus, the ink jet printhead according to the present invention can discharge the ink drops with high stability.

On the contrary, according to the comparative embodiment, the wall surfaces 1*a*' of the pressure chambers 6' opposed to the diaphragm 2' have a surface roughness (Ra) greater than 2 μm. This is because the bubbles (hydrogen) generated at the etching of the silicon substrate adhere to the wall surfaces and make it impossible to make the surface roughness of the wall surfaces 1*a*' less than 2 μm.

According to the comparative embodiment, since the surface roughness of the wall surfaces 1*a*' opposed to the diaphragm 2' exceeds 2 μm, the ink cannot flow smoothly in the pressure chambers 6' and the bubbles Ba easily get snagged on the asperities on the surfaces 1*a*', as shown in FIG. 10. Thus, the potential for the malfunction of the ink jet printhead such as a discharge malfunction becomes large. Therefore, the ink jet printhead according to the comparative embodiment cannot discharge the ink drops with stability.

The wall surfaces, which define the nozzle communicating channels 5, the pressure chambers 6, resistance channels 7, and the reservoir 8, may be formed such that their surface roughness (Ra) does not exceed 2 μm. However, at least the wall surfaces 1*a* of the pressure chambers 6 and the wall surfaces 1*b* of nozzle communicating channels 5 may meet the requirement of the surface roughness.

Figure 11:
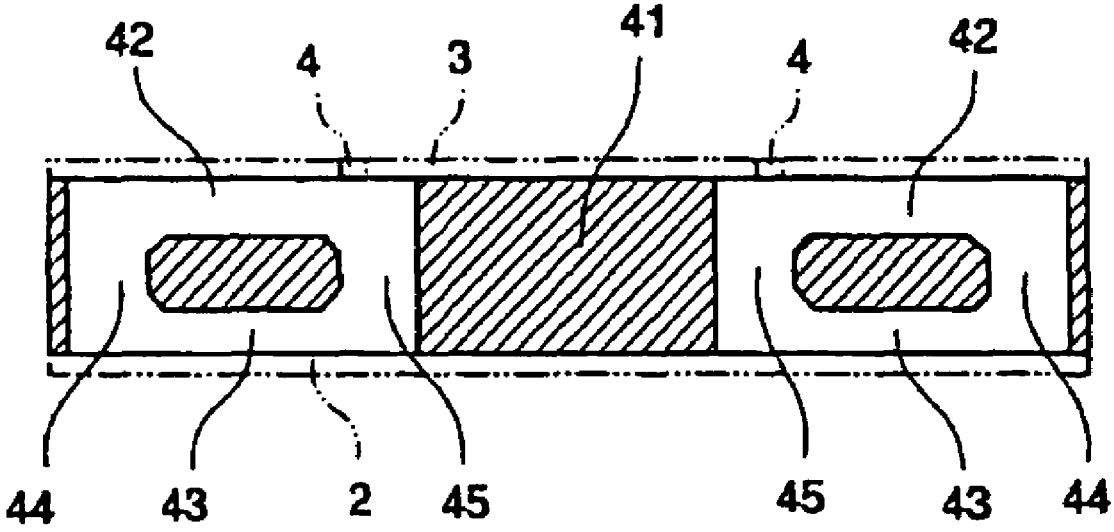
FIG. 11 shows a sectional view of the second embodiment of a spacer of an ink jet printhead according to the present invention.

Referring to FIG. 11, the second embodiment of a spacer of an ink jet printhead according to the present invention is shown in sectional view. Features similar to the features described with reference to FIGS. 1-4 are described with reference to FIG. 11 using same reference symbols. In this embodiment, the spacer 41 has nozzle-side channels 42 and diaphragm-side channels 43 formed therein, which act as ink channels for conducing the ink to the nozzle bores 4 of the nozzle plate 3. In other words, while the spacer 1 of the aforementioned first embodiment has single-sided ink channels, the spacer 41 of this second embodiment has double-sided ink channels.

In this embodiment, the diaphragm-side channels 43 act as pressure chambers (pressure channels) for applying pressure to the ink with the aid of a pressurizing means such as a piezoelectric element. The nozzle-side channels 42 are connected to the diaphragm-side channel 43 via the communicating channels 44,45.

Since the nozzle-side channels 42 and the diaphragm-side channels 43 are formed with respect to the nozzle bores 4 of the nozzle plate 3, the ink pressurized in the diaphragm-side channels 43 (pressure channels) is conducted to the nozzle bores 4 not only via the communicating channels 44 and the nozzle-side channels 42 but also via communicating channels 45. With this arrangement, it becomes possible to sufficiently re-fill the ink even during high frequency operations.

Referring to FIGS. 12, 13, one example of the processes employed by the inventors of the present invention for producing the spacer 1 of the aforementioned first embodiment is shown. First of all, as shown in FIG. 12A, the single crystal silicon substrate 61 (in this example, silicon wafer base) with crystal orientation (110) of 400 μm thickness was provided. Then, on both sides of the silicon substrate 61 were formed a silicon oxide film 62 of 1.0 μm thickness and a nitride film 63 of 0.2 μm thickness. The nitride film 63 was formed by LP-CVD (low-pressure chemical vapor deposition).

Figure 12A:
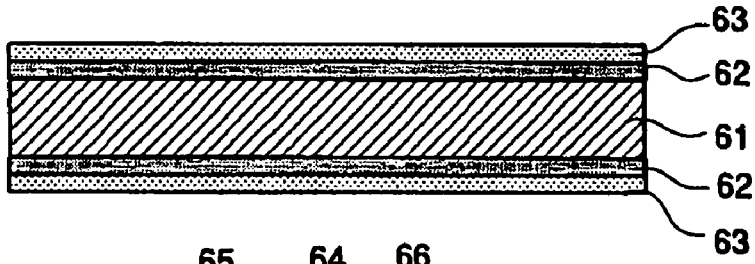
FIGS. 12A through 12E show one example of the processes employed for producing the spacer 1 of the first embodiment.
Figure 12B:
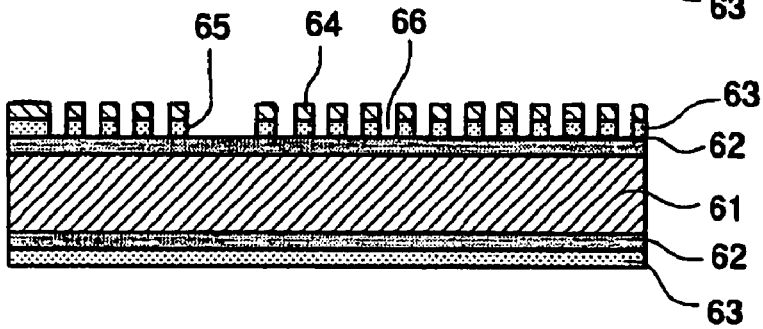

Then, as shown in FIG. 12B, on the nitride film 63 (on the nozzle plate-bonded side) of the silicon substrate 61 was formed a resist pattern 64 having the apertures for the nozzle communicating channels 5 and the concave portions 31 for the redundant adhesive. Then, the apertures 65, 66 for the nozzle communicating channels 5 and the concave portions 31 were patterned by the dry etching of the nitride film 63. A resist (not shown) was formed all over the non-etched sides of the silicon substrate 61*a*.

Figure 12C:
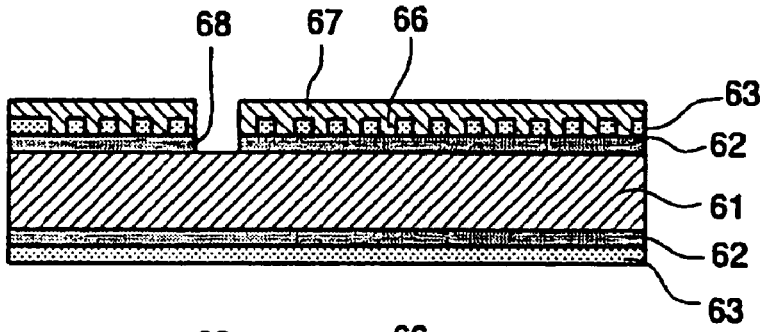

Then, as shown in FIG. 12C, after filling in the apertures 66 of the nitride film 63 with a resist, a resist pattern 67 having the apertures whose geometry corresponds to the geometry of the nozzle communicating channels 5 was formed on the nitride film 63 (on the nozzle plate-bonded side) of the silicon substrate 61. Then, the apertures 68 for the nozzle communicating channels 5 were patterned by the dry etching of the silicon oxide film 62 using the resist pattern 67 as a mask.

Figure 12D:
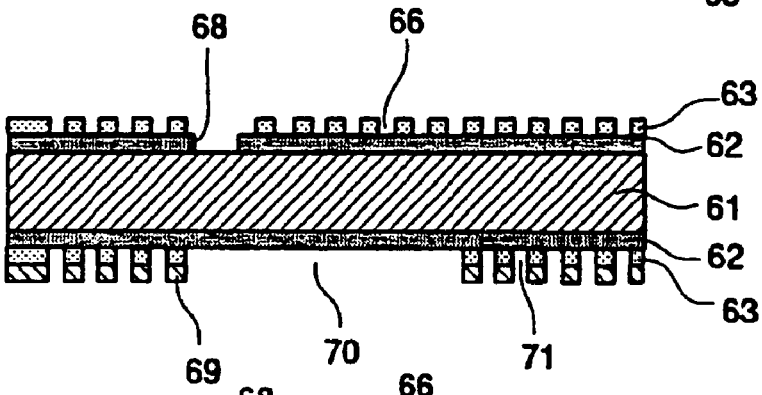

Then, as shown in FIG. 12D, on the nitride film 63 (on the diaphragm-bonded side) of the silicon substrate 61 was formed a resist pattern 69 having the apertures for the pressure chambers 6 and the concave portions 32 for the redundant adhesive. Then, the apertures 70, 71 for the pressure chambers 6 and the concave portions 32 were patterned by the dry etching of the nitride film 63.

Figure 12E:
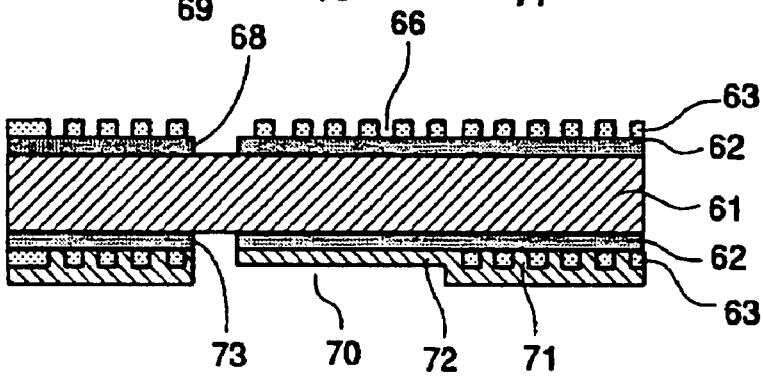

Then, as shown in FIG. 12E, after filling in the apertures 71 of the nitride film 63 with a resist, a resist pattern 72 having the apertures whose geometry corresponds to the geometry of the pressure chambers 6 was formed on the nitride film 63 (on the diaphragm-bonded side) of the silicon substrate 61. Then, the apertures 73 for the pressure chambers 6 were patterned by the dry etching of the silicon oxide film 62 using the resist pattern 72 as a mask.

Figure 13A:
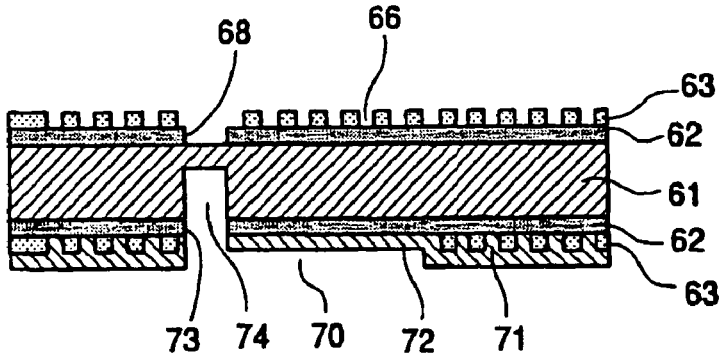
FIGS. 13A through 13E show the continuation of the processes employed for producing the spacer 1 of the first embodiment.

Then, as shown in FIG. 13A, the holes 74 for the nozzle communicating channels 5 were patterned by the dry etching of the silicon substrate 61 from the diaphragm-bonded side using an ICP (Inductively Coupled Plasma) dry etcher. At that time, the film thickness of the resist 72 was 8 μm. The dry etching using the ICP dry etcher was terminated when the depth of the holes 74 reached 300 μm.

Figure 13B:
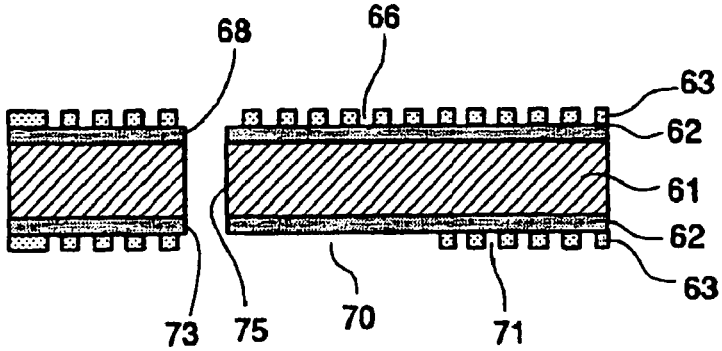

Then, as shown in FIG. 13B, after removing the resist 72, the through holes 75 for the nozzle communicating channel 5 were formed by the anisotropic etching of the silicon substrate 61 using a potassium hydroxide solution. This anisotropic etching process was performed from both sides (i.e., the nozzle plate-bonded side and the diaphragm-bonded side) of the silicon substrate 61. Although inclined portions were created by the anisotropic etching just after the through holes 75 were created (i.e., just after the silicon substrate 61 was first etched through by the anisotropic etching), the inclined portions were removed completely by this etching process.

Figure 13C:
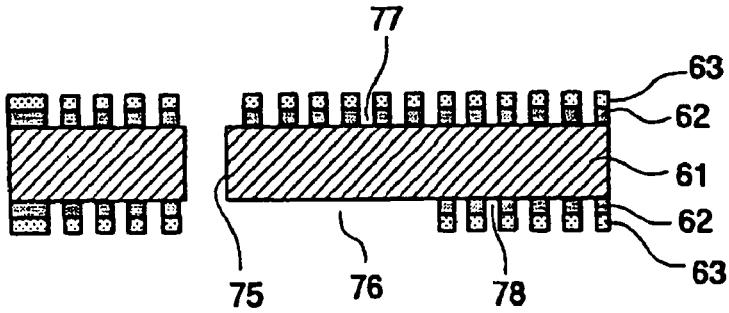

Then, as shown in FIG. 13C, the apertures 76 for the pressure chambers 6 and the apertures 77, 78 for the concave portions 31,32 were patterned by the wet etching of the silicon oxide film 62 using dilute fluoric acid with the nitride film 63 as a mask.

Figure 13D:
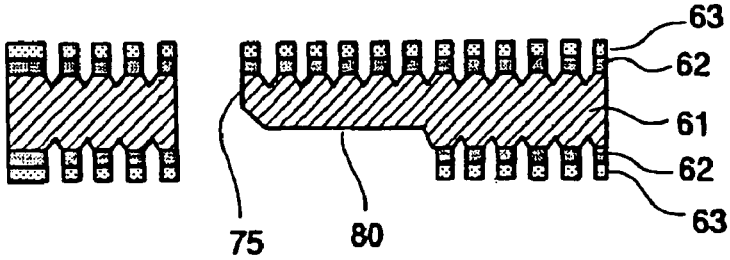

Then, as shown in FIG. 13D, the concave portions 80 corresponding to the pressure chambers 6 and the concave portions 31,32 were formed by the anisotropic etching of the silicon substrate 61 using a potassium hydroxide solution.

In this process, the concentration of the potassium hydroxide solution was 30% and the process temperature was 85° C. Further, the silicon substrate 61 (silicon wafer) was mechanically swayed. This swaying operation prevents the hydrogen generated at this etching process from adhering to the wall surfaces and enables the surface roughness (Ra) of the bottom surfaces (i.e., the surfaces opposed to the diaphragm 2) of the concave portions 80 corresponding to the pressure chambers 6 to be less than 2 μm.

Figure 13E:
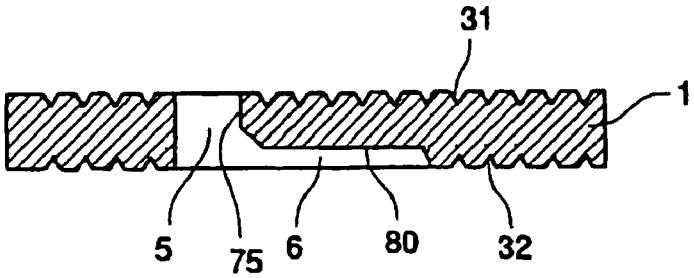

Then, as shown in FIG. 13E, the silicon oxide film 62 and the nitride film 63 were removed. Then, after the silicon oxide film of 1 μm thickness was formed as a fluid-proof film 10 (not shown), the processes for producing the spacer 1 were completed.

In the aforementioned processes, the special operation for making the surface roughness (Ra) less than 2 μm was carried out against the surfaces of the pressure chambers 6 opposed to the diaphragm 2. Consequently, the ink jet printhead that can operate with a high degree of reliability and guarantee a smooth ink flow without the bubbles being snagged on the surfaces was obtained.

Figure 14:
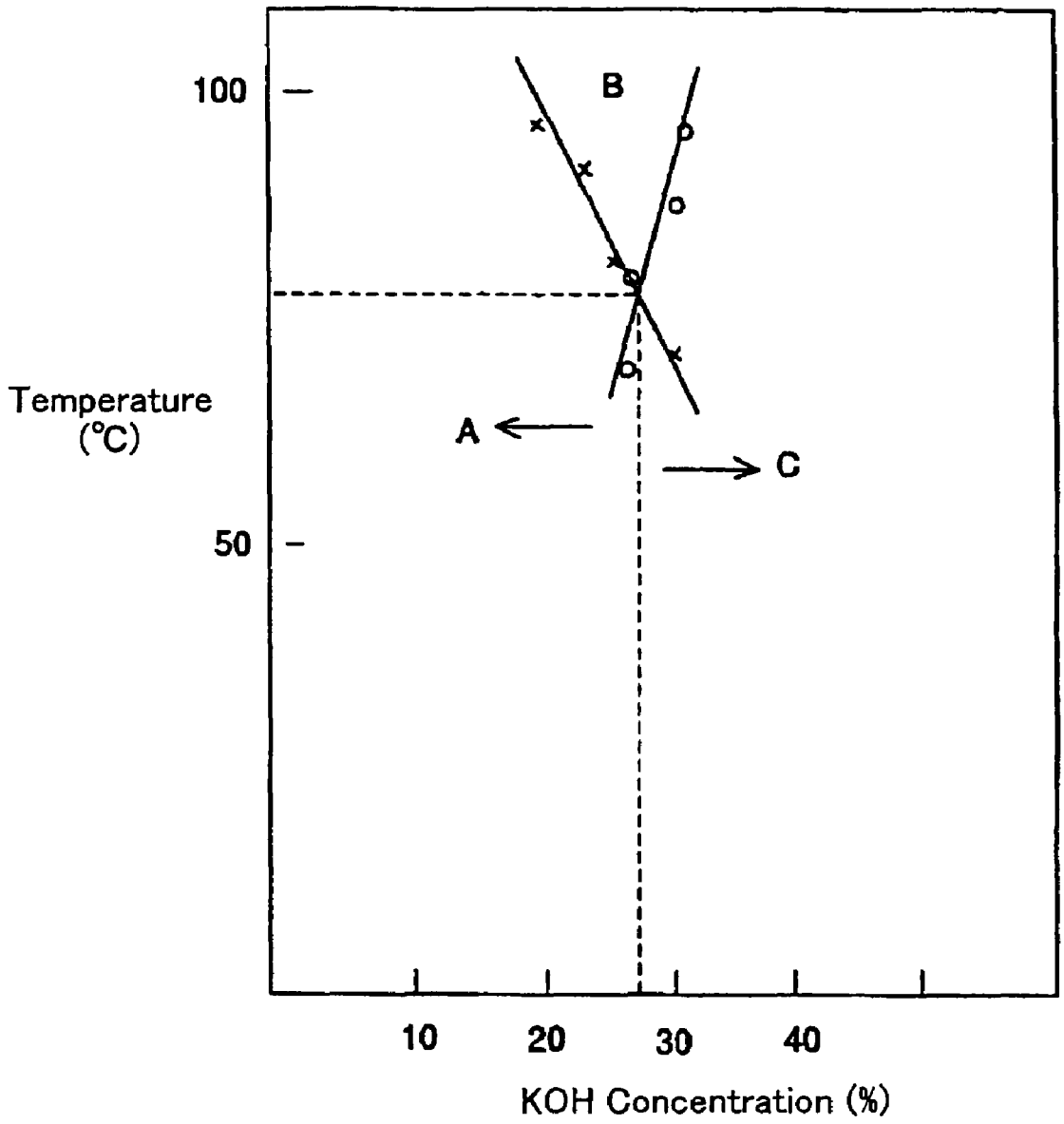
FIG. 14 shows the effect on the surface characteristic (roughness) of the concentration of the potassium hydroxide solution and the temperature for the anisotropic etching.

Here, the description will be directed to the anisotropic etching of the silicon substrate with reference to FIG. 14. FIG. 14 shows the relationship between concentration of the potassium hydroxide solution and surface characteristic (i.e., surface roughness) at the anisotropic etching.

The higher the concentration of the potassium hydroxide solution becomes, the lesser the surface roughness (Ra) becomes. However, it is known that an excessively high concentration of the potassium hydroxide solution creates a protrusion surrounded with the (110) surface of silicon, which structure is commonly referred to as a "micro pyramid". In FIG. 14, the area indicated by the symbol A is where micro pyramids are not created. The area indicated by the symbol C is where the surface roughness (Ra) is less than 2 μm. The area indicated by the symbol B is where micro pyramids are not created and the surface roughness (Ra) is less than 2 μm. Thus, the process condition of the anisotropic etching is preferably determined to fall within the area B as well as in terms of the prevention of the adhesion of the bubbles (hydrogen).

Additionally, in the case of using the potassium hydroxide solution for the anisotropic etching, the etching rate of silicon is maximized where the concentration of the potassium hydroxide solution is within 20-25%. In the state of this concentration range, the process temperature higher than 80° C. is preferred in terms of the requirement related to the area B. An appropriate selection of the process conditions (concentration and temperature) and the minimization of the variation in the etching proceeding allow improvement in the reliability of the ink jet printhead.

Referring to FIGS. 15, 16, one example of the processes employed for producing the spacer 41 of the aforementioned second embodiment (shown in FIG. 11) is shown. First of all, as shown in FIG. 15A, the single crystal silicon substrate 91 (in this example, silicon wafer base) with crystal orientation (110) of 400 μm thickness was provided. Then, on both sides of the silicon substrate 91 were formed a silicon oxide film 92 of 1.0 μm thickness and a nitride film 93 of 0.2 μm thickness. The nitride film 93 was formed by LP-CVD (low-pressure chemical vapor deposition).

Figure 15A:
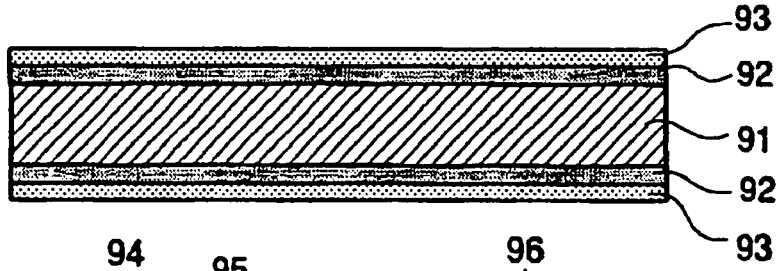
FIGS. 15A through 15E show one example of the processes employed for producing the spacer 41 of the second embodiment.
Figure 15B:
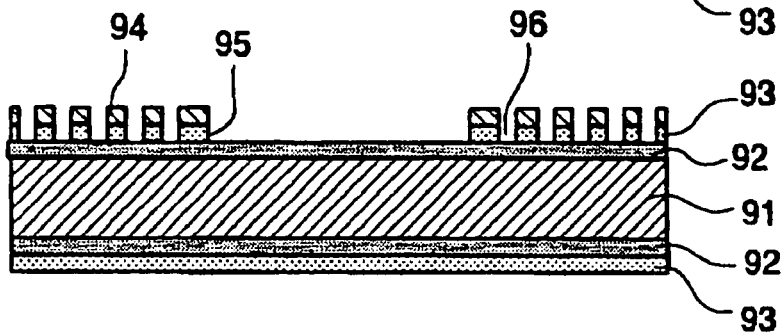

Then, as shown in FIG. 15B, on the nitride film 93 (on the nozzle plate-bonded side) of the silicon substrate 91 was formed a resist pattern 94 having the apertures for the nozzle-side channels 42 and the concave portions 31 for the redundant adhesive. Then, the apertures 95, 96 for the nozzle-side channels 42 and the concave portions 31 were patterned by the dry etching of the nitride film 93. A resist (not shown) was formed all over the non-etched sides of the silicon substrate 91*a*.

Figure 15C:
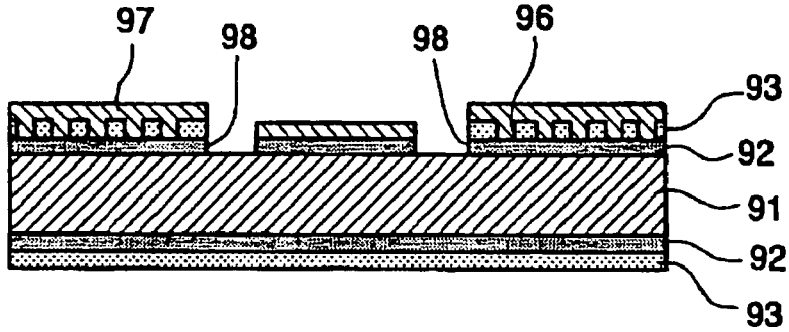

Then, as shown in FIG. 15C, after filling in the apertures 96 of the nitride film 93, a resist pattern 97 having the apertures whose geometry corresponds to the geometry of the communicating channels 44,45 was formed on the nitride film 93 (on the nozzle plate-bonded side) of the silicon substrate 91. Then, the apertures 98 for the communicating channels 44,45 were patterned by the dry etching of the silicon oxide film 92 using the resist pattern 97 as a mask.

Figure 15D:
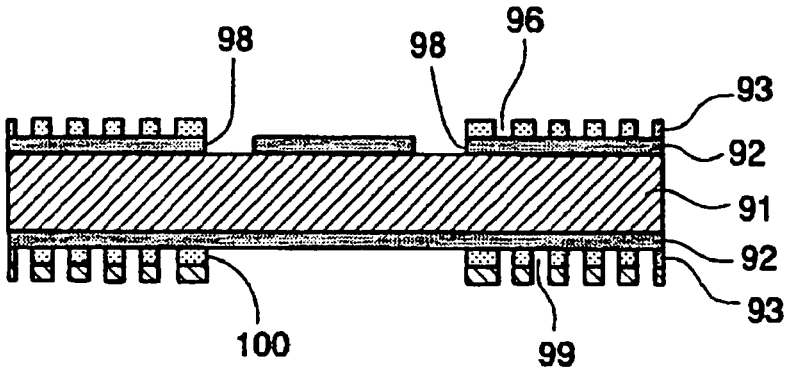

Then, as shown in FIG. 15D, on the nitride film 93 (on the diaphragm-bonded side) of the silicon substrate 91 was formed a resist pattern 69 having the apertures for the diaphragm-side channels 43 and the concave portions 32 for the redundant adhesive. Then, the apertures 100, 101 for the diaphragm-side channels 43 and the concave portions 32 were patterned by the dry etching of the nitride film 93.

Figure 15E:
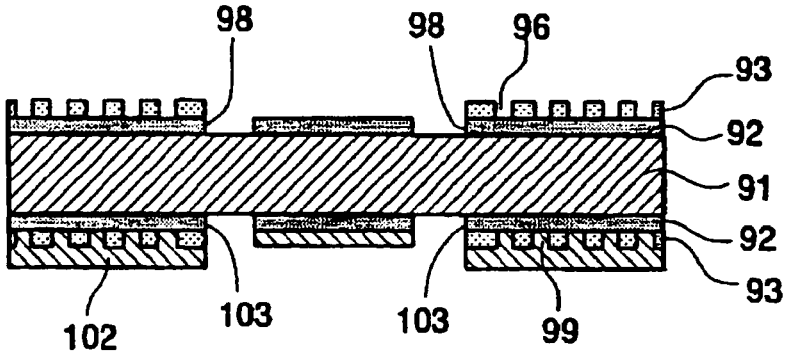

Then, as shown in FIG. 15E, after filling in the apertures 101 of the nitride film 93, a resist pattern 102 having the apertures whose geometry corresponds to the geometry of the communicating channels 44,45 was formed on the nitride film 93 (on the diaphragm-bonded side) of the silicon substrate 91. Then, the apertures 103 for the communicating channels 44,45 were patterned by the dry etching of the silicon oxide film 92 using the resist pattern 102 as a mask.

Figure 16A:
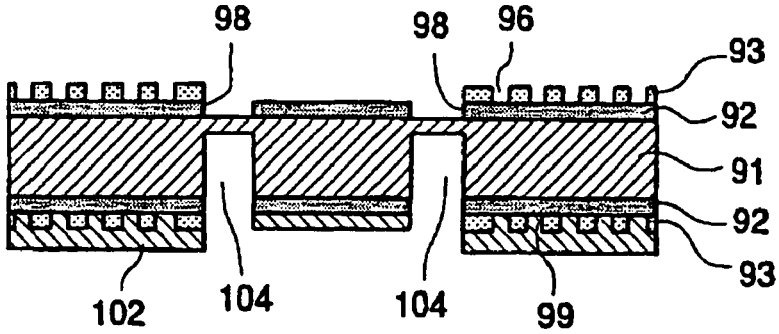
FIGS. 16A through 16E continue the example of the processes employed for producing the spacer 41 of the second embodiment.

Then, as shown in FIG. 16A, the holes 104 for the communicating channels 44,45 were patterned by the dry etching of the silicon substrate 91 from the diaphragm-bonded side using an ICP (Inductively Coupled Plasma) dry etcher. At that time, the film thickness of the resist 102 was 8 μm.

Figure 16B:
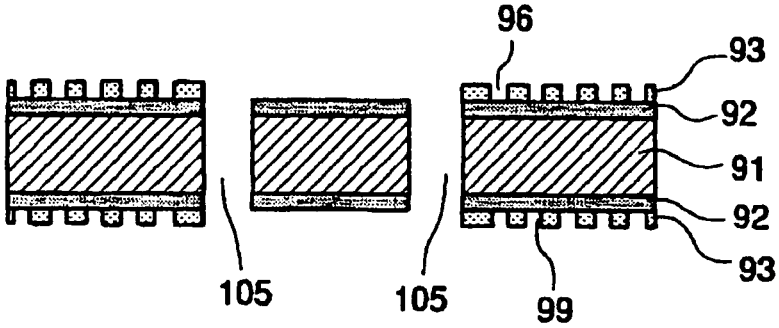

Then, as shown in FIG. 16B, after removing the resist 102, the through holes 105 for the communicating channels 44,45, which connect the diaphragm-side channels 43 to the nozzle-side channels 42, were formed by the anisotropic etching of the silicon substrate 91 using a potassium hydroxide solution.

Figure 16C:
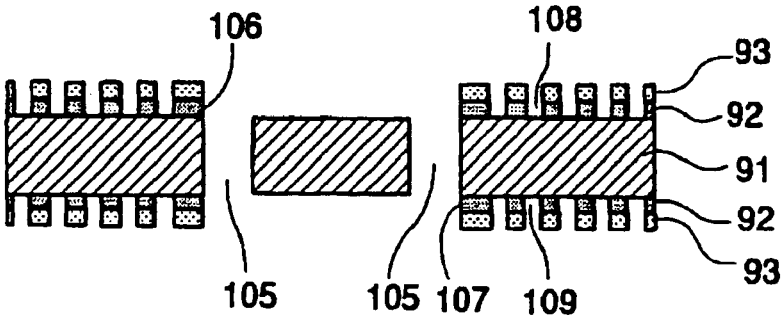

Then, as shown in FIG. 16C, the apertures 106, 107 for the nozzle-side channels 42 and the diaphragm-side channels 43 and the apertures 108, 109 for the concave portions 31,32 were patterned by the wet etching of the silicon oxide film 92 using dilute fluoric acid with the nitride film 93 as a mask.

Figure 16D:
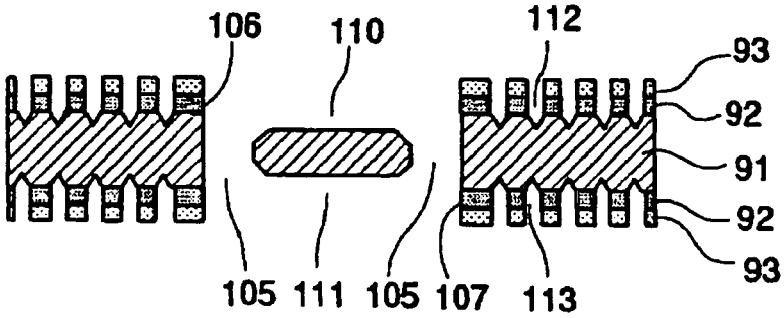

Then, as shown in FIG. 16D, the concave portions 110,111 corresponding to the nozzle-side channels 42 and the diaphragm-side channels 43, and the concave portions 31,32 were formed by the anisotropic etching of the silicon substrate 91 using a potassium hydroxide solution.

In this process, the concentration of the potassium hydroxide solution was 30% and the process temperature was 85° C. Further, the silicon substrate 91 (silicon wafer) was mechanically swayed. This swaying operation prevents the hydrogen generated at this etching process from adhering to the wall surfaces and thus enables the surface roughness (Ra) of the bottom surfaces (i.e., the surfaces opposed to the diaphragm 2) of the concave portions 111 corresponding to the pressure chambers 6 to be less than 2 μm.

Figure 16E:
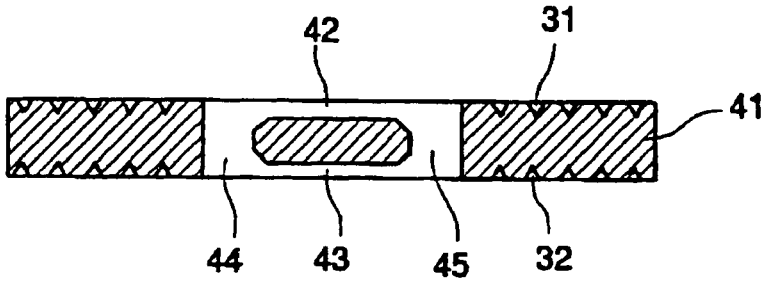

Then, as shown in FIG. 16E, the nitride film 93 and the silicon oxide film 92 were removed. Then, after the silicon oxide film of 1 μm thickness was formed as a fluid-proof film 10 (not shown), the processes for producing the spacer 41 were completed.

In the aforementioned processes, the special operation for making the surface roughness (Ra) less than 2 μm was carried out against the surfaces of the diaphragm-side channels 43 (pressure chambers) opposed to the diaphragm 2. Consequently, an ink jet printhead that can operate with a high degree of reliability and guarantee a smooth ink flow without the bubbles being snagged on the surfaces was obtained. Furthermore, since the spacer 41 was provided with the additional channels on its nozzle plate side (i.e., the nozzle-side channels 42) for supplying the ink, it was possible to sufficiently re-fill the ink even at high frequency operations and thus increase the printing speed.

Figure 17:
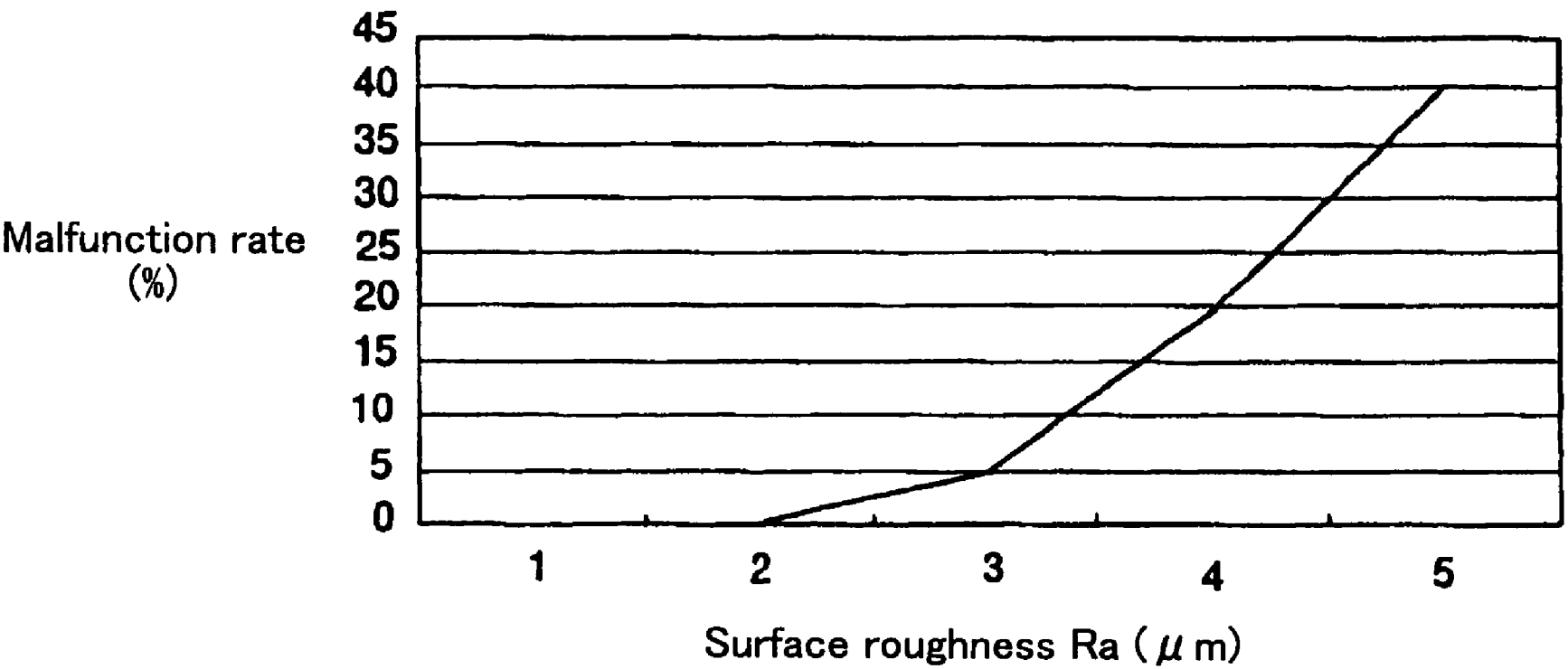
FIG. 17 shows the test results of an injection operation of the ink jet printhead equipped with the spacer 1.

Referring to FIG. 17, FIG. 17 shows the test results of an injection operation of the ink jet printhead equipped with the spacer 1 (the surface roughness (Ra) not greater than 2 μm), which was produced according to the aforementioned first embodiment. For a comparison, the process condition (i.e., the concentration and temperature of the potassium hydroxide solution and the condition relating to the adhesion of the bubbles) was varied so as to produce several test spacers with the respective surface roughness (Ra) of 3 μm, 4 μm, and 5 μm.

As shown in FIG. 17, it was found that the malfunction of the ink jet printhead such as a discharge malfunction and an empty-drop injection occurred in the case of the surface roughness (Ra) being greater than 2 μm. It was also found that the greater the surface roughness (Ra) became, the larger the potential for malfunction of the ink jet printhead became. As opposed to these test printheads, it was found that such malfunction didn't occur in the case of the ink jet printhead with the spacer 1 (the surface roughness (Ra) not greater than 2 μm) produced according to the present invention.

Figure 18:
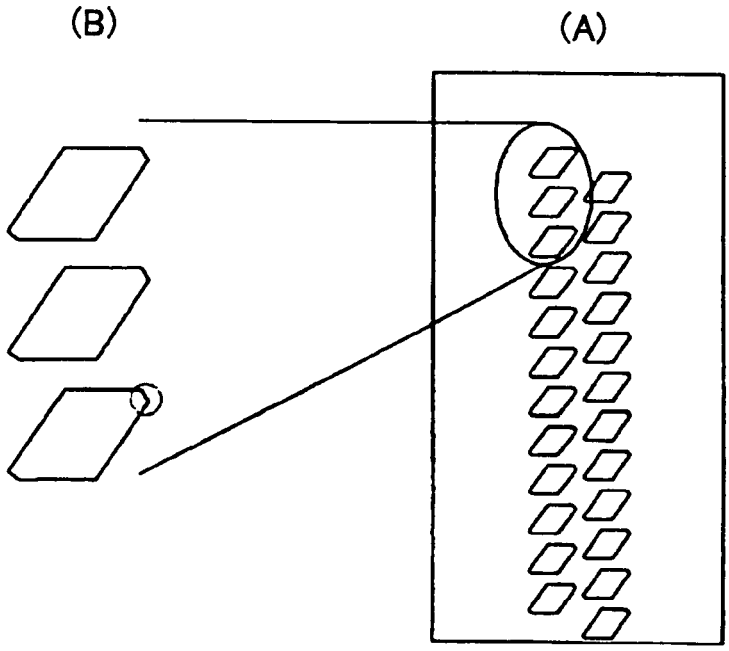
FIG. 18A shows a plan view of the nozzle plate-bonded surface of the spacer 11 according to the third embodiment.
FIG. 18B shows an enlarged detail of the nozzle communicating channels 55.
Figure 19:
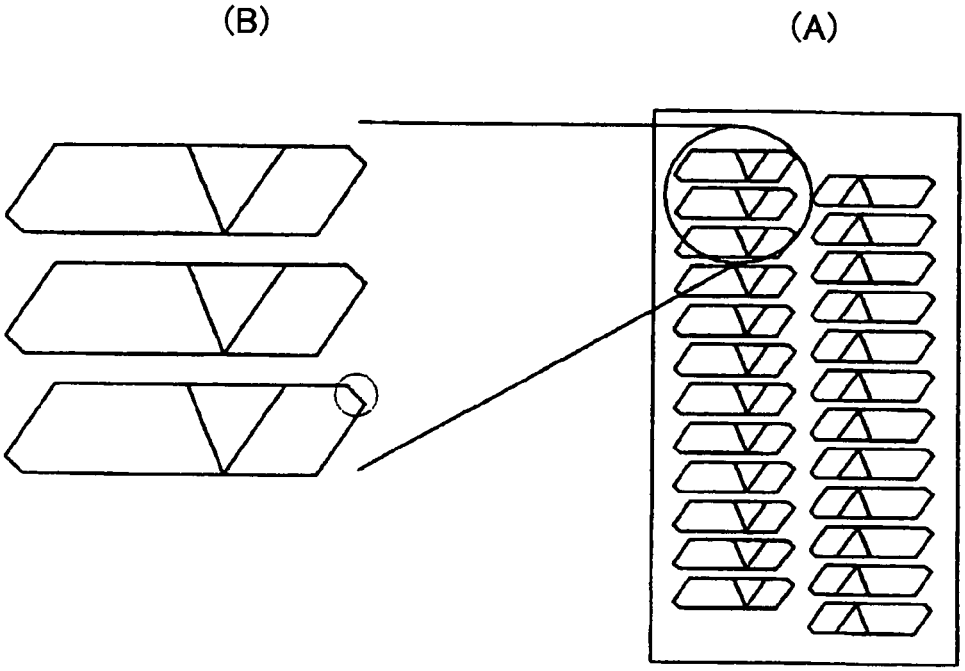
FIG. 19A shows a plan view of the spacer 11 for illustrating the diaphragm-bonded surface of the spacer 11.
FIG. 19B shows an enlarged detail of the pressure chambers 36.
Figure 20:
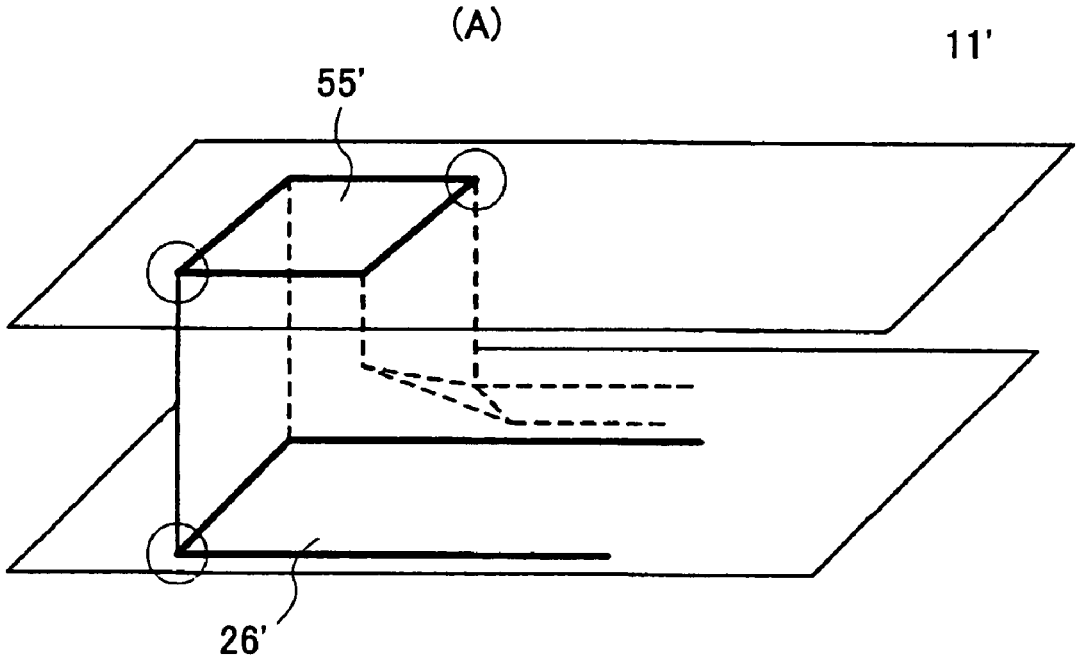
FIG. 20A shows a perspective view of the part of the spacer 11' according to a comparative embodiment.
FIG. 20B shows a perspective view of the part of the spacer 11 according to the third embodiment of the present invention.
Figure 20:
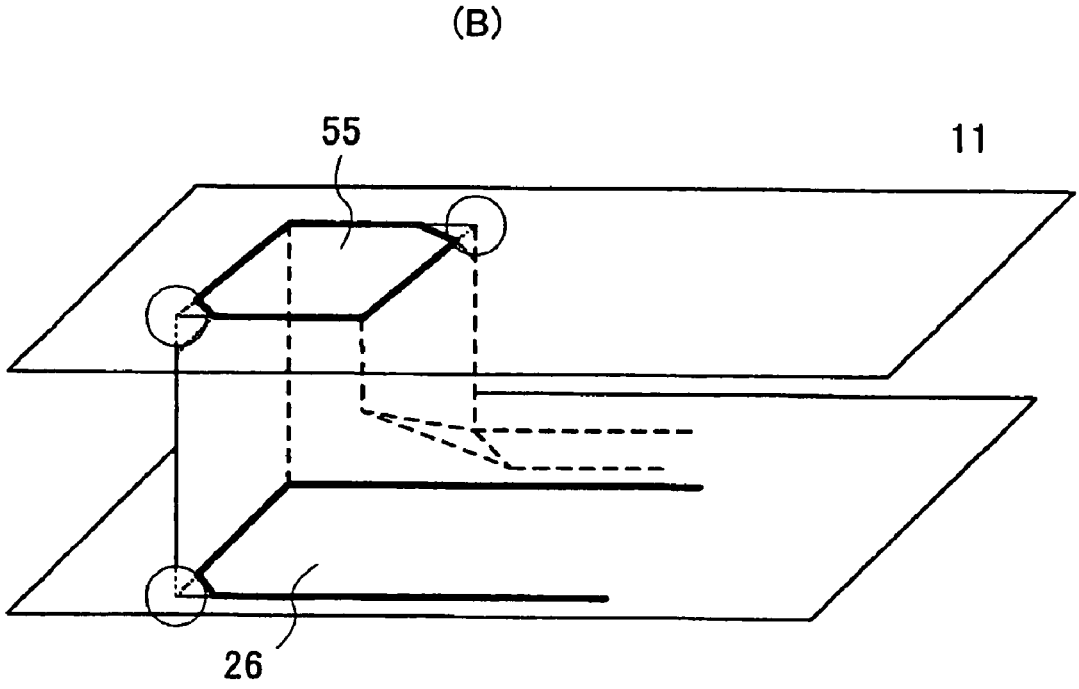

Next, the description will be directed to the third embodiment of the spacer according to the present invention with reference to FIGS. 18-20. Features similar to the features described with reference to FIGS. 1-4 are described with reference to FIGS. 18-20 using same reference symbols.

FIG. 18A shows a plan view of the spacer 11 according to the third embodiment for illustrating the nozzle plate-bonded surface of the spacer 11 and FIG. 18B shows an enlarged detail of the nozzle communicating channels 55. FIG. 19A shows a plan view of the spacer 11 for illustrating the diaphragm-bonded surface of the spacer 11 and FIG. 19B shows an enlarged detail of the pressure chambers 36. FIG. 20A shows a perspective view of the part (i.e., the part for printing one bit (dot)) of the spacer 11' according to a comparative embodiment and FIG. 20B shows a perspective view of the part of the spacer 11 according to the third embodiment of the present invention.

Figure 8:
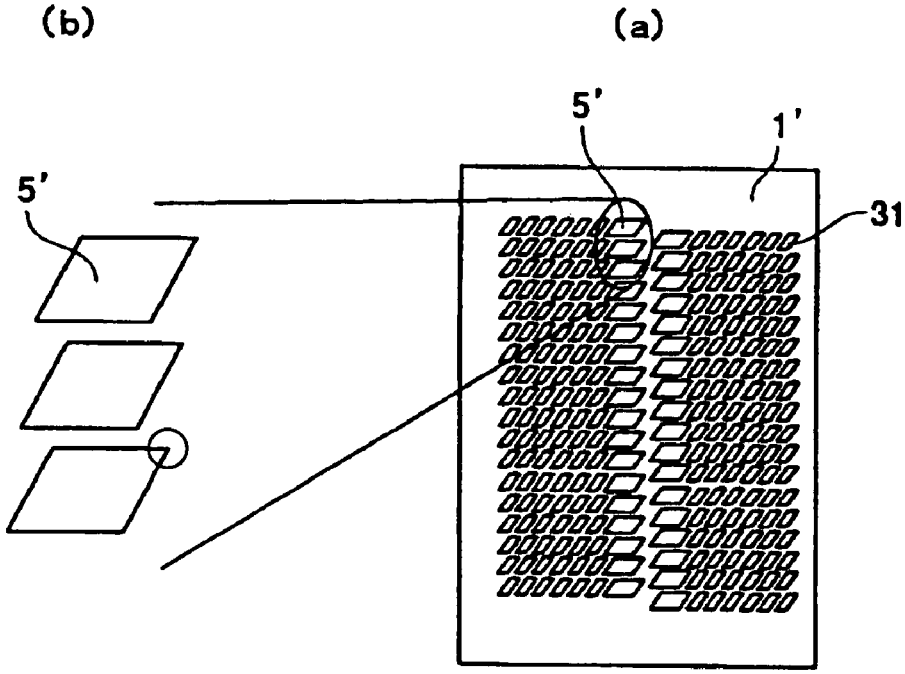
FIG. 8A shows a plan view of the nozzle plate-bonded surface of the spacer 1' according to a comparative embodiment.
FIG. 8B shows an enlarged detail of the nozzle communicating channels 5' of the spacer 1'.
Figure 9:
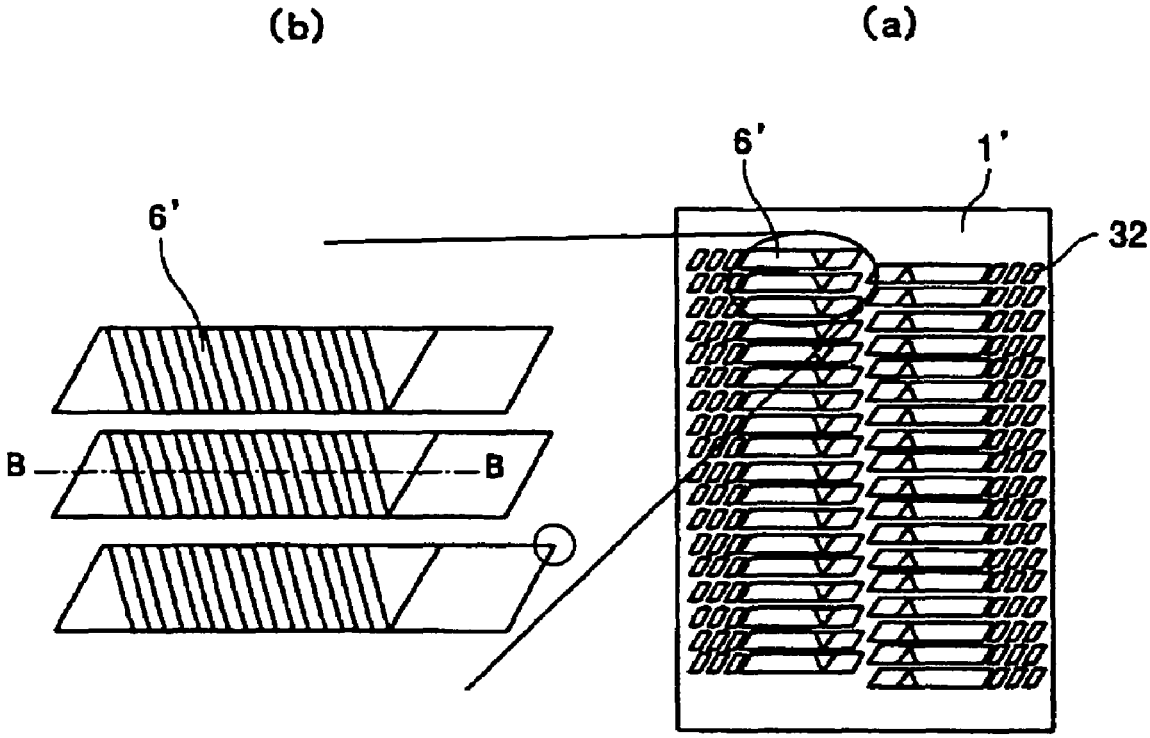
FIG. 9A shows a plan view of the diaphragm-bonded surface of the spacer 1' according to a comparative embodiment.
FIG. 9B shows an enlarged detail of the pressure chambers 6' of the spacer 1'.

Referring to FIG. 20B (and FIGS. 8,9) illustrating the comparative embodiment, the opening shape of the nozzle communicating channel 55' on the nozzle plate-bonded side is a parallelogram having two acute angle corners (indicated by a circle symbol in FIG. 20A and FIG. 9A), each of which is defined by two lines connected at an acute angle, and two obtuse angle corners (each of which defined by two lines connected at an obtuse angle) (see FIG. 8B). This opening shape increases the potential for retaining air bubbles and ink at the two acute angle corners. Likewise, the opening shape of the pressure chambers 36' immediately below the nozzle communicating channel 55' on the diaphragm-bonded side is defined by the three lines including the acute angle corner (indicated by a circle symbol in FIG. 20A and FIG. 9B). In the case of this opening shape, when the spacer 11' is bonded to the diaphragm 2 using an adhesive, the adhesive flows into the nozzle communicating channel 55' by capillary action, which causes a discharge malfunction or a deviation of ink drop trajectory.

On the contrary, according to the third embodiment, the opening shape of the nozzle communicating channel 55 on the nozzle plate-bonded side is defined by six lines connected by obtuse angles only and thus has six obtuse angle corners (see the circle symbol in FIG. 20B and FIG. 18B). Likewise, the opening shape of the pressure chamber 66 immediately below the nozzle communicating channel 55 on the diaphragm-bonded side is defined by the four lines connected at obtuse angles only and thus has two obtuse angle corners (indicated by the circle symbol in FIG. 20B and FIG. 19B). As opposed to the above-mentioned comparative opening shape, this opening shape can prevent the flow of the adhesive into the nozzle communicating channel 55 by capillary action and thus prevent a discharge malfunction or a deviation of ink drop trajectory.

Referring to FIG. 19A, according to the comparative embodiment, the inner surface of the nozzle communicating channel 55' in the immediate vicinity of the nozzle bore 4 is defined by four surfaces perpendicular to the nozzle plate-bonded surface of the spacer 11'. Likewise, the inner surface of the pressure chambers 36' on the diaphragm-bonded side is defined by three surfaces perpendicular to the diaphragm-bonded surface of the spacer 11'.

On the other hand, referring to FIG. 19B, according to the third embodiment, the inner surface of the nozzle communicating channel 55 in the immediate vicinity of the nozzle bore 4 is defined by four surfaces perpendicular to the nozzle plate-bonded surface of the spacer 11 and two inclined surfaces, which are connected to the nozzle plate-bonded surface at an acute angle (as viewed from the sectional view). Further, the inner surface of the pressure chamber 66 on the diaphragm-bonded side is defined by three surfaces perpendicular to the diaphragm-bonded surface of the spacer 11 and an inclined surface, which is connected to the diaphragm-bonded surface at an acute angle (as viewed from the sectional view). As opposed to the above-mentioned comparative embodiment, these inclined surfaces can prevent the retention of air bubbles and ink and thus prevent a malfunction such as a discharge malfunction and an empty-drop injection.

Furthermore, as has been discussed with reference to FIG. 19B, the cross-sectional profile of the nozzle communicating channel 55 changes from a tetragon inside the spacer 11 to a hexagon in the immediate vicinity of the nozzle bore 4. This cross-sectional profile can solve the problem such as a difficulty in flow control and an increased resistance against the flow due to complexity of the multi-dimensional inner surface (as disclosed in JP 7-178908A).

Referring to FIGS. 21, 22, one example of the processes employed for producing the spacer 11 of the aforementioned third embodiment is shown. Features similar to the features described with reference to FIGS. 12, 13 are described with reference to FIGS. 21, 22 using same reference symbols.

Figure 21A:
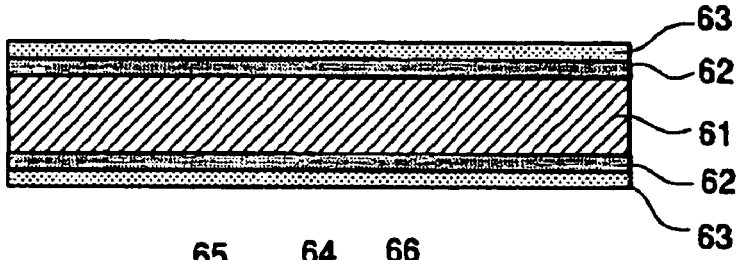
FIGS. 21A through 21E show one example of the processes employed for producing the spacer 11 of the third embodiment.

First of all, as shown in FIG. 21A, the single crystal silicon substrate 61 (in this example, silicon wafer base) with crystal orientation (110) of 400 μm thickness was provided. Then, on both sides of the silicon substrate 61 were formed a silicon oxide film 62 of 1.0 μm thickness and a nitride film 63 of 0.2 μm thickness. The nitride film 63 was formed by LP-CVD (low-pressure chemical vapor deposition).

Figure 21B:
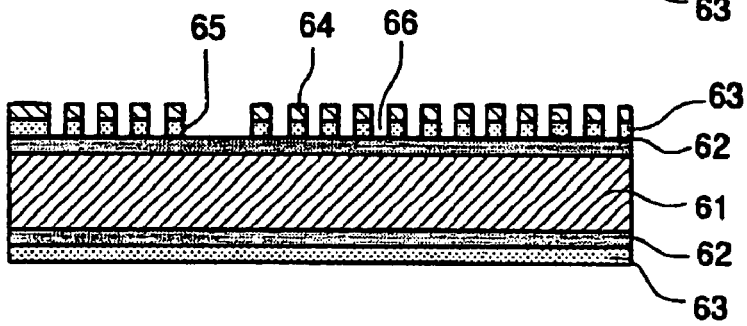

Then, as shown in FIG. 21B, on the nitride film 63 (on the nozzle plate-bonded side) of the silicon substrate 61 was formed a resist pattern 64 having the apertures for the nozzle communicating channels 55 and the concave portions 31 for the redundant adhesive. Then, the apertures 65, 66 for the nozzle communicating channels 55 and the concave portions 31 were patterned by the dry etching of the nitride film 63. At that time, the apertures 65 for the nozzle communicating channels 55 were patterned such as to be a hexagon defined by the six lines connected at obtuse angles.

Figure 21C:
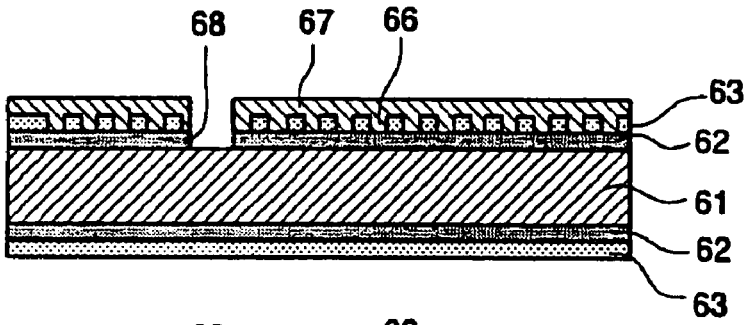

Then, on the nitride film 63 (on the nozzle plate-bonded side) of the silicon substrate 61 was formed a resist pattern 67 having the apertures whose geometry corresponds to the geometry of the nozzle communicating channels 55. Then, as shown in FIG. 21C, the apertures 68 for the nozzle communicating channels 55 were patterned by the dry etching of the silicon oxide film 62 using the resist pattern 67 as a mask.

Figure 21D:
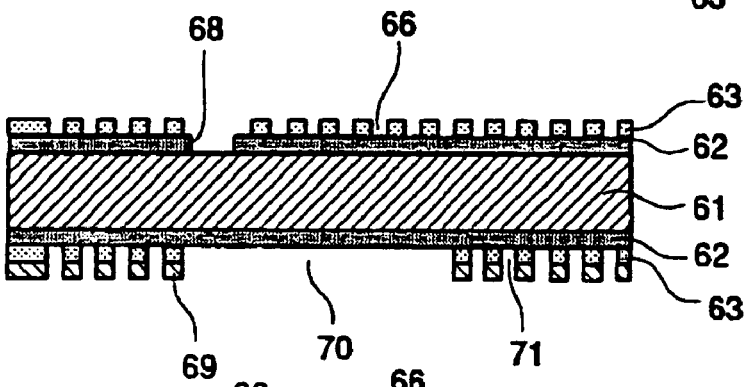

Then, as shown in FIG. 21D, on the nitride film 63 (on the diaphragm-bonded side) of the silicon substrate 61 was formed a resist pattern 69 having the apertures for the pressure chambers 36 and the concave portions 32 for the redundant adhesive. Then, the apertures 70, 71 for the pressure chambers 36 and the concave portions 32 were patterned by the dry etching of the nitride film 63.

Figure 21E:
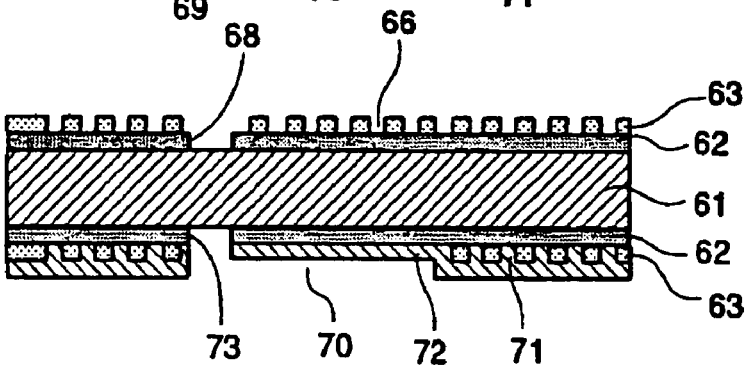

Then, on the nitride film 63 (on the diaphragm-bonded side) of the silicon substrate 61 was formed a resist pattern 72 having the apertures whose geometry corresponds to the geometry of the pressure chambers 36. Then, as shown in FIG. 21E, the apertures 73 for the pressure chambers 36 were patterned by the dry etching of the silicon oxide film 62 using the resist pattern 72 as a mask.

Figure 22A:
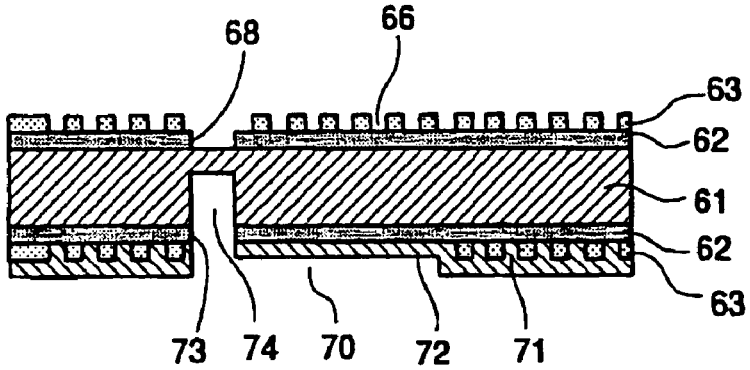
FIGS. 22A through 22E continue the example of the processes employed for producing the spacer 11 of the third embodiment.

Then, as shown in FIG. 22A, the holes 74 for the nozzle communicating channels 55 were patterned by the dry etching of the silicon substrate 61 from the diaphragm-bonded side using an ICP (Inductively Coupled Plasma) dry etcher. At that time, the film thickness of the resist 72 was 8 μm. The dry etching using the ICP dry etcher was terminated when the depth of the holes 74 reached 300 μm.

Figure 22B:
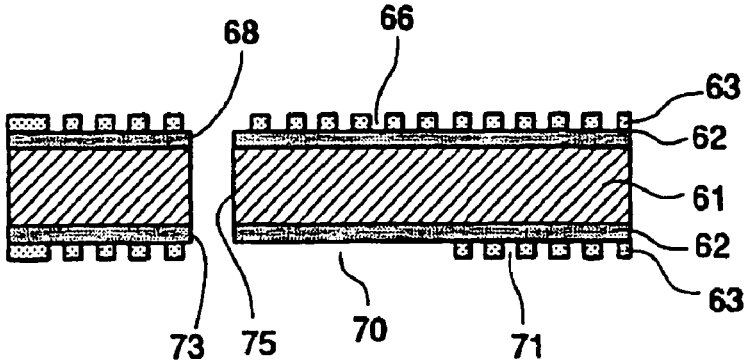

Then, as shown in FIG. 22B, after removing the resist 72, the through holes 75 for the nozzle communicating channel 5 were formed by the anisotropic etching of the silicon substrate 61 using a potassium hydroxide solution. This anisotropic etching process was performed from both sides (i.e., the nozzle plate-bonded side and the diaphragm-bonded side) of the silicon substrate 61. Although the inclined portions were created by anisotropic etching just after the through holes 75 were created (i.e., just after the silicon substrate 61 was first penetrated through by the anisotropic etching), the inclined portions were removed completely by this etching process.

Figure 22C:
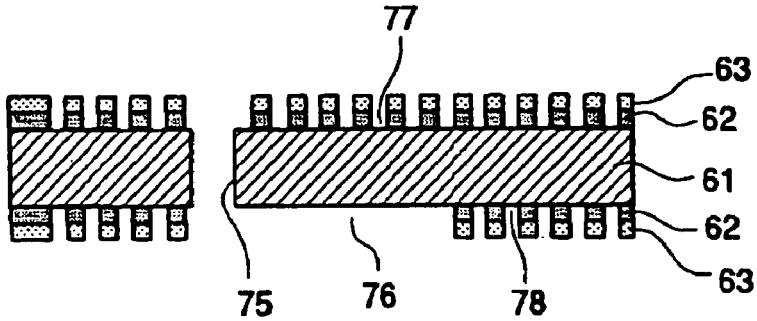

Then, as shown in FIG. 22C, the apertures 76 for the pressure chambers 36 and the apertures 77, 78 for the concave portions 31,32 were patterned by the wet etching of the silicon oxide film 62 using dilute fluoric acid with the nitride film 63 as a mask.

Figure 22D:
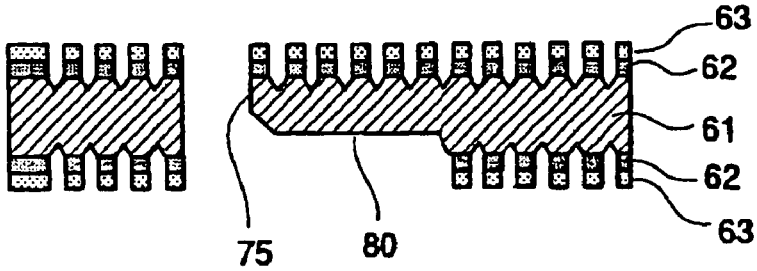

Then, as shown in FIG. 22D, the concave portions 80 corresponding to the pressure chambers 36 and the concave portions 31,32 were formed by the anisotropic etching of the silicon substrate 61 using a potassium hydroxide solution.

Figure 22E:
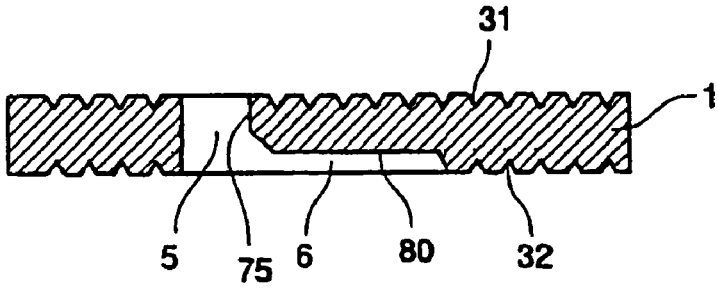

Then, as shown in FIG. 22E, the silicon oxide film 62 and the nitride film 63 were removed. Then, after the silicon oxide film of 1 μm thickness was formed as a fluid-proof film 10 (not shown), the processes for producing the spacer 11 were completed.

In this way, according to this embodiment, the opening shape of the nozzle communicating channel 55 in the nozzle plate-bonded surface of the spacer 11 is defined by the six lines connected at obtuse angles and the opening shape of the pressure chambers 36 immediately below the nozzle communicating channel 55 in the diaphragm-bonded surface is defined by the four lines connected at obtuse angles. Accordingly, by not forming any acute angle corners, it becomes possible to prevent the flow of the adhesive into the nozzle communicating channel 55 by capillary action at a subsequent process in which the spacer 11 is bonded to the nozzle plate 3 using the adhesive. Furthermore, by forming the inclined surfaces, it becomes possible to prevent the retention of air bubbles and ink and thus improve the reliability of the ink jet printhead.

Figure 23:
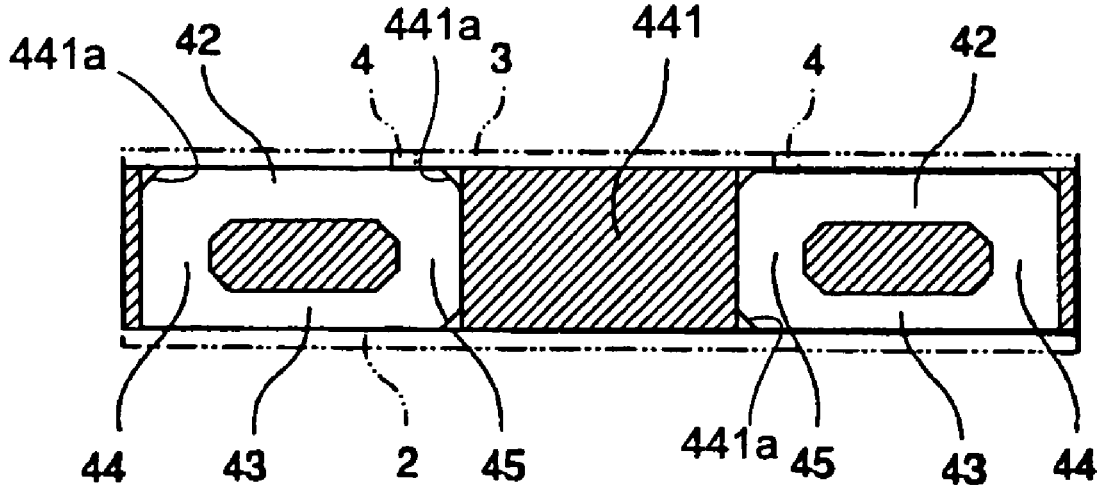
FIG. 23 shows a sectional view of the spacer 441 of the fourth embodiment.

Next, the description will be directed to the fourth embodiment of the spacer according to the present invention with reference to FIG. 23. Features similar to the features described with reference to FIG. 11 are described with reference to FIG. 23 using same reference symbols. The spacer 441 of this fourth embodiment has double-sided ink channels as discussed with reference to FIG. 11. The spacer 441 of this fourth embodiment has a structure identical to that of the spacer 41 of the aforementioned second embodiment except that the inclined surfaces 441*a* are formed at the corners of the nozzle-side channels 42 and the diaphragm-side channels 43, as is the case with the aforementioned third embodiment. The opening shape (not shown) of the nozzle-side channel 42 immediately below the nozzle bore 4 is defined by the four lines connected at obtuse angles, as is the case with the aforementioned third embodiment. Likewise, The opening shape (not shown) of the diaphragm-side channels 43 immediately below the nozzle bore 4 is defined by the four lines connected at obtuse angles, as is the case with the aforementioned third embodiment.

According to the fourth embodiment, by not forming any acute angle corners of the opening shape on both sides of the spacer 441, it becomes possible to prevent the flow of adhesive into the communicating channels 44,45 by capillary action when the spacer 441 is bonded to the nozzle plate 3 using the adhesive. Furthermore, by forming the inclined surfaces, it becomes possible to prevent the retention of the air bubbles and ink and thus improve the reliability of the ink jet printhead. Furthermore, by forming the additional channels on the nozzle plate side (i.e., the nozzle-side channels 42) for supplying the ink, it becomes possible to sufficiently re-fill the ink even at the high frequency operations and thus to improve the printing speed.

Referring to FIGS. 24, 25, one example of the processes employed for producing the spacer 441 of the aforementioned fourth embodiment is shown. Features similar to the features described with reference to FIGS. 15, 16 are described with reference to FIGS. 24, 25 using same reference symbols.

Figure 24A:
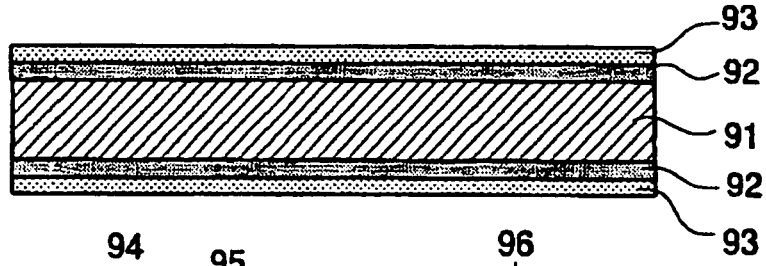
FIGS. 24A through 24E show one example of the processes employed for producing the spacer 441 of the fourth embodiment.

First of all, as shown in FIG. 24A, the single crystal silicon substrate 91 (in this example, silicon wafer base) with crystal orientation (110) of 400 μm thickness was provided. Then, on both sides of the silicon substrate 91 were formed a silicon oxide film 92 of 1.0 μm thickness and a nitride film 93 of 0.2 μm thickness. The nitride film 93 was formed by LP-CVD (low-pressure chemical vapor deposition).

Figure 24B:
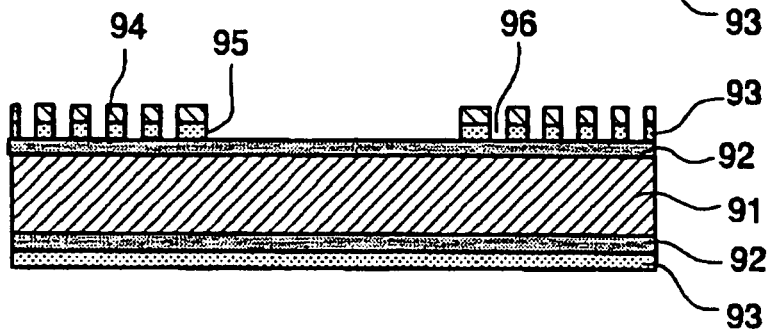

Then, as shown in FIG. 24B, on the nitride film 93 (on the nozzle plate-bonded side) of the silicon substrate 91 was formed a resist pattern 94 having the apertures for the nozzle-side channels 42 and the concave portions 31 for the redundant adhesive. Then, the apertures 95, 96 for the nozzle-side channels 42 and the concave portions 31 were patterned by the dry etching of the nitride film 93. At that time, the apertures 95 for the communicating channels 45 were patterned such as to be defined by the four lines connected at obtuse angles.

Figure 24C:
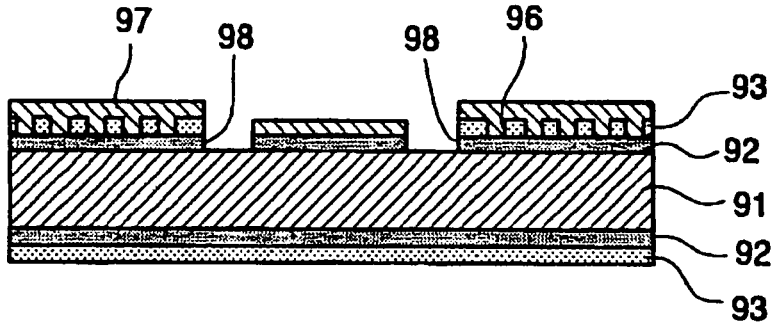

Then, on the nitride film 93 (on the nozzle plate-bonded side) of the silicon substrate 91 was formed a resist pattern 97 having the apertures whose geometry corresponds to the geometry of the communicating channels 44,45. Then, as shown in FIG. 24C, the apertures 98 for the communicating channels 44,45 were patterned by the dry etching of the silicon oxide film 92 using the resist pattern 97 as a mask.

Figure 24D:
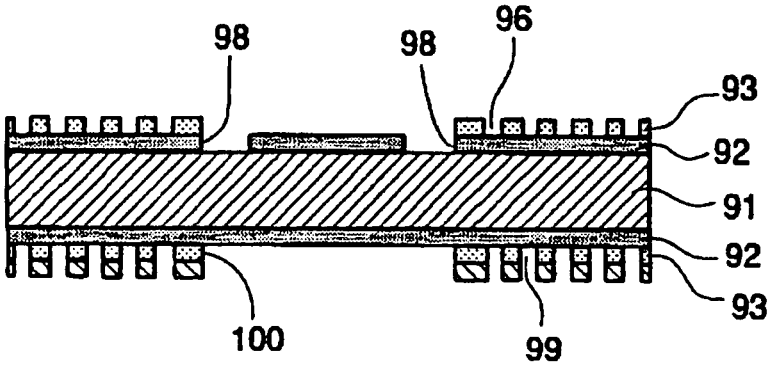

Then, as shown in FIG. 24D, on the nitride film 93 (on the diaphragm-bonded side) of the silicon substrate 91 was formed a resist pattern 69 having the apertures for the diaphragm-side channels 43 and the concave portions 32 for the redundant adhesive. Then, the apertures 100, 101 for the diaphragm-side channels 43 and the concave portions 32 were patterned by the dry etching of the nitride film 93.

Figure 24E:
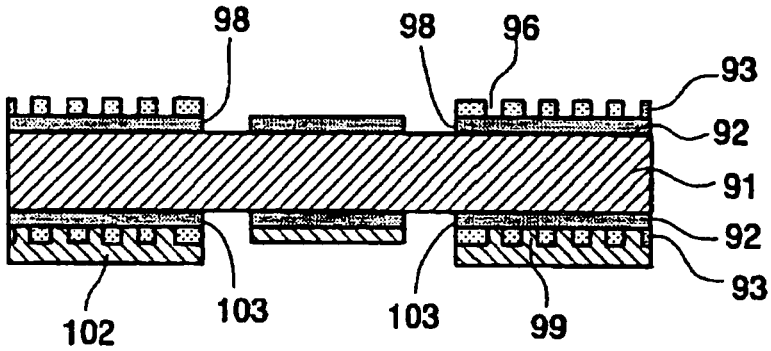

Then, on the nitride film 93 (on the diaphragm-bonded side) of the silicon substrate 91 was formed a resist pattern 102 having the apertures whose geometry corresponds to the geometry of the communicating channels 44,45. Then, as shown in FIG. 24E, the apertures 103 for the communicating channels 44,45 were patterned by the dry etching of the silicon oxide film 92 using the resist pattern 102 as a mask.

Figure 25A:
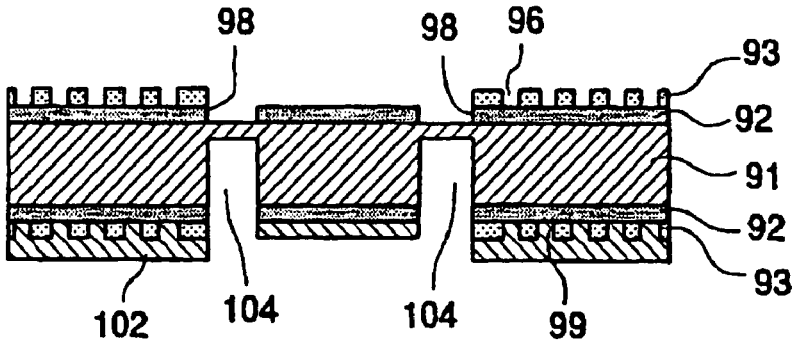
FIGS. 25A through 25E continue the example of the processes employed for producing the spacer 441 of the fourth embodiment.

Then, as shown in FIG. 25A, the holes 104 for the communicating channels 44,45 were patterned by the dry etching of the silicon substrate 91 from the diaphragm-bonded side using an ICP (Inductively Coupled Plasma) dry etcher. At that time, the film thickness of the resist 102 was 8 μm.

Figure 25B:
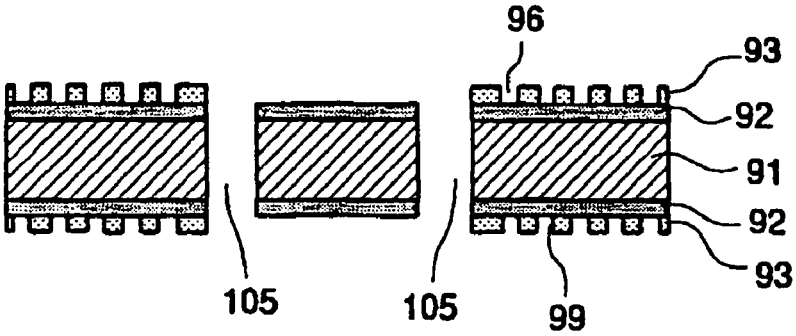

Then, as shown in FIG. 25B, after removing the resist 102, the through holes 105 for the communicating channels 44,45, which connect the diaphragm-side channels 43 to the nozzle-side channels 42, were formed by the anisotropic etching of the silicon substrate 91 using a potassium hydroxide solution.

Figure 25C:
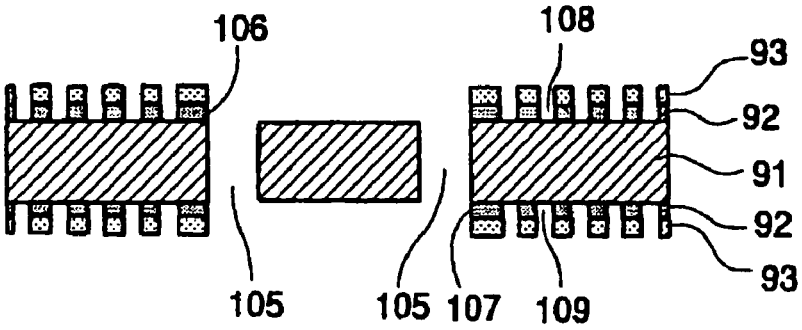

Then, as shown in FIG. 25C, the apertures 106, 107 for the nozzle-side channels 42 and the diaphragm-side channels 43, and the apertures 108, 109 for the concave portions 31,32 were patterned by the wet etching of the silicon oxide film 92 using dilute fluoric acid with the nitride film 93 as a mask.

Figure 25D:
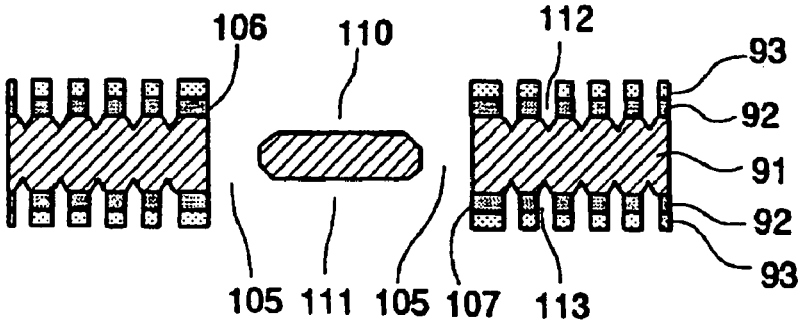

Then, as shown in FIG. 25D, the concave portions 110,111 corresponding to the nozzle-side channels 42 and the diaphragm-side channels 43, and the concave portions 31,32 were formed by the anisotropic etching of the silicon substrate 91 using a potassium hydroxide solution.

Figure 25E:
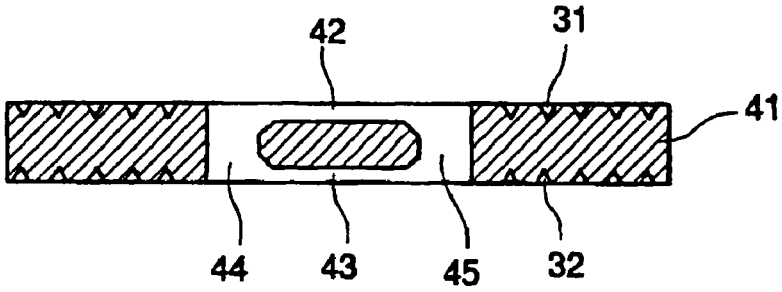

Then, as shown in FIG. 25E, the nitride film 93 and the silicon oxide film 92 were removed. Then, after the silicon oxide film of 1 μm thickness was formed as a fluid-proof film 10 (not shown), the processes for producing the spacer 441 were completed.

Next, the description will be directed to the fifth embodiment of the spacer according to the present invention with reference to FIGS. 26-29.

Figure 26:
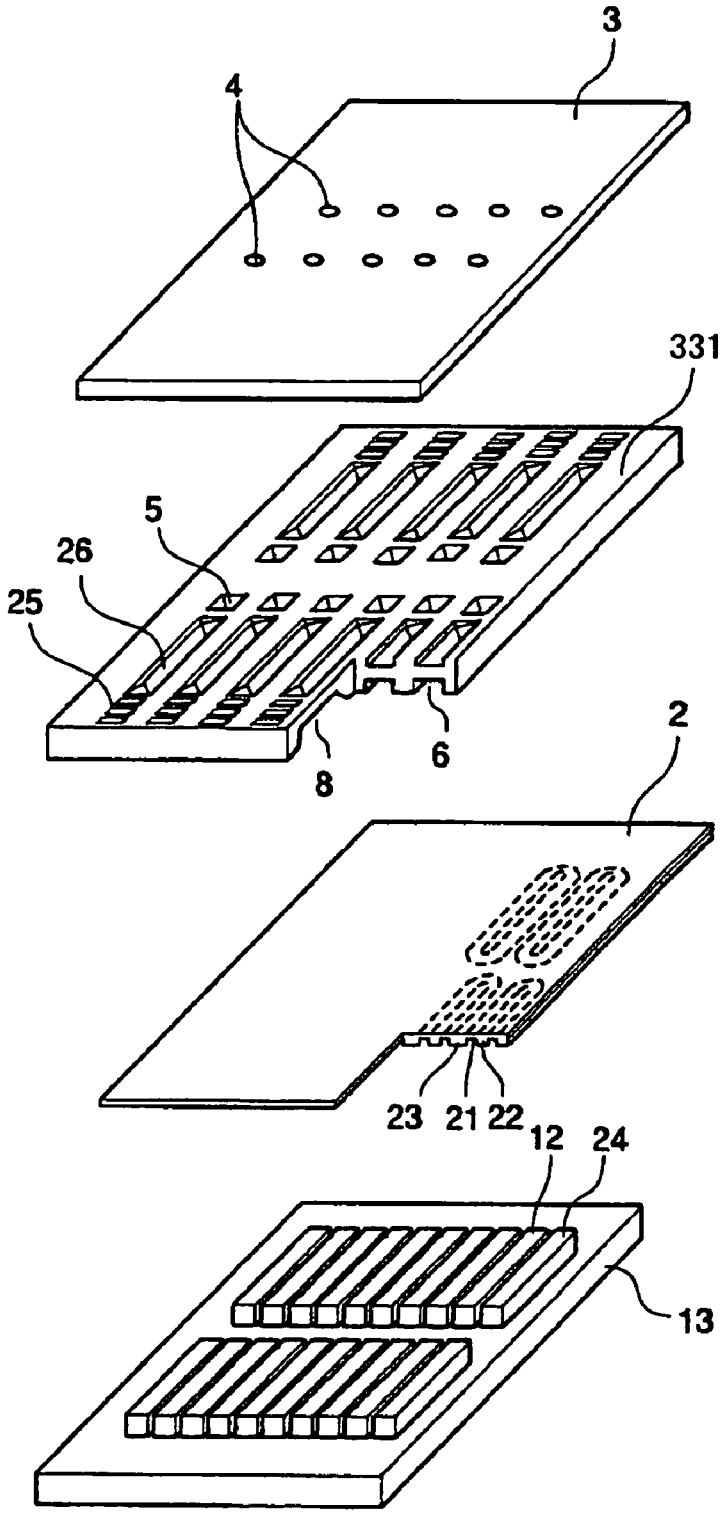
FIG. 26 shows an exploded perspective view of another ink jet printhead according to the present invention.
Figure 27:
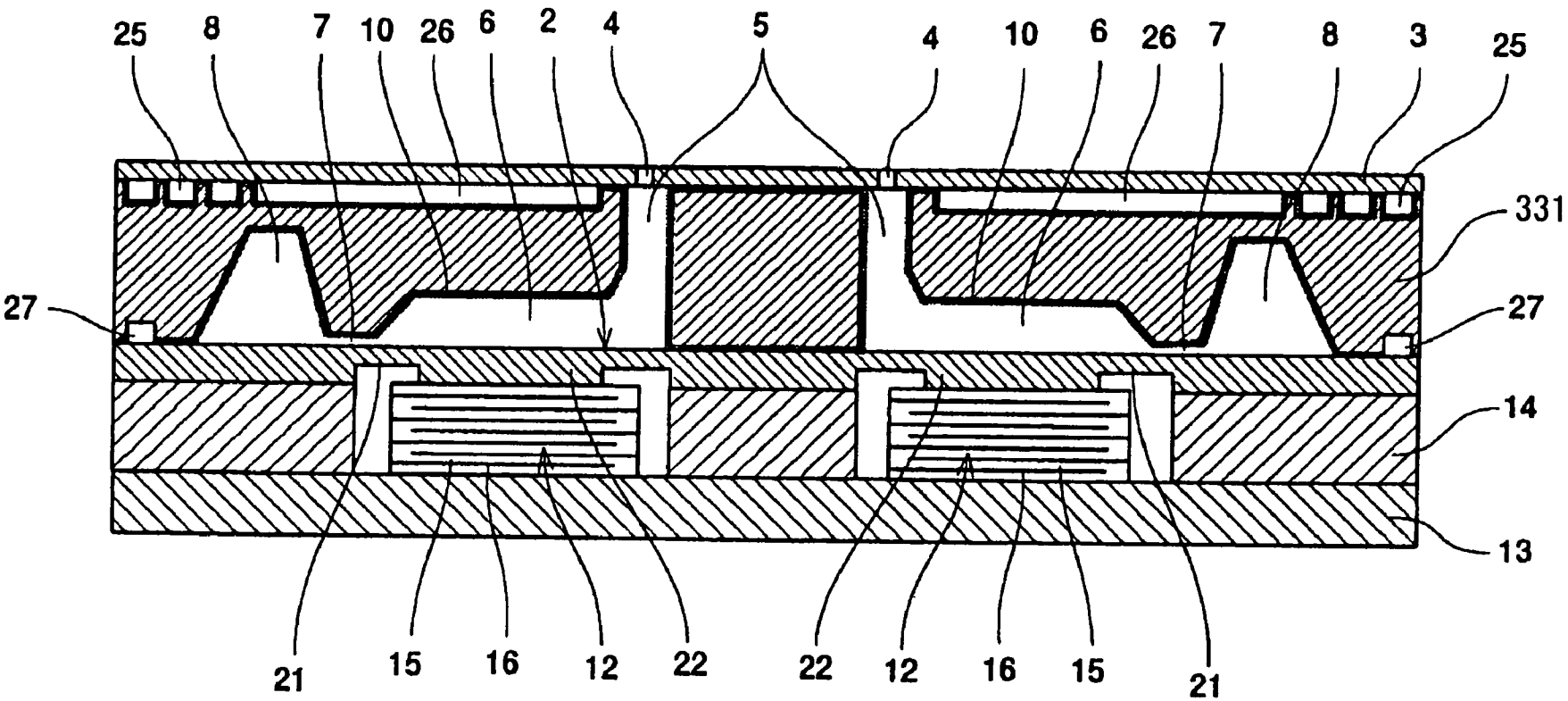
FIG. 27 shows a sectional view taken along a longitudinal direction of the ink jet printhead of FIG. 26.
Figure 28:
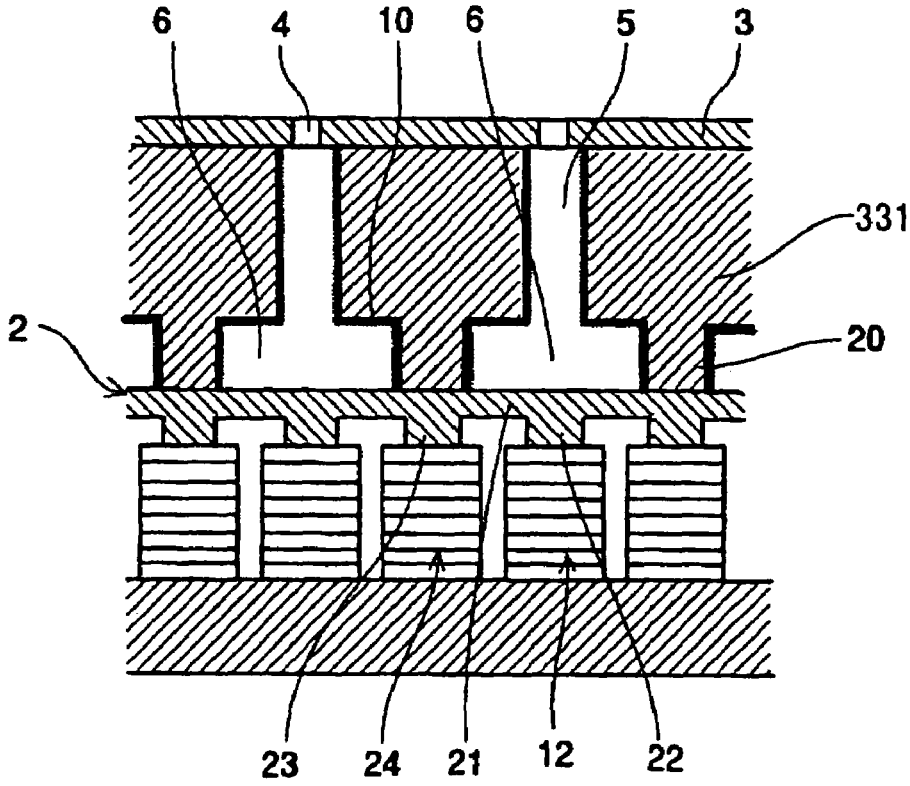
FIG. 28 shows a sectional view taken along lateral direction of the main parts of the ink jet printhead of FIG. 26.
Figure 29:
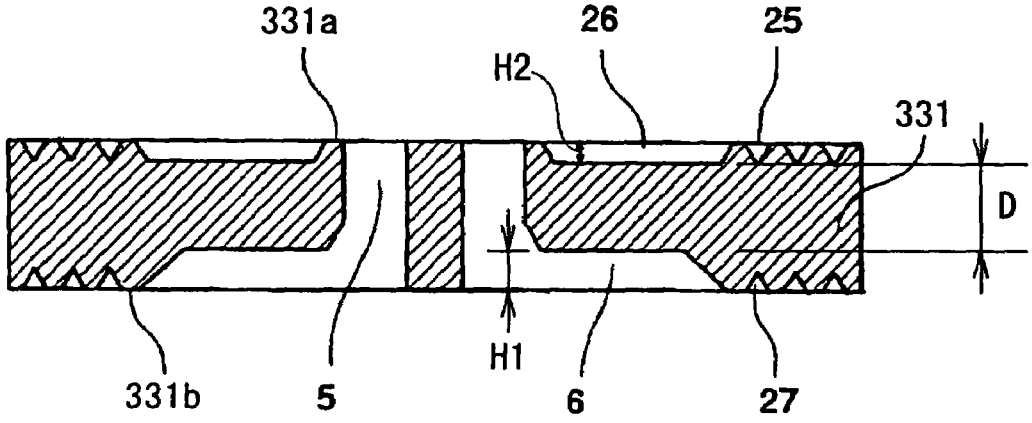
FIG. 29 shows a sectional view of a spacer 331 of the ink jet printhead of FIG. 26.

FIG. 26 shows an exploded perspective view of the ink jet printhead. FIG. 27 shows a sectional view taken along a longitudinal direction of the ink jet printhead. FIG. 28 shows a sectional view taken along lateral direction of the main parts of the ink jet printhead. FIG. 29 shows a sectional view of a spacer (excluding the reservoir 8 and the resistance channels 7) of the ink jet printhead. Features similar to the features described with reference to FIGS. 1-4 are described with reference to FIGS. 26-29 using same reference symbols.

The spacer 331 of this fourth embodiment has a structure identical to that of the spacer 1 of the aforementioned first embodiment except that the spacer 331 has pseudo-pressure chambers 26 (which doesn't constitute ink channel) and concave portions 25 formed on the nozzle plate-bonded side and has concave portions 27 formed on diaphragm-bonded side. The concave portions 25, 27 accept the redundant adhesive that overflows when the spacer 331 is bonded to the nozzle plates 3 and the diaphragm 2, respectively.

By the way, in the aforementioned first embodiment, the spacer 1 has the pressure chambers 6, the resistance channels 7, and the reservoir 8 formed on the nozzle plate-bonded side (see FIGS. 1-4). However, in this state, the difference in the surface area between the nozzle plate-bonded surface and the diaphragm-bonded surface is large. It should be noted that the surface area is determined based on the surface of the spacer making contact with the surface of the target member (i.e., the nozzle plate 3 and the diaphragm 2). In other words, in this case, the surface area of the nozzle plate-bonded surface is determined by not counting the concave surface relating to the nozzle communicating channels 5. Likewise, the surface area of the diaphragm-bonded surface is determined by not counting in the concave surface relating to the pressure chambers 6, the resistance channels 7, and the reservoir 8.

The larger the difference in the surface area between the nozzle plate-bonded surface and the diaphragm-bonded surface becomes, the larger the potential for the occurrence of the distortion (bowing) of the spacer becomes because of the occurrence of stress inside the fluid-proof film 10. Especially, in the case of the fluid-proof film 10 formed by a highly fluid-proof material such as silicon oxide and titanium nitride, the distortion (bowing) of the spacer is more likely to occur.

For this reason, the spacer 331 according to the fifth embodiment is formed such that the surface area of the nozzle plate-bonded surface is substantially equal to that of the diaphragm-bonded surface. Specifically, this substantially same surface area is achieved by forming the pseudo-pressure chambers 26 and concave portions 25 on the nozzle plate-bonded side of the spacer 331 and the concave portions 27 on diaphragm-bonded side.

In the case of forming fluid-proof film 10 on the wall surfaces of the ink channel, this substantially same surface area between both sides of the spacer 331 attenuates the difference in stress in the films between both sides and thus relieves the distortion (bowing) of the spacer 331. Therefore, it becomes possible to improve the reliability of the bonding between the spacer 331 and the nozzle plate 3, and the bonding between the spacer 331 and the diaphragm 2. Furthermore, minimizing faulty bonding during manufacturing enables improvement in yield and thus cost reduction.

Figure 30A:
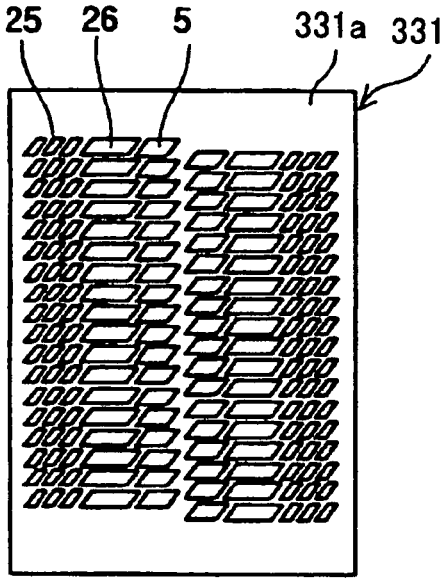
FIG. 30A shows a plan view of the nozzle plate-bonded surface of the spacer 331.
Figure 30B:
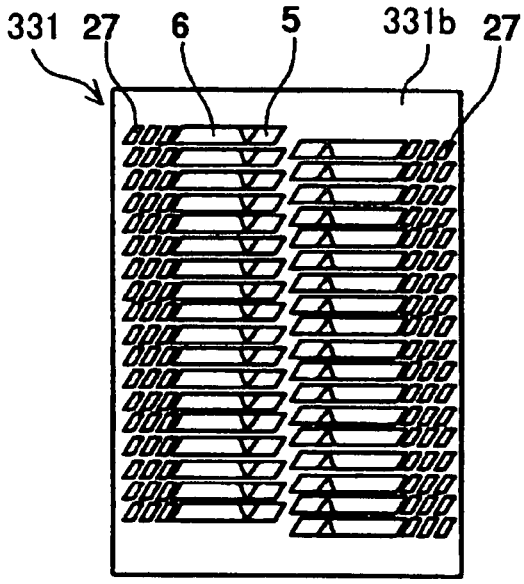
FIG. 30B shows a plan view of the diaphragm-bonded surface of the spacer 331.

As for a detailed explanation, referring to FIGS. 29-31, FIG. 30A shows a plan view of the nozzle plate-bonded surface of the spacer 331 and FIG. 30B shows a plan view of the diaphragm-bonded surface of the spacer 331. FIG. 31A shows a plan view of the nozzle plate-bonded surface of the spacer 331' according to a comparative embodiment and FIG. 31B shows a plan view of the diaphragm-bonded surface of the spacer 331'.

Figure 31A:
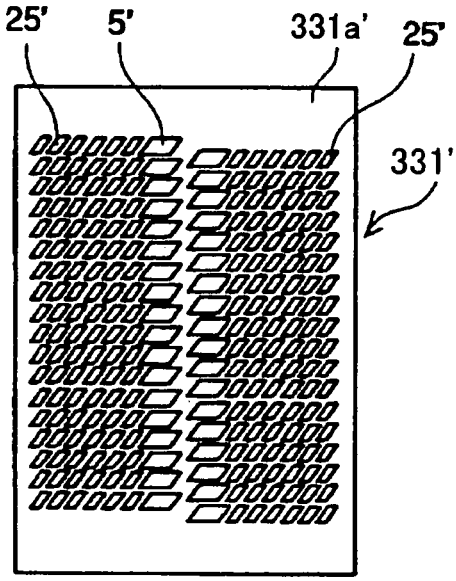
FIG. 31A shows a plan view of the nozzle plate-bonded surface of the spacer 331' according to a comparative embodiment.
Figure 31B:
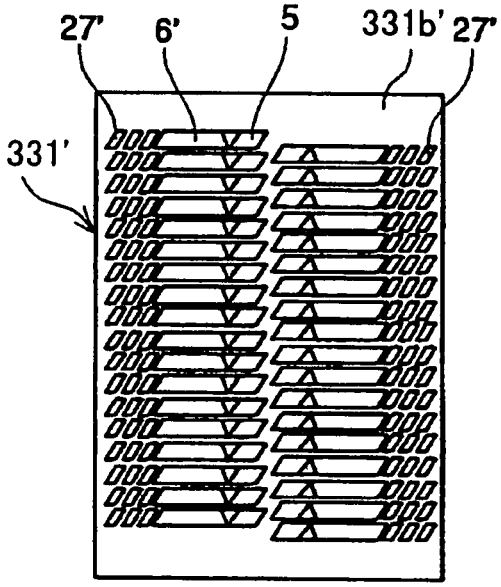
FIG. 31B shows a plan view of the diaphragm-bonded surface of the spacer 331'.

As shown in FIGS. 30B, 31B, on the diaphragm-bonded surfaces 331*b*, 331*b*' the spacers 331, 331' have the concave portions corresponding to the pressure chambers 6,6' and the concave portions 27,27' for accepting the redundant adhesive formed in an analogous fashion. Thus, the concave pattern on diaphragm-bonded surface 331*b* of the spacer 331 is same as that of the diaphragm-bonded surface 331*b*' of the spacer 331'.

On the other hand, as shown in FIGS. 30A, 31A, the concave pattern on the nozzle plate-bonded surface 331*a* of the spacer 331 is different from that of the nozzle plate-bonded surface 331*a*' of the spacer 331'. Specifically, the spacer 331' according to the comparative embodiment has a plurality of the nozzle communicating channels 5 and the concave portions 57' for accepting the redundant adhesive, while the spacer 331 according to the present invention has a plurality of the pseudo-pressure chambers 26 (the concave portions whose opening shapes are similar to the opening shapes of pressure chambers 6) and a plurality of the concave portions 25.

Thus, according to the comparative embodiment, the difference in the concave profile and thus the surface area between the nozzle plate-bonded surface 331*a*' and the diaphragm-bonded surface 331*b*' is large. It has been determined through experiments that the distortion of such spacer 331' exceeds 6 μm in the case of forming the silicon oxide of 7000Å thickness as a fluid-proof film. In this case, the faulty bonding will occur when the spacer 331' is bonded to the nozzle plate 3 or the diaphragm 2. Although the increased thickness of the adhesive can prevent the faulty bonding to some extent, this increases the overflow of the adhesive and brings about the disadvantage in terms of the stiffness of the overall assembly.

On the contrary, according to the fifth embodiment, there is substantially no difference in the concave profile and thus the surface area between the nozzle plate-bonded surface 331*a* and the diaphragm-bonded surface 331*b*, because the spacer 331 has the pseudo-pressure chambers 26 on the nozzle plate-bonded side according to the pressure chambers 6 formed on the diaphragm-bonded side. It has been determined through experiments that the distortion of the spacer 331 doesn't exceed 2 μm in the case of forming the silicon oxide of 7000Å thickness as a fluid-proof film and such a distortion level (i.e., 2 μm) cannot cause faulty bonding when the spacer 331 is bonded to the nozzle plate 3 or the diaphragm 2.

Figure 32:
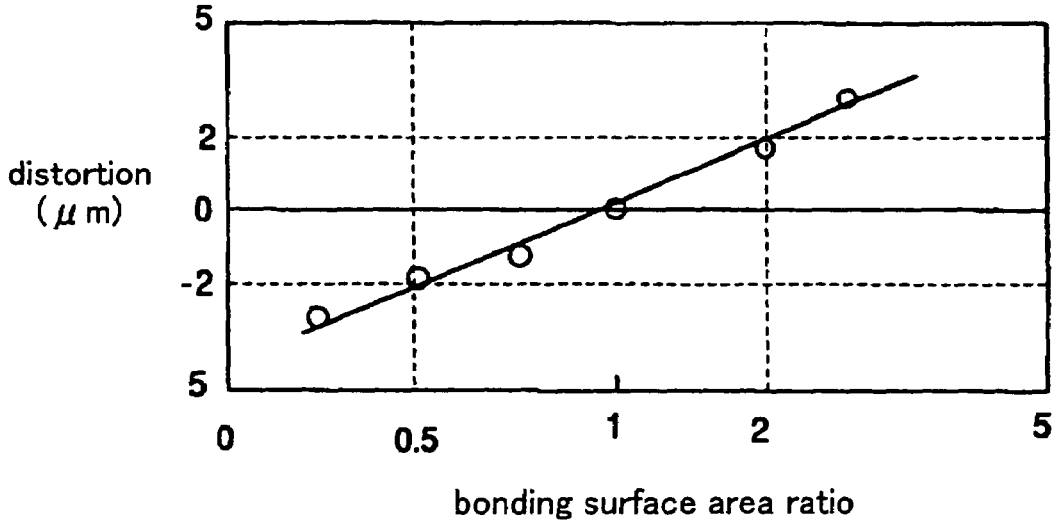
FIG. 32 shows a measured test result of the relationship between the ratio of the diaphragm-bonded surface area to the nozzle plate-bonded surface area and distortion level of the spacer.

Referring to FIG. 32, FIG. 32 shows a measured test result of the relationship between surface area ratio of the diaphragm-bonded surface to the nozzle plate-bonded surface and distortion level of the spacer in the case of forming the silicon oxide of 1 μm thickness.

It can be understood from the measured test result of FIG. 32 that the surface area ratio should be within 0.5-2.0 in order to make the distortion level of the spacer be less than 2 μm. The spacer with a distortion level less than 2 μm can substantially prevent the faulty bonding due to distortion.

Figure 33A:
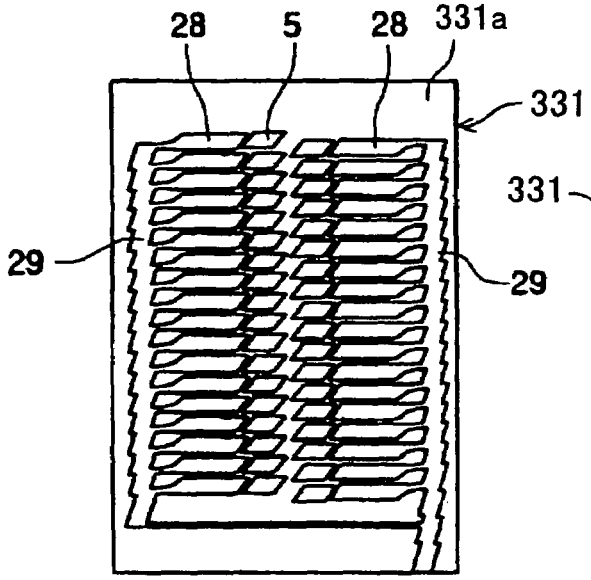
FIG. 33A shows a plan view of the nozzle plate-bonded surface of the spacer 331 according to an alternative embodiment.
Figure 33B:
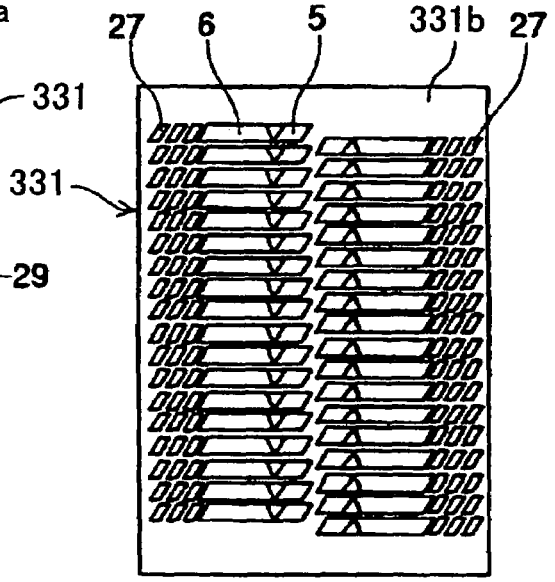
FIG. 33B shows a plan view of the diaphragm-bonded surface of the spacer 331.

Referring to FIG. 33, FIG. 33A shows a plan view of the nozzle plate-bonded surface of the spacer 331 according to an alternative embodiment and FIG. 33B shows a plan view of the diaphragm-bonded surface of the spacer 331.

The spacer 331 according to the alternative embodiment has pseudo-pressure chambers 28 formed for every bit, each of which pseudo-pressure chambers 28 is connected to the outside of the spacer 331 via communicating channel(s) 29 extending to the end portion of the spacer 331. Making the pseudo-pressure chambers 28 for every bit open to the outside of the spacer 331 can prevent faulty bonding due to heating during manufacturing processes.

As opposed to the pseudo-pressure chambers 28 according to this alternative embodiment, the pseudo-pressure chambers 26 aforementioned with reference to FIG. 5 have a large enclosed volume insulated from the outside. In this case, when the heat and the pressure are applied to the spacer 331 during the bonding process, the expansion of the air within the pseudo-pressure chambers 26 may cause faulty bonding. Although conducting the bonding operation at room temperature can prevent the faulty bonding, this increases the overall process time and thus manufacturing cost.

On the other hand, according to the alternative embodiment, by forming the communicating channel(s) 29 to make the pseudo-pressure chambers 28 open to the outside of the spacer 331, it becomes possible to minimize the expansion of the air even if heat is applied to the spacer 331 during the bonding process and thus minimize the overall process time.

Referring to FIGS. 34, 35, one example of the processes employed for producing the spacer 331 of the fifth embodiment is shown.

Figure 34A:
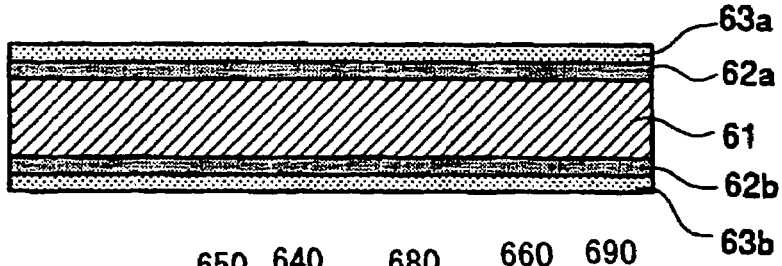
FIGS. 34A through 34E show one example of the processes employed for producing the spacer 331 of the fifth embodiment.

First of all, as shown in FIG. 34A, the single crystal silicon substrate 61 (in this example, silicon wafer base) with crystal orientation (110) of 400 μm thickness was provided. Then, on both sides of the silicon substrate 61 were formed silicon oxide films 62*a*, 62*b* of 1.0 μm thickness and nitride films 63*a*, 63*b* of 0.2 μm thickness. The nitride films 63*a*, 63*b* were formed by LP-CVD (low-pressure chemical vapor deposition).

Figure 34B:
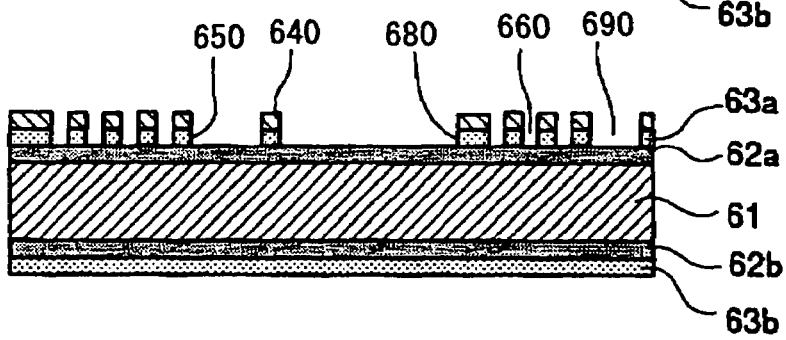

Then, as shown in FIG. 34B, on the nitride film 63*a* (on the nozzle plate-bonded side) of the silicon substrate 61 was formed a resist pattern 640 having the apertures for the nozzle communicating channels 5, the concave portions 25, the pseudo-pressure chambers 28, and the communicating channel(s) 29. This example relates to the spacer shown in FIG. 33 having the additional concave portions 25 for accepting the resident adhesive during the bonding process. Then, the apertures 650, 660 for the nozzle communicating channels 5 and the concave portions 25 as well as the apertures 680, 690 for the pseudo-pressure chambers 28 and the communicating channel(s) 29 were patterned by the dry etching of the nitride film 63*a*.

Figure 34C:
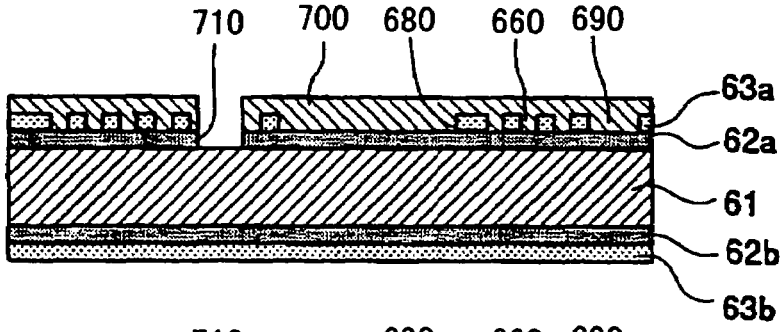

Then, as shown in FIG. 34C, after filling in the apertures 660, 680, and 690 of the nitride film 63*a*, a resist pattern 700 having the apertures whose geometry corresponds to the geometry of the nozzle communicating channels 5 was formed on the nitride film 63*a* (on the nozzle plate-bonded side) of the silicon substrate 61. Then, the apertures 710 for the nozzle communicating channels 5 were patterned by the dry etching of the silicon oxide film 62*a* using the resist pattern 700 as a mask.

Figure 34D:
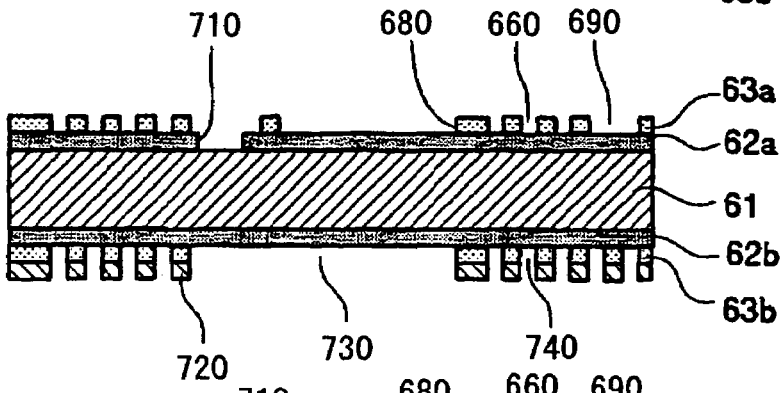

Then, as shown in FIG. 34D, on the nitride film 63*b* (on the diaphragm-bonded side) of the silicon substrate 61 was formed a resist pattern 720 having the apertures for the pressure chambers 6 and the concave portions 27 for the redundant adhesive. Then, the apertures 730, 740 for the pressure chambers 6 and the concave portions 27 were patterned by the dry etching of the nitride film 63*b*.

Figure 34E:
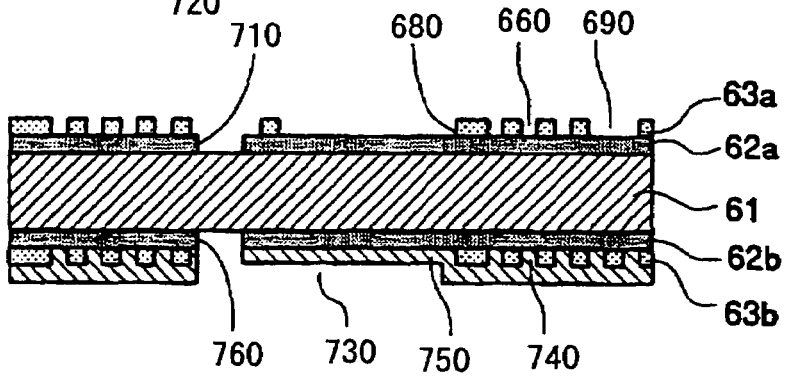

Then, as shown in FIG. 34E, after filling in the apertures 740 of the nitride film 63*a*, a resist pattern 750 having the apertures whose geometry corresponds to the geometry of the pressure chambers 6 was formed on the nitride film 63*b* (on the diaphragm-bonded side) of the silicon substrate 61. Then, the apertures 760 for the pressure chambers 6 were patterned by the dry etching of the silicon oxide film 62 using the resist pattern 750 as a mask.

Figure 35A:
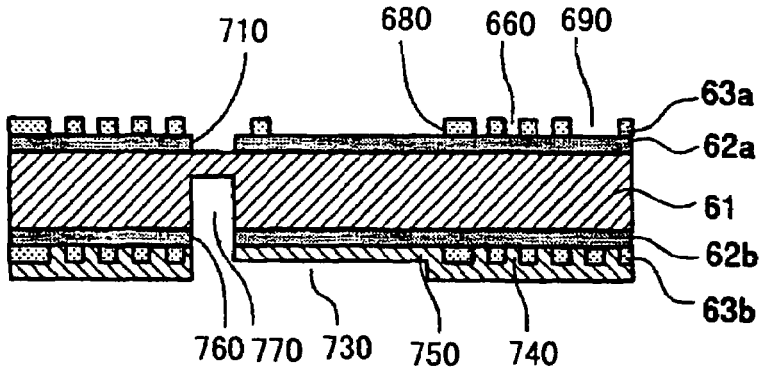
FIGS. 35A through 35E continues the example of the processes employed for producing the spacer 331 of the fifth embodiment.

Then, as shown in FIG. 35A, the holes 770 for the nozzle communicating channels 5 was patterned by the dry etching of the silicon substrate 61 from the diaphragm-bonded side using an ICP (Inductively Coupled Plasma) dry etcher. At that time, the film thickness of the resist 750 was 8 μm. The dry etching using the ICP dry etcher was terminated when the depth of the holes 770 reached 300 μm.

Figure 35B:
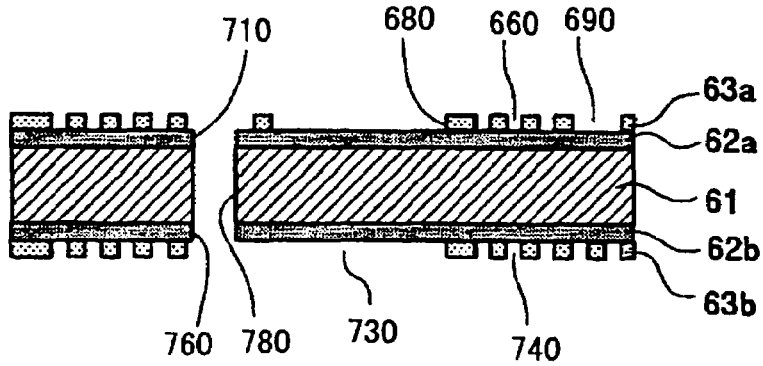

Then, as shown in FIG. 35B, after removing the resist 75, the through holes 780 for the nozzle communicating channel 5 were formed by the anisotropic etching of the silicon substrate 61 using a potassium hydroxide solution. This anisotropic etching process was performed from both sides (i.e., the nozzle plate-bonded side and the diaphragm-bonded side) of the silicon substrate 61. Although the inclined portions were created by the anisotropic etching just after the through holes 780 were created (i.e., just after the silicon substrate 61 was first penetrated through by the anisotropic etching), the inclined portions were removed completely by this etching process.

Figure 35C:
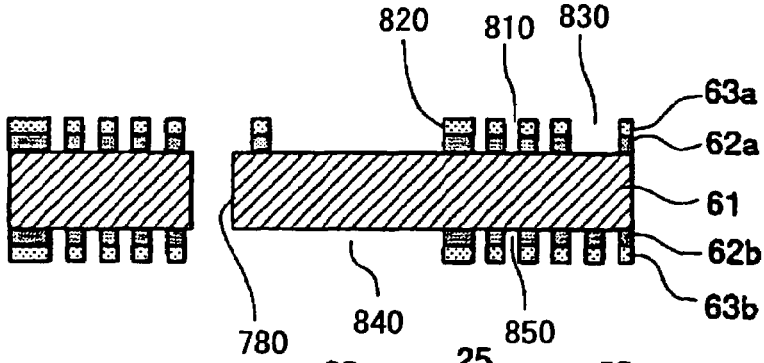

Then, as shown in FIG. 35C, the apertures 840 for the pressure chambers 6, the apertures 850 for the concave portions 27, and the apertures 810, 820, and 830 respectively for the concave portions 25, the pseudo-pressure chambers 28, and the communicating channel(s) 29 were patterned by the wet etching of the silicon oxide film 62*a*, 62*b* using dilute fluoric acid with the nitride film 63 as a mask.

Figure 35D:
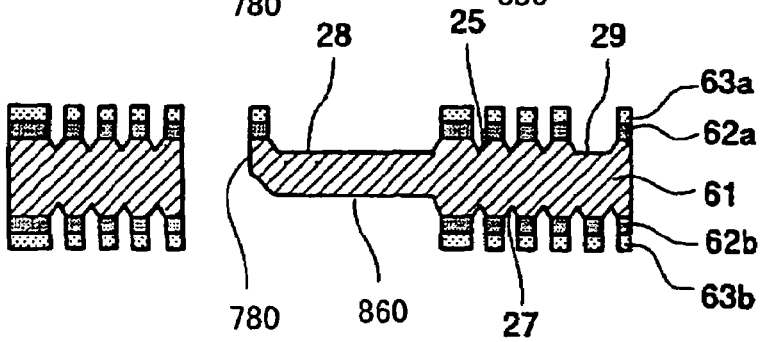

Then, as shown in FIG. 35D, the concave portions 860 corresponding to the pressure chambers 6 and the concave portions 25, 27, and the concave portions corresponding to the pseudo-pressure chambers 28 and the communicating channel(s) 29 were formed by the anisotropic etching of the silicon substrate 61 using a potassium hydroxide solution. In this process, the concentration of the potassium hydroxide solution was 30% and the process temperature was 85° C.

Figure 35E:
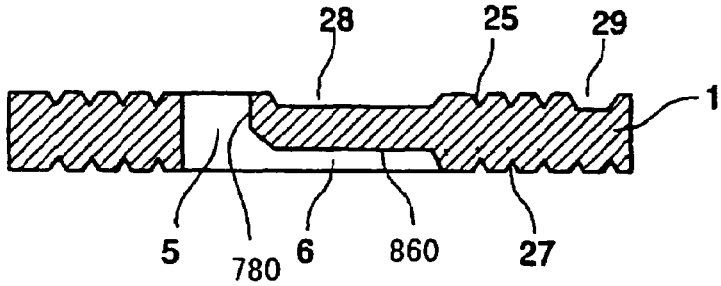

Then, as shown in FIG. 35E, the silicon oxide film 62*a*, 62*b* and the nitride film 63*a*, 63*b* were removed. Then, after the silicon oxide film of 1 μm thickness was formed as a fluid-proof film 10 (not shown), the processes for producing the spacer 331 were completed.

In this way, it became possible to make the distortion level less than 2 μm even in the case of forming the fluid-proof film, because the patterning was performed such that the bonding surface area on the nozzle plate-bonded side became substantially the same as the surface area on the diaphragm-bonded side and the shape of the pseudo-pressure chambers 28 on the nozzle plate-bonded side became similar to the shape of the pressure chambers 6 on the diaphragm-bonded side. Furthermore, it became possible to prevent the faulty bonding due to the expansion of the air within the pseudo-pressure chambers 28 at the heat-bonding operation, because the communicating channel(s) 29 were formed so as to allow the respective pseudo-pressure chambers 28 to communicate with the outside.

Further, it became possible to form the pressure chambers with great accuracy and thus minimize the variation in the ink discharge characteristic, because the spacer was made from the silicon substrate and the ink channels such as the pressure chambers and the nozzle communicating channels were formed by a combination of dry etching (for deeply etched portions) and wet anisotropic etching.

Further, since the wet etching processes were performed using the multi-layered film of the silicon oxide/silicon nitride as a mask, only two wet etching processes were required to form the spacer in this example. This improved the throughput and thus reduced the manufacturing cost in comparison with the case of forming the nozzle communicating channels only by dry etching.

Referring to FIGS. 36, 37, another example of the processes employed for producing the spacer 331 of the fifth embodiment is shown.

Figure 36A:
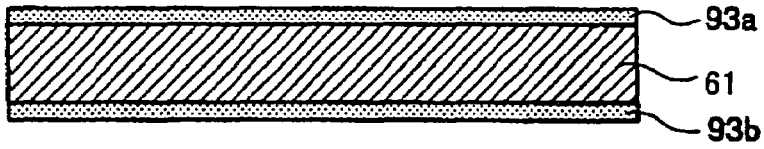
FIGS. 36A through 36E show another example of the processes employed for producing the spacer 331 of the fifth embodiment.

First of all, as shown in FIG. 36A, the single crystal silicon substrate 61 (in this example, silicon wafer base) with crystal orientation (110) of 400 μm thickness was provided. Then, on both sides of the silicon substrate 61 were formed nitride films 93*a*, 93*b* of 150 nm thickness. The nitride film 93*a*, 93*b* were formed by LP-CVD (low-pressure chemical vapor deposition).

Figure 36B:
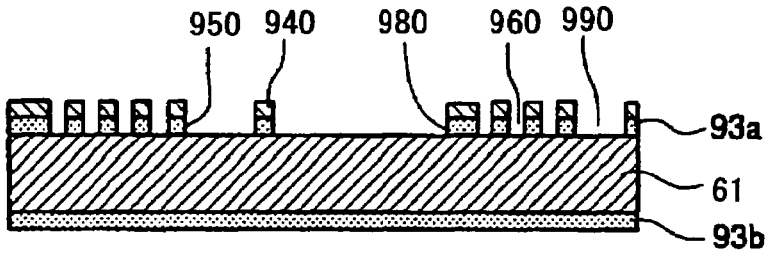

Then, as shown in FIG. 36B, on the nitride film 93*a* (on the nozzle plate-bonded side) of the silicon substrate 61 was formed a resist pattern 940 having the apertures for the nozzle communicating channels 5, the concave portions 25, the pseudo-pressure chambers 28, and the communicating channel(s) 29. This example relates to the spacer shown in FIG. 33 having the additional concave portions 25 for accepting the resident adhesive during the bonding process. Then, the apertures 950, 960 for the nozzle communicating channels 5 and the concave portions 25 as well as the apertures 980, 990 for the pseudo-pressure chambers 28 and the communicating channel(s) 29 were patterned by the dry etching of the nitride film 93*a*.

Figure 36C:
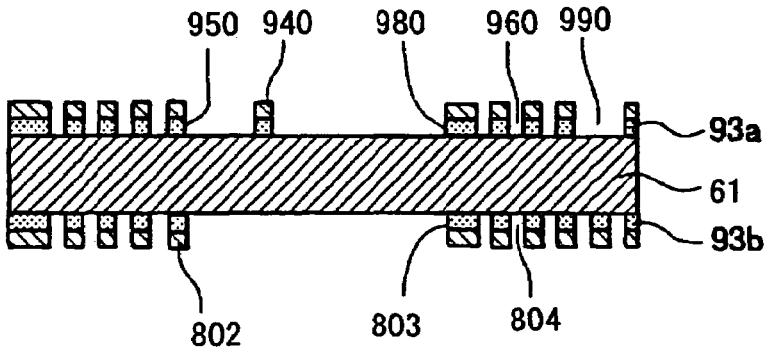

Then, as shown in FIG. 36C, on the nitride film 93*b* (on the diaphragm-bonded side) of the silicon substrate 61 was formed a resist pattern 802 having the apertures for the pressure chambers 6 and the concave portions 27 for the redundant adhesive. Then, the apertures 803 for the pressure chambers 6 and the apertures 804 for the concave portions 27 were patterned by the dry etching of the nitride film 93*b*.

Figure 36D:
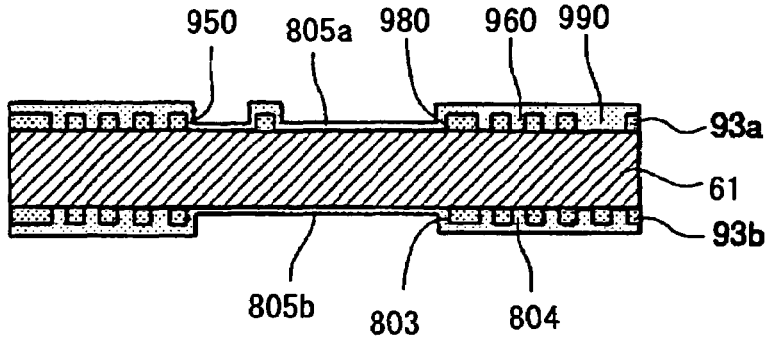
Figure 36E:
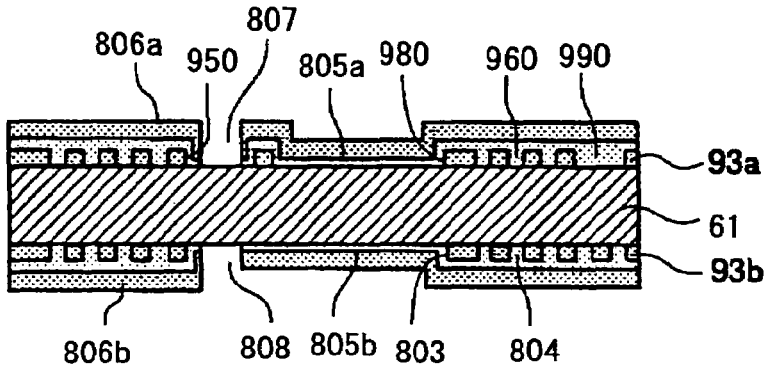

Then, as shown in FIG. 36D, on both sides of the silicon substrate 61 were formed high-temperature oxide films 805*a*, 805*b* of 250 nm thickness. Then, as shown in FIG. 36E, on the high-temperature oxide films 805*a*, 805*b* were formed nitride films 806*a*, 806*b* of 150 nm thickness by LP-CVD. Then, the opposed apertures 807, 808 for the nozzle communicating channels 5 were formed by the dry etching of the high-temperature oxide films 805*a*, 805*b* and the nitride films 806*a*, 806*b*.

Figure 37A:
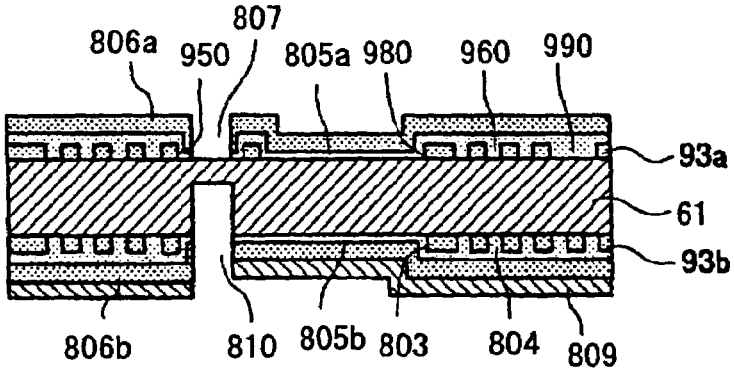
FIGS. 37A through 37E continues the example of the processes employed for producing the spacer 331 of the fifth embodiment.

Then, as shown in FIG. 37A, after forming the resist 809 on the nitride films 806*b*, the holes 810 for the nozzle communicating channels 5 were patterned by the dry etching of the silicon substrate 61 from the diaphragm-bonded side using an ICP (Inductively Coupled Plasma) dry etcher. At that time, the film thickness of the resist 809 was 8 μm.

Figure 37B:
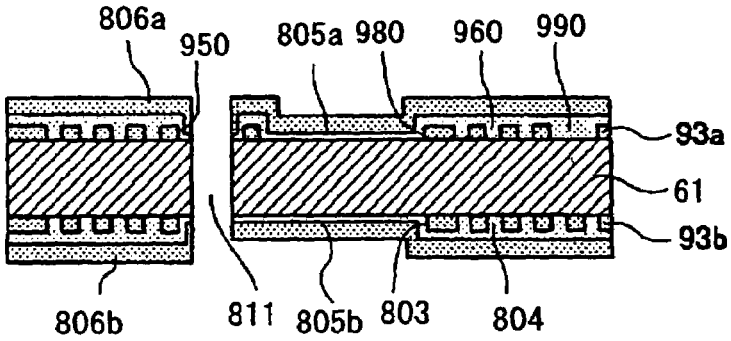

Then, as shown in FIG. 37B, after removing the resist 809, the through holes 811 for the nozzle communicating channel 5 were formed by the anisotropic etching of the silicon substrate 61 using a potassium hydroxide solution.

Figure 37C:
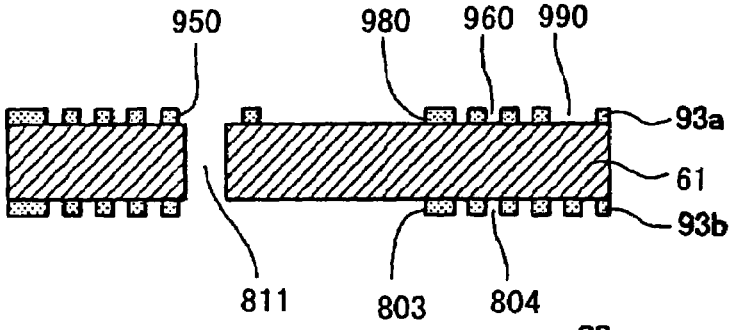

Then, as shown in FIG. 37C, the nitride films 806*a*, 806*b* were removed by heated phosphate using the high-temperature oxide films 805*a*, 805*b* as a blocking film and the high-temperature oxide films 805*a*, 805*b* were removed by dilute fluoric acid.

Figure 37D:
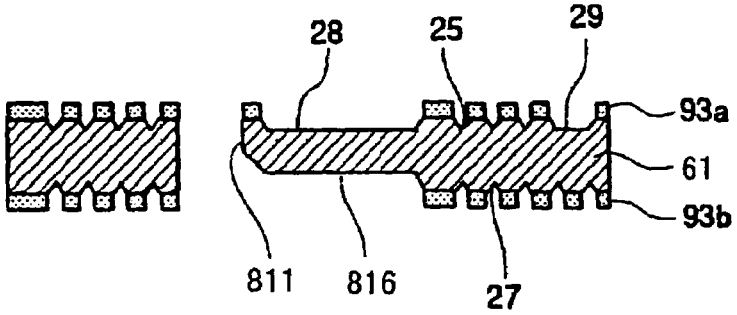

Then, as shown in FIG. 37D, the concave portions 816 corresponding to the pressure chambers 6 and the concave portions 25, 27, and the concave portions corresponding to the pseudo-pressure chambers 28 and the communicating channel(s) 29 were formed by the anisotropic etching of the silicon substrate 61 using a potassium hydroxide solution. In this process, the concentration of the potassium hydroxide solution was 30% and the process temperature was 85° C.

Figure 37E:
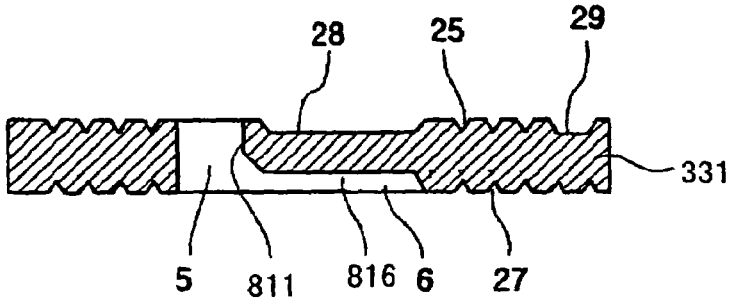

Then, as shown in FIG. 37E, the nitride film 93*a*, 93*b* were removed. Then, after the silicon oxide film of 1 μm thickness was formed as a fluid-proof film 10 (not shown), the processes for producing the spacer 331 were completed.

In this example, as is the case with the aforementioned example, it became possible to make the distortion level less than 2 μm even in the case of forming the fluid-proof film, because the patterning was performed such that the bonding surface area on the nozzle plate-bonded side became substantially same as the surface area on the diaphragm-bonded side and the shape of the pseudo-pressure chambers 28 on the nozzle plate-bonded side became similar to the shape of the pressure chambers 6 on the diaphragm-bonded side. Furthermore, it became possible to prevent the faulty bonding due to the expansion of the air within the pseudo-pressure chambers at the heat-bonding operation, because the communicating channel(s) 29 were formed so as to allow the respective pseudo-pressure chambers 28 to communicate with the outside.

Further, it became possible to form the pressure chambers with great accuracy and thus minimize the variation in the ink discharge characteristic, because the spacer was made from the silicon substrate and the ink channels such as the pressure chambers and the nozzle communicating channels were formed by a combination of dry etching (for deeply etched portions) and wet anisotropic etching.

Further, since the wet etching processes were performed using the multi-layered film of the nitride/silicon oxide/nitride as a mask, only two wet etching processes were required to form the spacer in this example. This improved the throughput and thus reduced the manufacturing cost in comparison with the case of forming the nozzle communicating channels only by dry etching. Furthermore, it became possible to control the dimensions with higher-accuracy, because only the nitride film was required as a mask to form the pressure chambers.

Referring to FIGS. 38, 39, another example of the processes employed for producing the spacer 331 of the fifth embodiment is shown.

Figure 38A:
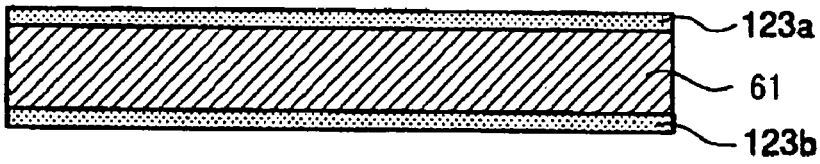
FIGS. 38A through 38D show yet another example of the processes employed for producing the spacer 331 of the fifth embodiment.

First of all, as shown in FIG. 38A, the single crystal silicon substrate 61 (in this example, silicon wafer base) with crystal orientation (110) of 400 μm thickness was provided. Then, on both sides of the silicon substrate 61 were formed nitride films 123*a*, 123*b* of 150 nm thickness. The nitride film 123*a*, 123*b* were formed by LP-CVD (low-pressure chemical vapor deposition).

Figure 38B:
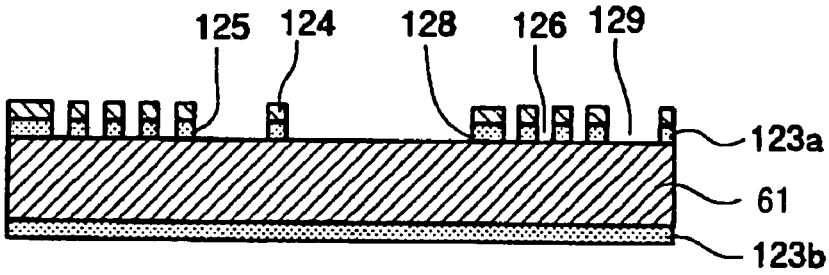

Then, as shown in FIG. 38B, on the nitride film 123*a* (on the nozzle plate-bonded side) of the silicon substrate 61 was formed a resist pattern 124 having the apertures for the nozzle communicating channels 5, the concave portions 25, the pseudo-pressure chambers 28, and the communicating channel(s) 29. This example relates to the spacer shown in FIG. 33 having the additional concave portions 25 for accepting the resident adhesive during the bonding process. Then, the apertures 125 for the nozzle communicating channels 5 and the apertures 126 for the concave portions 25 as well as the apertures 128, 129 for the pseudo-pressure chambers 28 and the communicating channel(s) 29 were patterned by the dry etching of the nitride film 123*a*.

Figure 38C:
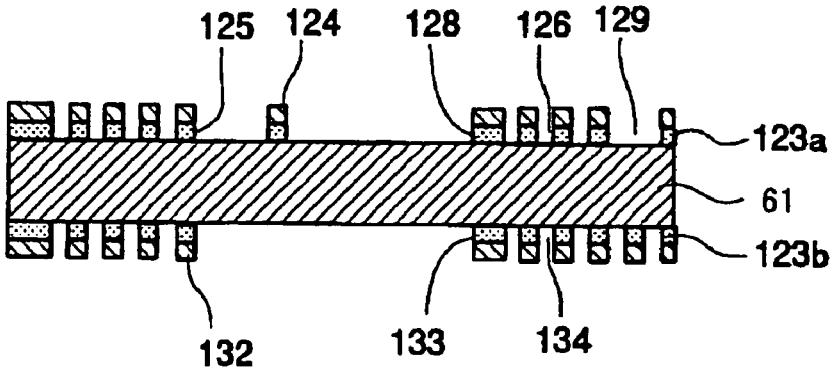

Then, as shown in FIG. 38C, on the nitride film 123*b* (on the diaphragm-bonded side) of the silicon substrate 61 was formed a resist pattern 132 having the apertures for the pressure chambers 6 and the concave portions 27 for the redundant adhesive. Then, the apertures 133 for the pressure chambers 6 and the apertures 134 for the concave portions 27 were patterned by dry etching of the nitride film 123*b*.

Figure 38D:
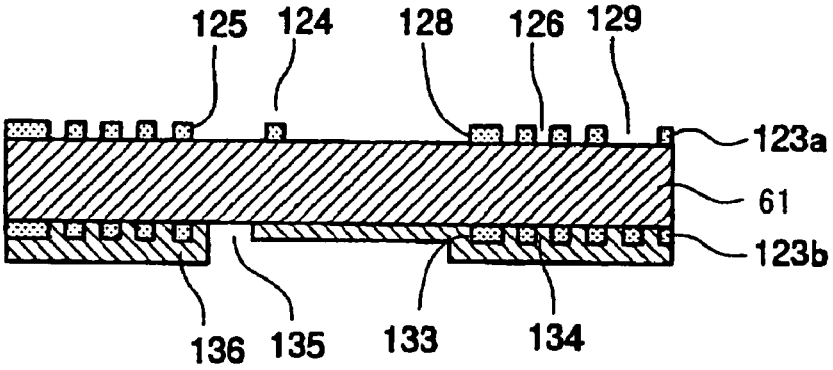

Then, as shown in FIG. 38D, on the nozzle plate-bonded side was formed a resist pattern 136 having the apertures 135 for the nozzle communicating channels 5. At that time, the film thickness of the resist pattern 136 was 8 μm.

Figure 39A:
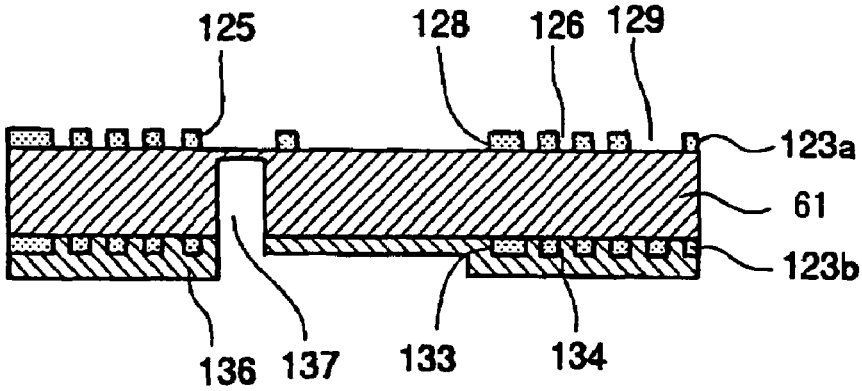
FIGS. 39A through 39C continues the example of the processes employed for producing the spacer 331 of the fifth embodiment.

Then, as shown in FIG. 39A, the holes 137 for the nozzle communicating channels 5 were patterned by the dry etching of the silicon substrate 61 from the diaphragm-bonded side using an ICP (Inductively Coupled Plasma) dry etcher.

Figure 39B:
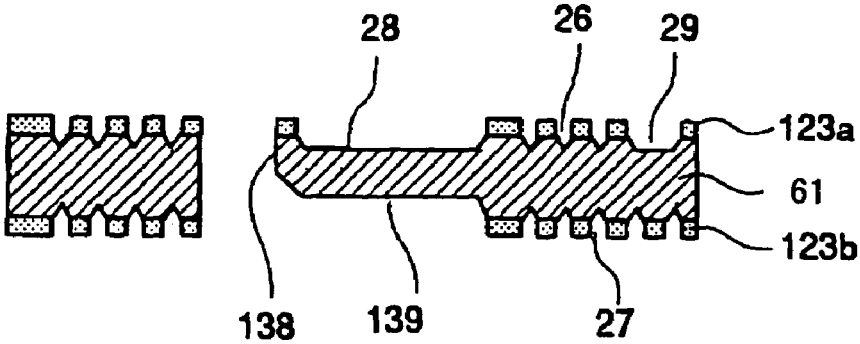

Then, as shown in FIG. 39B, after removing the resist pattern 136, the through holes 138 for the nozzle communicating channel 5 as well as the concave portions 139 corresponding to the pressure chambers 6, the concave portions 25, 27, and the concave portions corresponding to the pseudo-pressure chambers 28 and the communicating channel(s) 29 were formed by the anisotropic etching of the silicon substrate 61 using a potassium hydroxide solution. In this process, the concentration of the potassium hydroxide solution was 30% and the process temperature was 85° C.

Figure 39C:
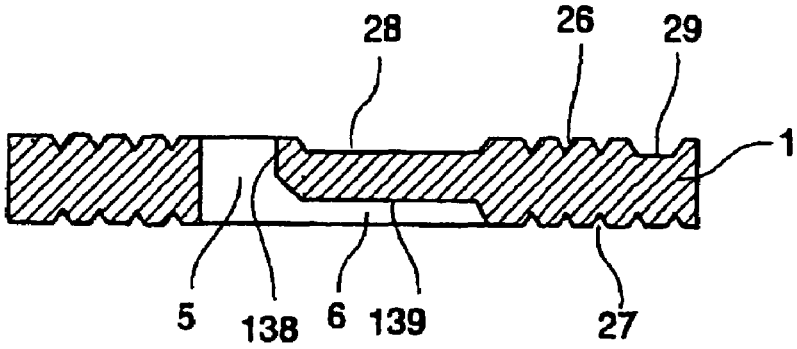

Then, as shown in FIG. 39C, the nitride films 123*a*, 123*b* were removed. Then, after the silicon oxide film of 1 μm thickness was formed as a fluid-proof film 10 (not shown), the processes for producing the spacer 331 were completed.

In this example, as is the case with the aforementioned examples, it became possible to make the distortion level less than 2 μm even in the case of forming the fluid-proof film, because the patterning was performed such that the bonding surface area on the nozzle plate-bonded side became substantially same as the surface area on the diaphragm-bonded side and the shape of the pseudo-pressure chambers 28 on the nozzle plate-bonded side became similar to the shape of the pressure chambers 6 on the diaphragm-bonded side. Furthermore, it became possible to prevent the faulty bonding due to expansion of air within the pseudo-pressure chambers at the heat-bonding operation, because the communicating channel (s) 29 were formed so as to allow the respective pseudo-pressure chambers 28 to communicate with the outside.

Further, it became possible to form the pressure chambers with great accuracy and thus minimize the variation in the ink discharge characteristic, because the spacer was made from the silicon substrate and the ink channels such as the pressure chambers and the nozzle communicating channels were formed by a combination of dry etching (for deeply etched portions) and wet anisotropic etching.

Further, since the wet etching processes were performed using only the nitride film as a mask, it became possible to control the dimensions with higher accuracy and thus minimize the variation in the ink discharge characteristic and reduce the manufacturing processes.

Figure 40:
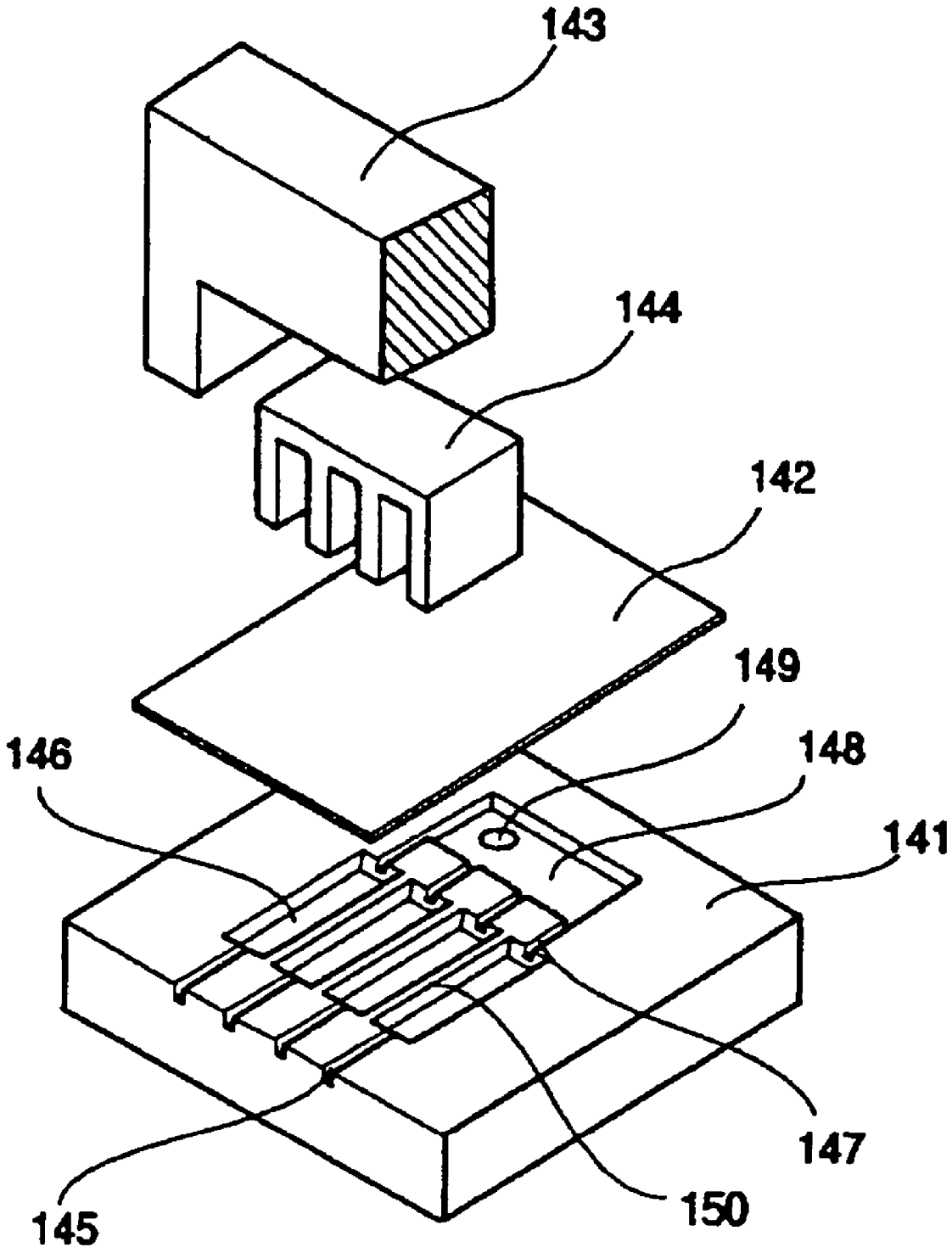
FIG. 40 shows an exploded perspective view of the ink jet printhead according to an alternative embodiment.
Figure 41:
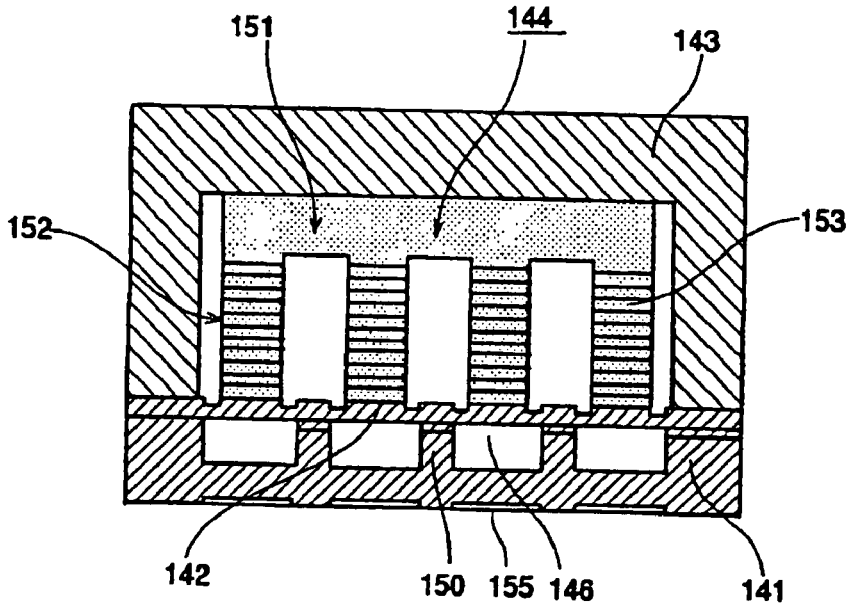
FIG. 41 shows a sectional view of the ink jet printhead of FIG. 40.

Referring to FIGS. 40, and 41, FIG. 40 shows an exploded perspective view of the ink jet printhead according to an alternative embodiment and FIG. 41 shows a sectional view of the ink jet printhead of FIG. 40.

The ink jet printhead according to the alternative embodiment includes channel-forming element 141 (spacer). The diaphragm 142 is mounted on the channel-forming element 141. The piezoelectric member 144 held by a holder 143 is bonded to the channel-forming element 141.

The channel-forming element 141 is made from the silicon substrate and has the channel portions for nozzles 145, the concave portions for pressure chambers 146 connected to the nozzles 145, the channel portions for resistance channels 147 (which act as a fluid resistance), and the concave portion for a reservoir 148 formed by anisotropic etching. The channel-forming element 141 also has an ink supply channel 149 connected to the reservoir 148.

The ink channel just described is established when the diaphragm 142 is bonded to the channel-forming element 141. In this sense, the diaphragm 142 also acts as a cover element. The fluid-proof film (not shown) is formed on the ink-contact wall surfaces of the channel-forming element 141 such as the wall surfaces of the nozzles 145, resistance channels 147, and the reservoir 148.

The piezoelectric member 144 has a non-driven portion 151 formed by multi-layering only green sheets of the piezoelectric material. The piezoelectric member 144 has a driven portion 152 formed by multi-layering green sheets and internal electrodes alternately on the non-driven portion 151. A plurality of the piezoelectric elements 156 are made by forming the grooves extending to the non-driven portion 151 but not penetrating the non-driven portion 151. The diaphragm 142 is bonded to the end face of the piezoelectric elements 156.

With this ink jet printhead, selectively applying a pulse voltage of 20-50V to the piezoelectric elements 156 causes the piezoelectric elements 156 to be deformed in the layered direction, thereby causing the diaphragm 142 to be moved toward the pressure chambers 146. Then, the ink in the pressure chambers 146 is pressurized according to the volume change of the pressure chambers 146 to be expelled (injected) as ink drops out of the nozzles 145 in the direction perpendicular to the piezoelectric element's deformation direction.

As is the case with the aforementioned embodiments, the channel-forming element 141 has the concave portions 155 in its bottom surface for the pseudo-pressure chambers, the opening shape of which concave portions 155 is similar to the opening shape of the ink channel such as the pressure chambers 146 formed in the surface opposed to the bottom surface (i.e., top surface). Thus, the channel-forming element 141 has same surface areas (except the concave portions) on both sides.

Therefore, according to this alternative embodiment, it is possible to reduce the distortion level of the channel-forming element 141 made from the silicon substrate and thus improve the reliability of the bonding operation even in the case of the fluid-proof film formed by a highly anionic ink-proof film such as silicon oxide film and nitride film.

Figure 42:
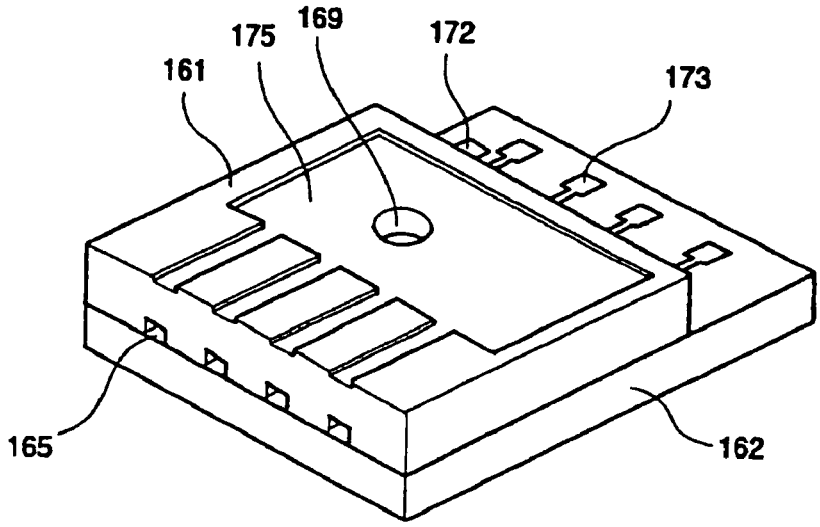
FIG. 42 shows a perspective view of the ink jet printhead according to another alternative embodiment.
Figure 43:
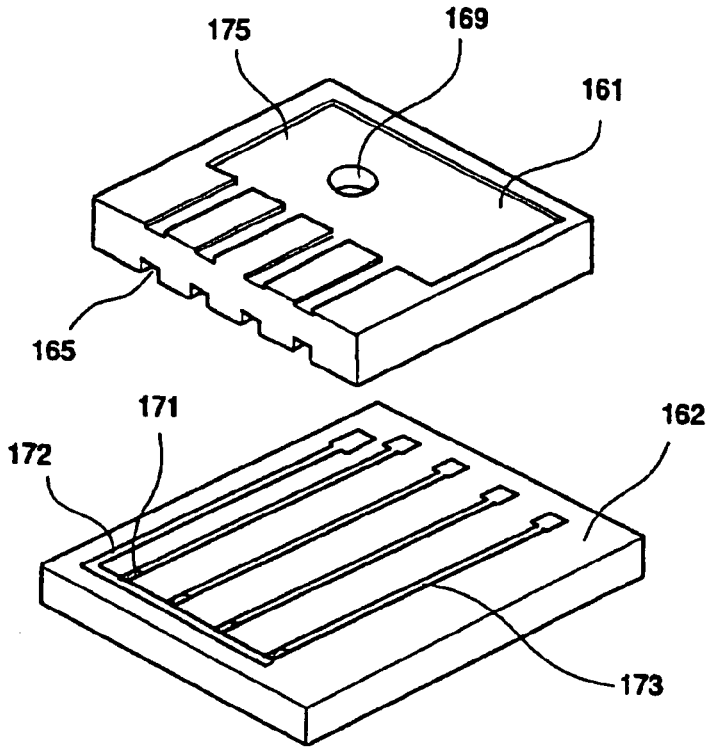
FIG. 43 shows an exploded perspective view of the ink jet printhead of FIG. 42.
Figure 44:
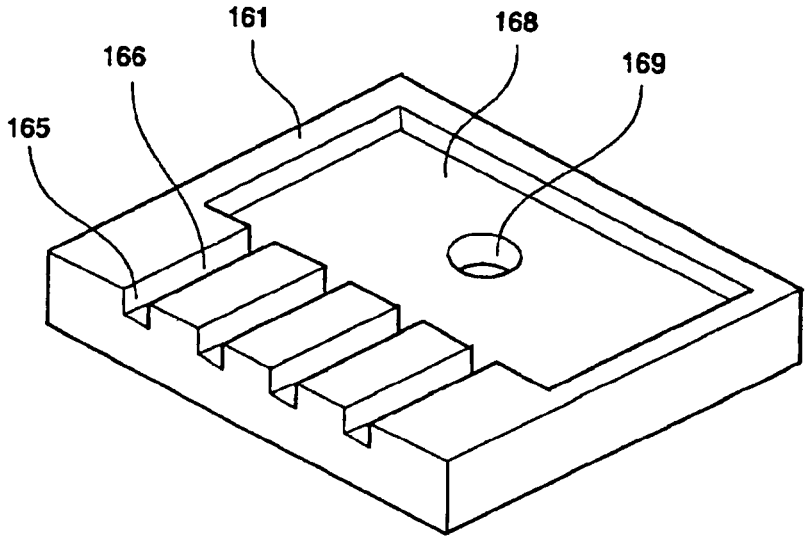
FIG. 44 shows a perspective view of a channel-forming element viewed from the ink channel-forming side.

Referring to FIGS. 42-44, FIG. 42 shows a perspective view of the ink jet printhead according to another alternative embodiment and FIG. 43 shows an exploded perspective view of the ink jet printhead. FIG. 44 shows a perspective view of a channel-forming element viewed from ink channel-forming side.

The ink jet printhead according to the alternative embodiment includes a first base 161 corresponding to a channel-forming element (spacer). A second base 162, which is a heating element, is mounted on the first base 161. The first base 161 and the second base 162 cooperatively define a plurality of nozzles 165 for injecting the ink drops, pressure chambers 166 connected to the nozzles 165, reservoir 168 for supplying the ink to the pressure chambers 166 and the like. The ink supplied through an ink supply bore 169 formed in the first base 161 is conducted via the reservoir 168 and the pressure chambers 166 to be injected out of the nozzles 165 as ink drops.

The first base 161 is made from the silicon substrate and has the channel portions for nozzles 165 and pressure chambers 166 and the concave portion for a reservoir 168 formed by etching. The ink channel just described is established when the second base 162 is bonded to the first base 161. In this sense, the second base 162 also acts as a cover element to define the ink channel. The fluid-proof film (not shown) is formed on the ink-contact surface of the first base 161 on the second base-bonded side.

The second base 162 is provided with a heating resistance element (electrothermal conversion element) 171. The second base 162 is provided with a common electrode 172 and individual electrodes 173 for applying a voltage to the heating resistance element 171.

With this ink jet printhead, selectively applying a drive voltage to the individual electrodes 173 causes the heating resistance element 171 to produce heat, thereby causing a change in the pressure of the ink within the pressure chambers 166. This change in the ink pressure causes the ink drops to be expelled (injected) out of the nozzles 165.

As is the case with the aforementioned embodiments, the first base 161 has the concave portions 175 in its top surface for the pseudo-pressure chambers, the opening shape of which concave portions 175 is similar to the opening shape of the ink channel such as the pressure chambers 166 formed in the surface opposed to the top surface (i.e., bottom surface). Thus, the first base 161 has the same surface areas (except for the concave portions) on both its sides.

Therefore, according to this alternative embodiment, it is possible to reduce the distortion level of the first base 161 made from the silicon substrate and thus improve the reliability of the bonding operation even in the case of forming the fluid-proof film with high resistance to anionic ink such as a silicon oxide film and nitride film.

Next, the description will be directed to the sixth embodiment of the spacer according to the present invention.

By the way, forming the pseudo-pressure chambers in the spacer (channel-forming element) can prevent the distortion of the spacer due to the fluid-proof film, while this decreases the thickness D of the partition walls 6*a* (spacing) between the pressure chambers 6 and the pseudo-pressure chambers 26 and thus reduces the stiffness of the partition walls 6*a*. The reduction of the stiffness of the partition walls 6*a* may cause degradation in discharge performance.

Figure 45:
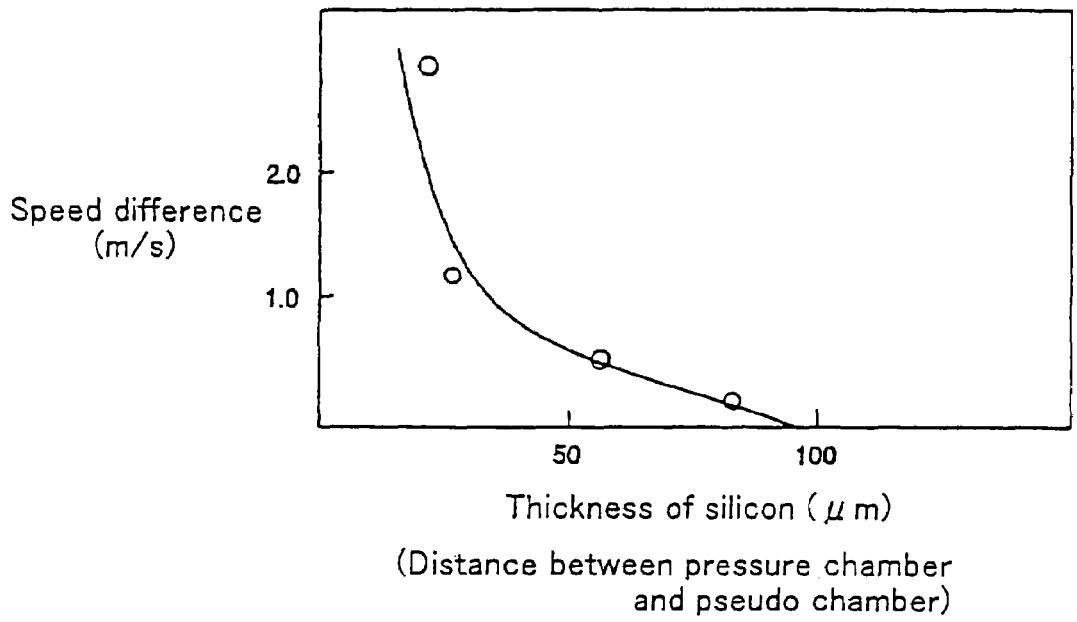
FIG. 45 shows the evaluation results as to ink drop speed in the cases of driving a single bit and simultaneously driving multiple bits.

In this regard, evaluations were made as to ink drop speed in the case of driving a single bit and ink drop speed in the case of simultaneously driving multiple bits while varying the distance D (thickness D of the partition walls 6*a*) between the pressure chambers 6 and the pseudo-pressure chambers 26 as a parameter. FIG. 45 shows the evaluation results. Hereafter, driving a single bit is referred to as "single-injection" and simultaneously driving multiple bits is referred to as "multi-injection".

As is evident from FIG. 45, if the distance D between the pressure chambers 6 and the pseudo-pressure chambers 26 exceeds 100 μm, the difference in the ink drop speed between a single-injection and a multi-injection disappears. A difference in the ink drop speed between a single-injection and a multi-injection causes a change in the drop placement and affects the print image quality.

Figure 46:
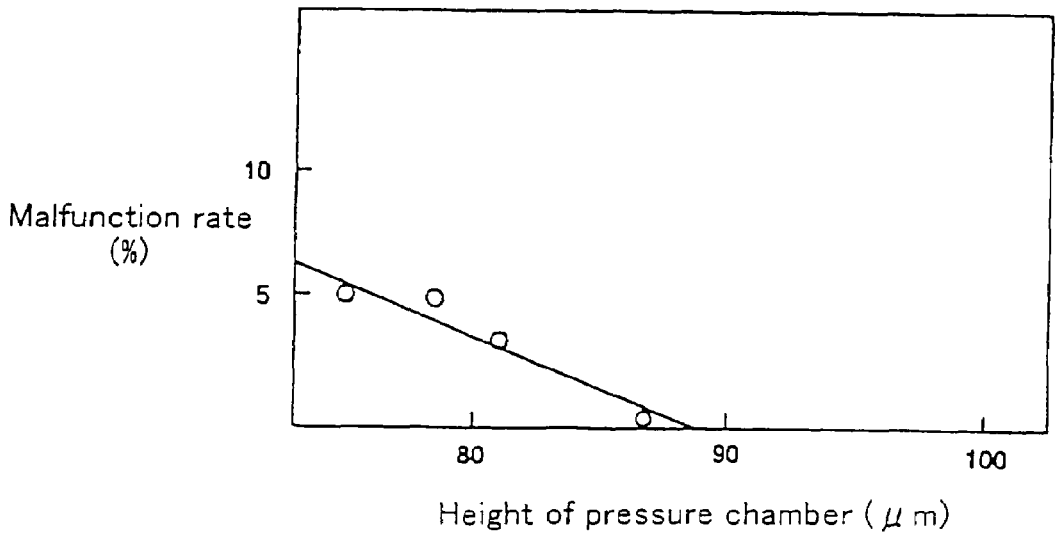
FIG. 46 shows the evaluation results as to the relationship between height H1 of the pressure chamber 6 and discharge malfunction rate.

Further, evaluations were made as to the relationship between height (depth) H1 of the pressure chambers 6 and discharge malfunction rate in the case of discharging a fluid of high viscosity (4 cp) at a high frequency. FIG. 46 shows the evaluation results.

As is evident from FIG. 46, if the height (depth) H1 of the pressure chambers 6 is greater than or equal to 85 μm, a stable discharge performance is guaranteed even in the case of using a high-viscosity fluid. In the case of using a high-viscosity fluid, an insufficient height (depth) H1 of the pressure chambers 6 causes an insufficient supply of the fluid to the pressure chambers 6 at a high driving frequency and thus causes a discharge malfunction.

Further, evaluations were made as to the discharge malfunction at a high driving frequency and the difference in the ink drop speed between a single-injection and a multi-injection while varying distance D between the pressure chambers 6 and the pseudo-pressure chambers 26 as a parameter. Table 1 shows the evaluation results in the case of the spacer (made from the silicon substrate) of 350 μm thickness. Table 2 shows the evaluation results in the case of the spacer of 400 μm thickness. Table 3 shows the evaluation results in the case of the spacer of 450 μm thickness. In the following tables, the terms "remaining thickness" means the distance D (thickness D of the partition walls 6*a*) between the pressure chambers 6 and the pseudo-pressure chambers 26.

TABLE 1

| Wafer's thickness | Pressure chamber's depth | Remaining thickness | High frequency discharge | Difference between single injection and multi-injection |
|---|---|---|---|---|
| 350 | 70 | 210 | X | ○ |
| 350 | 75 | 200 | X | ○ |
| 350 | 80 | 190 | X | ○ |
| 350 | 85 | 180 | ○ | ○ |
| 350 | 90 | 170 | ○ | ○ |
| 350 | 95 | 160 | ○ | ○ |
| 350 | 100 | 150 | ○ | ○ |
| 350 | 105 | 140 | ○ | ○ |
| 350 | 110 | 130 | ○ | ○ |
| 350 | 115 | 120 | ○ | ○ |
| 350 | 120 | 110 | ○ | ○ |
| 350 | 125 | 100 | ○ | ○ |
| 350 | 130 | 90 | ○ | X |
| 350 | 135 | 80 | ○ | X |
| 350 | 140 | 70 | ○ | X |

TABLE 2

| Wafer's thickness | Pressure chamber's depth | Remaining thickness | High frequency discharge | Difference between single injection and multi-injection |
|---|---|---|---|---|
| 400 | 70 | 260 | X | ○ |
| 400 | 75 | 250 | X | ○ |
| 400 | 80 | 240 | X | ○ |
| 400 | 85 | 230 | ○ | ○ |
| 400 | 90 | 220 | ○ | ○ |
| 400 | 95 | 210 | ○ | ○ |
| 400 | 100 | 200 | ○ | ○ |
| 400 | 105 | 190 | ○ | ○ |
| 400 | 110 | 180 | ○ | ○ |
| 400 | 115 | 170 | ○ | ○ |
| 400 | 120 | 160 | ○ | ○ |
| 400 | 125 | 150 | ○ | ○ |
| 400 | 130 | 140 | ○ | ○ |
| 400 | 135 | 130 | ○ | ○ |
| 400 | 140 | 120 | ○ | ○ |
| 400 | 145 | 110 | ○ | ○ |
| 400 | 150 | 100 | ○ | ○ |
| 400 | 155 | 90 | ○ | X |
| 400 | 160 | 80 | ○ | X |
| 400 | 165 | 70 | ○ | X |

TABLE 3

| Wafer's thickness | Pressure chamber's depth | Remaining thickness | High frequency discharge | Difference between single injection and multi-injection |
|---|---|---|---|---|
| 450 | 70 | 310 | X | ○ |
| 450 | 75 | 300 | X | ○ |
| 450 | 80 | 290 | X | ○ |
| 450 | 85 | 280 | ○ | ○ |
| 450 | 90 | 270 | ○ | ○ |
| 450 | 95 | 260 | ○ | ○ |
| 450 | 100 | 250 | ○ | ○ |
| 450 | 105 | 240 | ○ | ○ |
| 450 | 110 | 230 | ○ | ○ |
| 450 | 115 | 220 | ○ | ○ |
| 450 | 120 | 210 | ○ | ○ |
| 450 | 125 | 200 | ○ | ○ |
| 450 | 130 | 190 | ○ | ○ |
| 450 | 135 | 180 | ○ | ○ |
| 450 | 140 | 170 | ○ | ○ |
| 450 | 145 | 160 | ○ | ○ |
| 450 | 150 | 150 | ○ | ○ |
| 450 | 155 | 140 | ○ | ○ |
| 450 | 160 | 130 | ○ | ○ |
| 450 | 165 | 120 | ○ | ○ |
| 450 | 170 | 110 | ○ | ○ |
| 450 | 175 | 100 | ○ | ○ |
| 450 | 180 | 90 | ○ | X |
| 450 | 185 | 80 | ○ | X |
| 450 | 190 | 70 | ○ | X |

It became evident from these evaluation results that regardless of the thickness of a wafer, the discharge malfunction at a high driving frequency due to an insufficient ink supply cannot occur even in the case of using a high-viscosity fluid, if the height (depth) H1 of the pressure chambers 6 is greater than or equal to 85 μm. Further, it became evident from these evaluation results that a difference in the ink drop speed between a single-injection and a multi-injection cannot occur, if the distance D between the pressure chambers 6 and the pseudo-pressure chambers 26 is greater than or equal to 100 μm.

On the basis of these evaluation results, the pressure chambers 6 of the ink jet printhead according to the sixth embodiment are formed such that the height (depth) H1 of the pressure chambers 6 is greater than or equal to 85 μm. This allows a reduction in distortion level of the silicon-based component (spacer) due to the stress in a protective film and can eliminate the potential for faulty bonding between the spacer and the diaphragm or the nozzle plate, even if the protective film to prevent the silicon elution into anionic ink is formed on the silicon-based component. Further, it becomes possible to sufficiently supply a fluid to the nozzles even in the case of discharging at high frequency a high-viscosity fluid necessary for printing high quality images on ordinary paper and thus improve the print image quality.

Further, the spacer of the ink jet printhead according to the sixth embodiment is formed such that the distance D between the pressure chambers 6 and the pseudo-pressure chambers 26 is greater than or equal to 100 μm. This allows the minimization of the speed difference due to the difference in the number of the bits to be driven, especially the difference in the ink drop speed between a single-injection and a multi-injection. Consequently, it becomes possible to minimize the difference in drop placement due to difference in the number of bits to be driven and thus improve the print image quality.

Referring to FIGS. 47, 48, one example of the processes employed for producing the spacer of the sixth embodiment is shown.

Figure 47A:
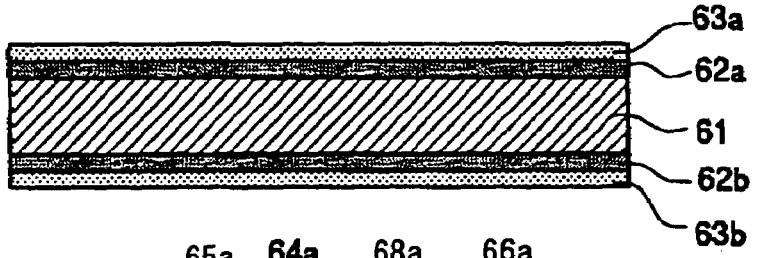
FIGS. 47A through 47E show one example of the processes employed for producing the spacer of the sixth embodiment.

First of all, as shown in FIG. 47A, the single crystal silicon substrate 61 (in this example, silicon wafer) with crystal orientation (110) of 400 μm thickness was provided. Then, on both sides of the silicon substrate 61 were formed silicon oxide films 62*a*, 62*b* of 1.0 μm thickness and silicon nitride films 63*a*, 63*b* of 0.15 μm thickness. The nitride film 63*a*, 63*b* were formed by LP-CVD (low-pressure chemical vapor deposition).

Figure 47B:
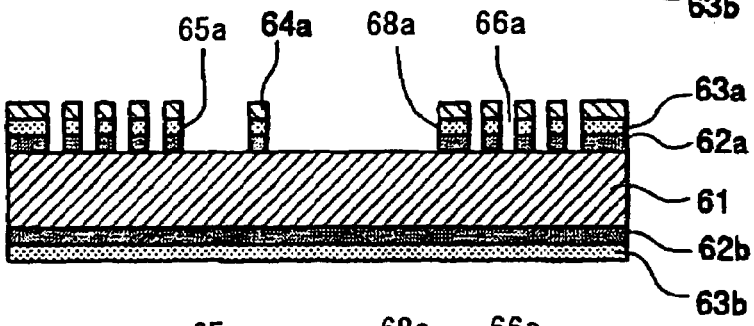

Then, as shown in FIG. 47B, on the nitride film 63*a* (on the nozzle plate-bonded side) of the silicon substrate 61 was formed a resist pattern 64*a* having the apertures for the nozzle communicating channels 5, the concave portions 25 (for accepting the resident adhesive), and the pseudo-pressure chambers 26.

Then, the apertures 65*a* for the nozzle communicating channels 5 and the apertures 66*a* for the concave portions 25 as well as the apertures 68*a* for the pseudo-pressure chambers 26 were patterned by the dry etching of the silicon oxide film 62*a* and the nitride film 63*a*. At that time, the apertures 68*a* for the pseudo-pressure chambers 26 were formed such as to have a plane shape (opening shape) identical to the pressure chambers 6.

Figure 47C:
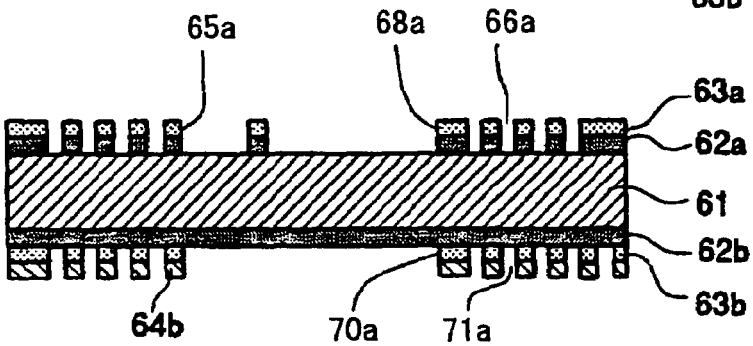

Then, as shown in FIG. 47C, on the nitride film 63*a* (on the nozzle plate-bonded side) of the silicon substrate 61 was formed a resist pattern 64*b* having the apertures for the pressure chambers 6 and the apertures for the concave portions 27 (for accepting the resident adhesive). Then, the apertures 70*a* for the pressure chambers 6 and the apertures 71*a* for the concave portions 27 were patterned by the dry etching of the silicon nitride film 63*a*.

Figure 47D:
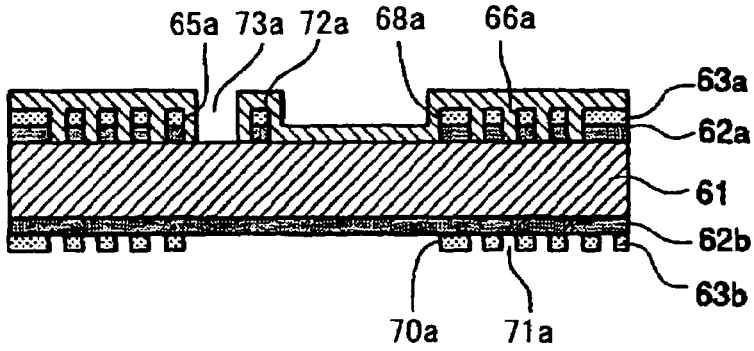

Then, as shown in FIG. 47D, after filling in the apertures 65*a*, 66*a*, and 68*a* with a resist, a resist pattern 72*a* having the apertures 73*a* for the nozzle communicating channel 5 was formed on the nozzle plate-bonded side of the silicon substrate 61. At that time, the film thickness of the resist 72*a* was 8 μm.

Figure 47E:
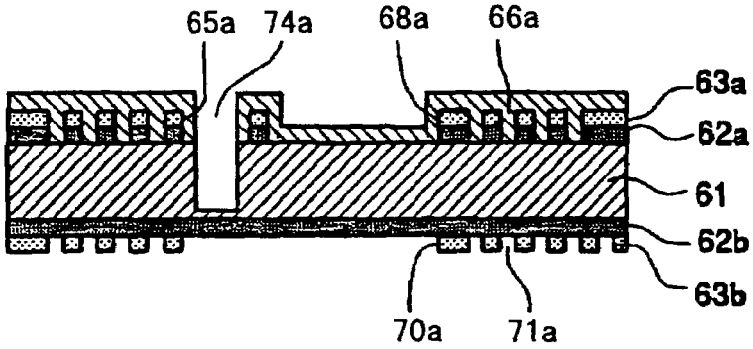

Then, as shown in FIG. 47E, the holes 74*a* for the nozzle communicating channels 5 were patterned by the dry etching of the silicon substrate 61 from the nozzle plate-bonded side by an ICP (Inductively Coupled Plasma) dry etcher using the resist pattern 72*a* as a mask.

Figure 48A:
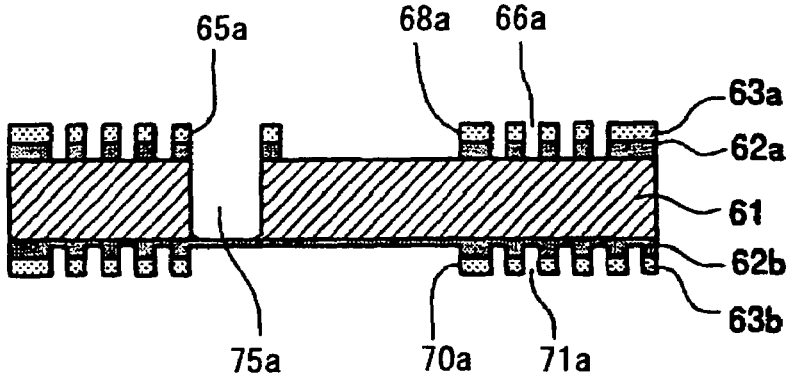
FIGS. 48A through 48D continues the example of the processes employed for producing the spacer of the sixth embodiment.

Then, as shown in FIG. 48A, after removing the resist 72*a*, the through holes 75*a* for the nozzle communicating channel 5 were formed by the anisotropic etching of the silicon substrate 61 using a potassium hydroxide solution.

Figure 48B:
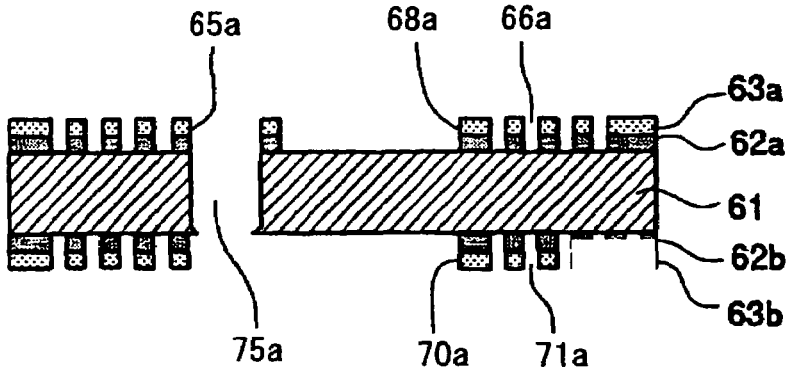

Then, as shown in FIG. 48B, the portion of the silicon oxide film 62*b* corresponding to the apertures 70*a* for the pressure chambers 6 and the apertures 71*a* for the concave portions 27 was removed by the wet etching.

Figure 48C:
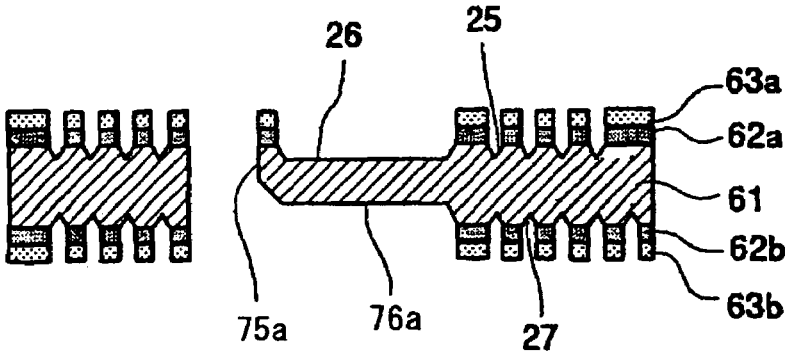

Then, as shown in FIG. 48C, the concave portions 76*a* for the pressure chambers 6, the concave portions 25,27, and the concave portions for the pseudo-pressure chambers 26 were patterned by the anisotropic etching of the silicon substrate 61 using a potassium hydroxide solution. In this process, the concentration of the potassium hydroxide solution was 30% and the process temperature was 85° C. Although the inclined portions were created by the anisotropic etching just after the through holes 75*a* were created (i.e., just after the silicon substrate 61 was etched through by the anisotropic etching), the inclined portions were removed completely by this etching process.

Figure 48D:
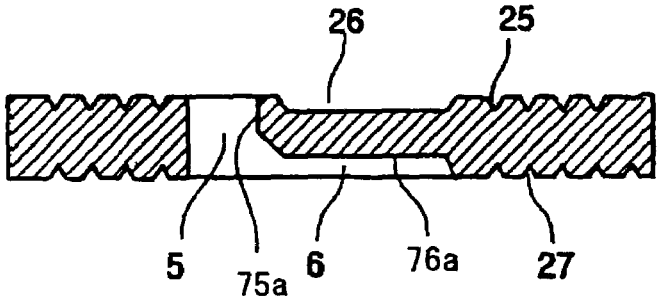

Then, as shown in FIG. 48D, the silicon oxide film 62*a*, 62*b* and the nitride film 63*a*, 63*b* were removed. Then, after the silicon oxide film of 1 μm thickness was formed as a fluid-proof film 10 (not shown), the processes for producing the spacer were completed.

In this way, it became possible to make the distortion level less than 1 μm even in the case of forming the fluid-proof film, because the patterning was performed such that the bonding surface area on the nozzle plate-bonded side became substantially same as the surface area on the diaphragm-bonded side and the shape of the pseudo-pressure chambers on the nozzle plate-bonded side became similar to the shape of the pressure chambers 6 on the diaphragm-bonded side, and the communicating channel(s) were formed so as to allow the respective pseudo-pressure chambers to communicate with the outside.

Further, it became possible to form the pressure chambers with great accuracy and thus minimize the variation in the ink discharge characteristic, because the spacer was made from the silicon substrate and the ink channels such as the pressure chambers and the nozzle communicating channels were such formed by a combination of dry etching (for deeply etched portions) and wet anisotropic etching.

Further, since the wet etching processes were performed using the multi-layered film of the silicon oxide/silicon nitride as a mask, only two wet etching processes were required to form the spacer in this example. This improved the throughput and thus reduced the manufacturing cost in comparison with the case of forming the nozzle communicating channels only by dry etching.

In this example, the etching depth H2 (see FIG. 29) for the pseudo-pressure chamber was greater than the etching depth H1 for the pressure chamber, since the pseudo-pressure chamber was subjected to wet etching twice.

Further, the spacer of the ink jet printhead was formed such that the thickness of the silicon substrate between the pressure chambers 6 and the pseudo-pressure chambers 26 was greater than or equal to 100 μm and the height of the pressure chambers 6 (the depth of the concave portions 76*a*) was greater than or equal to 85 μm. Accordingly, by making the thickness of the silicon substrate between the pressure chambers 6 and the pseudo-pressure chambers 26 greater than or equal to 100 μm, it became possible to equalize the ink drop speed between a single-injection and a multi-injection and thus control the ink drop placement with great accuracy. Further, by making the height of the pressure chambers 6 greater than or equal to 85 μm, it became possible to sufficiently supply the ink even at a high discharging frequency in the case of using a high-viscosity fluid to print high quality images on ordinary paper.

Referring to FIGS. 49, 50, another example of the processes employed for producing the spacer of the sixth embodiment is shown.

Figure 49A:
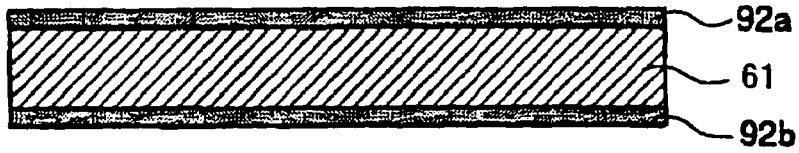
FIGS. 49A through 49D show another example of the processes employed for producing the spacer of the sixth embodiment.

First of all, as shown in FIG. 49A, the single crystal silicon substrate 61 (in this example, silicon wafer) with crystal orientation (110) of 400 μm thickness was provided. Then, on both sides of the silicon substrate 61 were formed silicon oxide films 92*a*, 92*b* of 1.0 μm thickness.

Figure 49B:
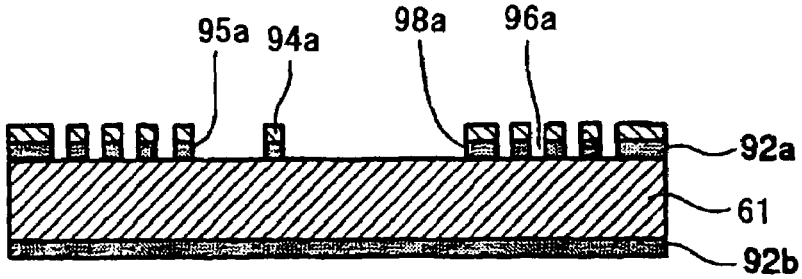

Then, as shown in FIG. 49B, on the silicon oxide film 92*a* (on the nozzle plate-bonded side) of the silicon substrate 61 was formed a resist pattern 94*a* having the apertures for the nozzle communicating channels 5, the concave portions 25 (for accepting the resident adhesive), and the pseudo-pressure chambers 26.

Then, the apertures 95*a* for the nozzle communicating channels 5 and the apertures 96*a* for the concave portions 25 as well as the apertures 98*a* for the pseudo-pressure chambers 26 were patterned by the dry etching of the silicon oxide film 92*a*. At that time, the apertures 98*a* for the pseudo-pressure chambers 26 were formed such as to have a plane shape (opening shape) identical to the pressure chambers 6.

Figure 49C:
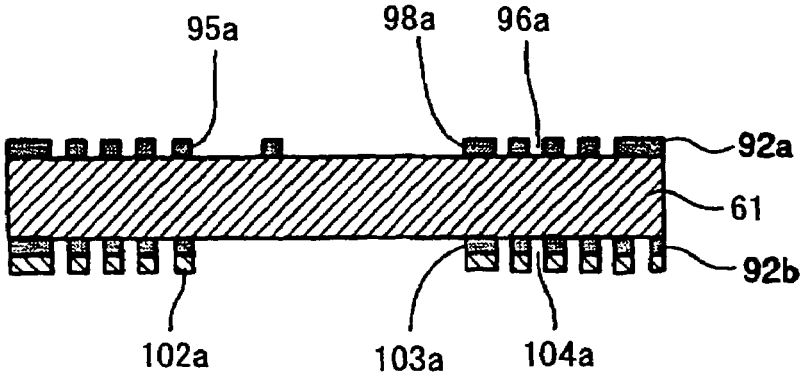

Then, as shown in FIG. 49C, on the silicon oxide film 92*b* (on the diaphragm-bonded side) of the silicon substrate 61 was formed a resist pattern 102*a* having the apertures for the pressure chambers 6 and the concave portions 27 for the redundant adhesive. Then, the apertures 103*a* for the pressure chambers 6 and the apertures 104*a* for the concave portions 27 were patterned by dry etching of the silicon oxide film 92*b*.

Figure 49D:
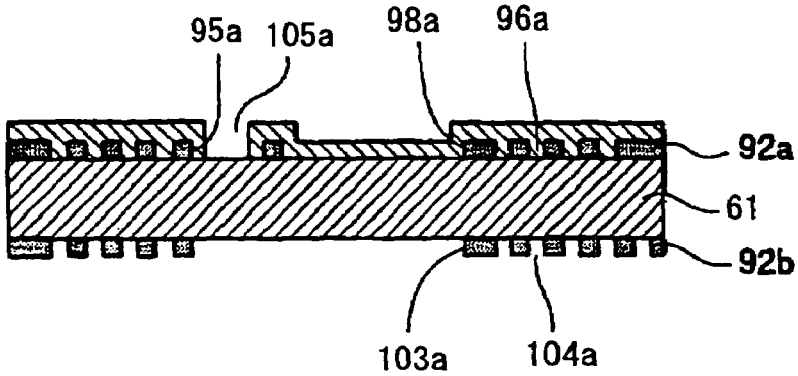

Then, as shown in FIG. 49D, after filling in the apertures 95*a*, 96*a*, and 98*a* of the silicon oxide film 92*a* with a resist, a resist pattern 106*a* having the apertures 105*a* for the nozzle communicating channels 5 was formed on the nozzle plate-bonded side. At that time, the film thickness of the resist pattern 106*a* was 8 μm.

Figure 50A:
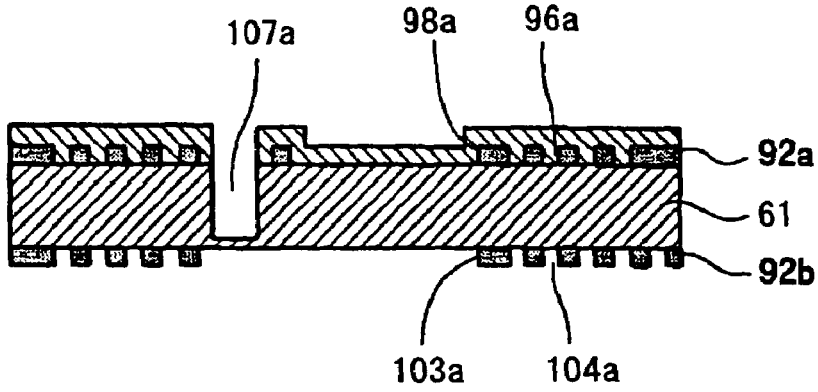
FIGS. 50A through 50C continues the example of the processes employed for producing the spacer of the sixth embodiment.

Then, as shown in FIG. 50A, the holes 107*a* for the nozzle communicating channels 5 were patterned by the dry etching of the silicon substrate 61 from the nozzle plate-bonded side using an ICP (Inductively Coupled Plasma) dry etcher. At that time, the dry etching was carried out using the resist pattern 106*a* as a mask.

Figure 50B:
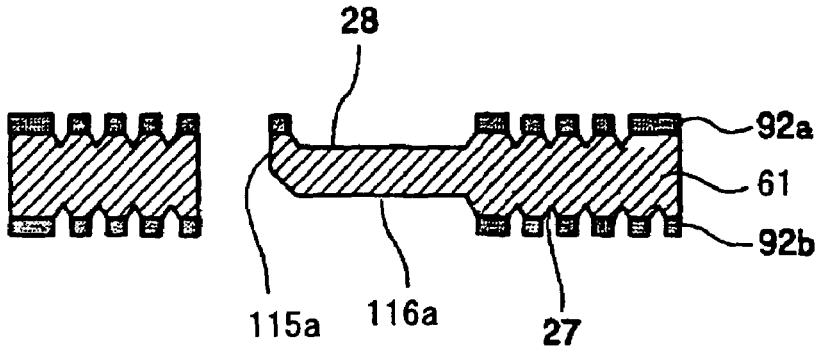

Then, as shown in FIG. 50B, after removing the resist pattern 106*a*, the through holes 115*a* for the nozzle communicating channel 5 as well as the concave portions 116*a* for the pressure chambers 6, the concave portions 25, 27, and the concave portions corresponding to the pseudo-pressure chambers 26 were formed by the anisotropic etching of the silicon substrate 61 using a potassium hydroxide solution. In this process, the concentration of the potassium hydroxide solution was 30% and the process temperature was 85° C.

Figure 50C:
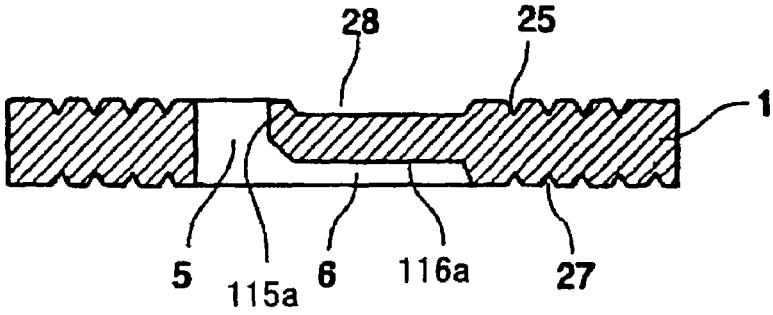

Then, as shown in FIG. 50C, silicon oxide films 92*a*, 92*b* were removed. Then, after the silicon oxide film of 1 μm thickness was formed as a fluid-proof film 10 (not shown), the processes for producing the spacer were completed.

In this example, as is the case with aforementioned examples, it became possible to make the distortion level less than 1 μm even in the case of forming the fluid-proof film, because the patterning was performed such that the bonding surface area on the nozzle plate-bonded side became substantially same as the surface area on the diaphragm-bonded side and the shape of the pseudo-pressure chambers 26 on the nozzle plate-bonded side became similar to the shape of the pressure chambers 6 on the diaphragm-bonded side. Furthermore, it became possible to prevent the faulty bonding due to the expansion of the air within the pseudo-pressure chambers at the heat-bonding operation, because the communicating channel(s) were formed so as to allow the respective pseudo-pressure chambers to communicate with the outside.

Further, it became possible to form the pressure chambers with great accuracy and thus minimize the variation in the ink discharge characteristic, because the spacer was made from the silicon substrate and the ink channels such as the pressure chambers and the nozzle communicating channels were formed by a combination of dry etching (for deeply etched portions) and wet anisotropic etching.

Further, since the wet etching process was performed using the silicon oxide film as a mask, only one wet etching process was required to form the spacer in this example. This improved the throughput and reduced the manufacturing cost in comparison with the case of forming the nozzle communicating channels only by dry etching. Furthermore, since only the silicon oxide film was utilized as a mask when forming pressure chambers 6, it became possible to simplify the process for producing a mask and thus reduce the manufacturing cost.

In this example, the etching depth H2 (see FIG. 29) for the pseudo-pressure chamber was substantially equal to the etching depth H1 for the pressure chamber, since both the pseudo-pressure chamber and the pressure chamber were subjected to wet etching twice.

Further, the spacer of the ink jet printhead was formed such that the thickness of the silicon substrate between the pressure chambers 6 and the pseudo-pressure chambers 26 was greater than or equal to 100 μm and the height of the pressure chambers 6 (the depth of the concave portions 116*a*) was greater than or equal to 85 μm. Accordingly, by making the thickness of the silicon substrate between the pressure chambers 6 and the pseudo-pressure chambers 26 greater than or equal to 100 μm, it became possible to equalize the ink drop speed between a single-injection and a multi-injection and thus control the ink drop placement with great accuracy. Further, by making the height of the pressure chambers 6 greater than or equal to 85 μm, it became possible to sufficiently supply the ink even at a high discharging frequency in the case of using a high-viscosity fluid to print high quality image on an ordinary paper.

Referring to FIGS. 51, 52, another example of the processes employed for producing the spacer of the sixth embodiment is shown.

Figure 51A:
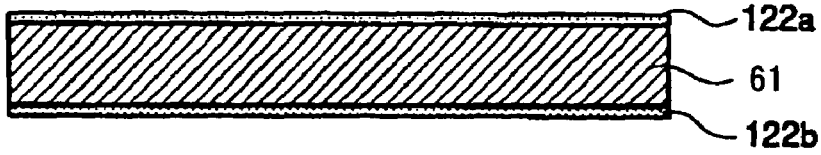
FIGS. 51A through 51D show yet another example of the processes employed for producing the spacer of the sixth embodiment.

First of all, as shown in FIG. 51A, the single crystal silicon substrate 61 (in this example, silicon wafer) with crystal orientation (110) of 400 μm thickness was provided. Then, on both sides of the silicon substrate 61 were formed silicon nitride films 122*a*, 122*b* of 0.15 μm thickness by LP-CVD.

Figure 51B:
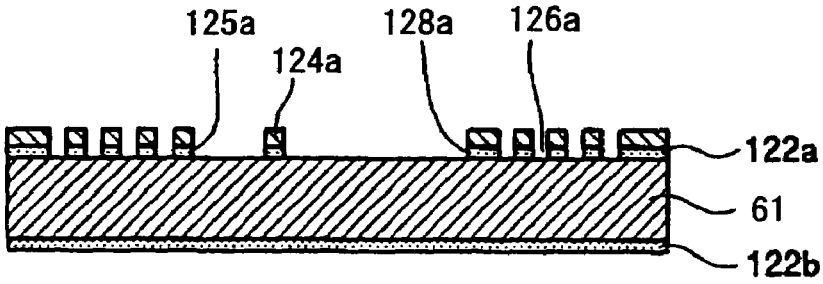

Then, as shown in FIG. 51B, on the silicon nitride film 122*a* (on the nozzle plate-bonded side) of the silicon substrate 61 was formed a resist pattern 124*a* having the apertures for the nozzle communicating channels 5, the concave portions 25 (for accepting the resident adhesive), and the pseudo-pressure chambers 26.

Then, the apertures 125*a* for the nozzle communicating channels 5 and the apertures 126*a* for the concave portions 25 as well as the apertures 128*a* for the pseudo-pressure chambers 26 were patterned by the dry etching of the silicon nitride film 122*a*. At that time, the apertures 128*a* for the pseudo-pressure chambers 26 were formed so as to have a plane shape (opening shape) identical to the pressure chambers 6.

Figure 51C:
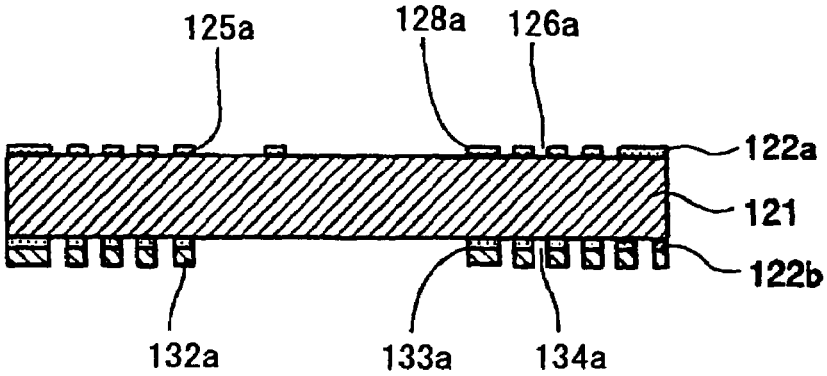

Then, as shown in FIG. 51C, on the silicon nitride film 122*b* (on the diaphragm-bonded side) of the silicon substrate 61 was formed a resist pattern 132*a* having the apertures for the pressure chambers 6 and the concave portions 27 for the redundant adhesive. Then, the apertures 133*a* for the pressure chambers 6 and the apertures 134*a* for the concave portions 27 were patterned by dry etching of the silicon nitride film 122*b*.

Figure 51D:
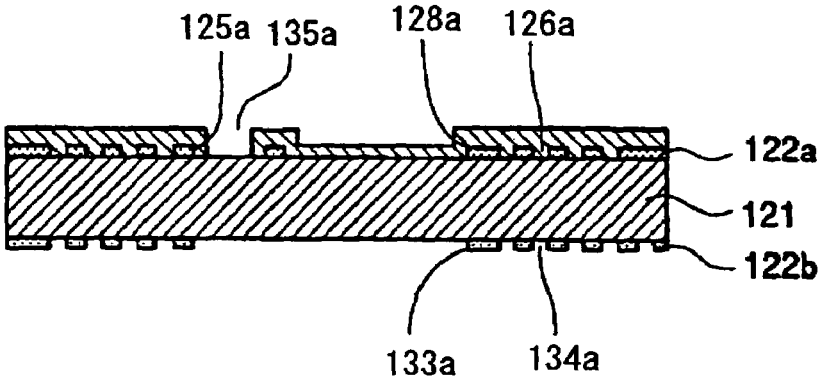

Then, as shown in FIG. 51D, after filling in the apertures 95*a*, 96*a*, and 98*a* of the silicon nitride film 122*a* with a resist, a resist pattern 136*a* having the apertures 135*a* for the nozzle communicating channels 5 was formed on the nozzle plate-bonded side. At that time, the film thickness of the resist pattern 136*a* was 8 μm.

Figure 52A:
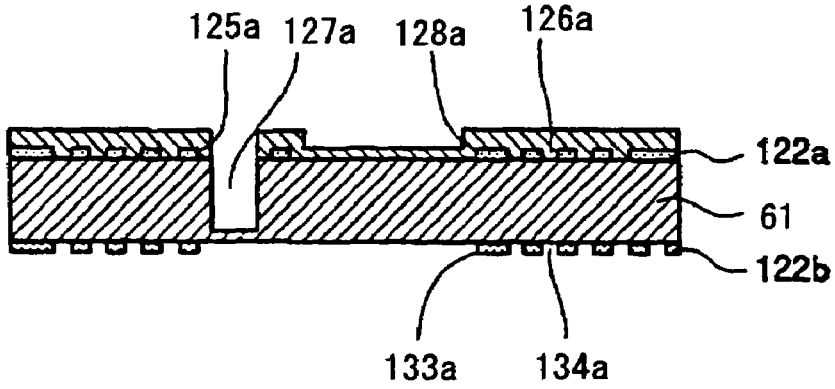
FIGS. 52A through 52C continues the example of the processes employed for producing the spacer of the sixth embodiment.

Then, as shown in FIG. 52A, the holes 127*a* for the nozzle communicating channels 5 were patterned by the dry etching of the silicon substrate 61 from the nozzle plate-bonded side using an ICP (Inductively Coupled Plasma) dry etcher. At that time, the dry etching was carried out using the resist pattern 136*a* as a mask.

Figure 52B:
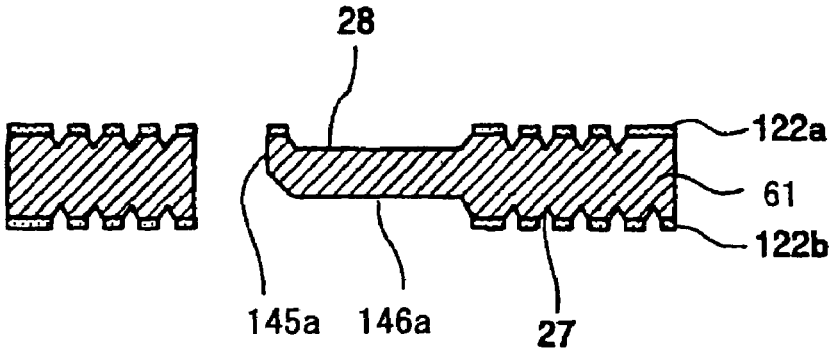

Then, as shown in FIG. 52B, after removing the resist pattern 136*a*, the through holes 145*a* for the nozzle communicating channel 5 as well as the concave portions 146*a* for the pressure chambers 6, the concave portions 25, 27, and the concave portions for the pseudo-pressure chambers 26 were formed by the anisotropic etching of the silicon substrate 61 using a potassium hydroxide solution. In this process, the concentration of the potassium hydroxide solution was 30% and the process temperature was 85° C.

Figure 52C:
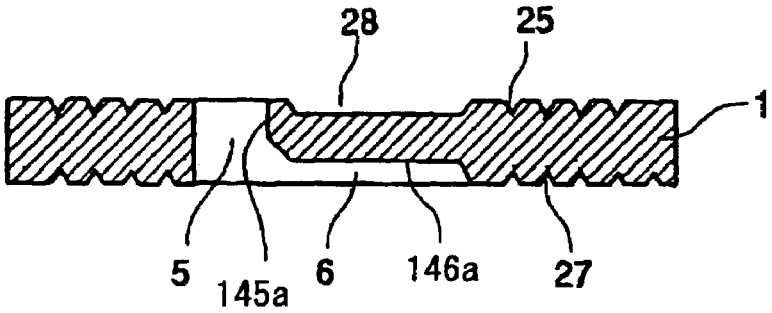

Then, as shown in FIG. 52C, silicon nitride films 122*a*, 122*b* were removed. Then, after the silicon oxide film of 1 μm thickness was formed as a fluid-proof film 10 (not shown), the processes for producing the spacer were completed.

In this example, as is the case with aforementioned examples, it became possible to make the distortion level less than 1 μm even in the case of forming the fluid-proof film, because the patterning was performed such that the bonding surface area on the nozzle plate-bonded side became substantially the same as the surface area on the diaphragm-bonded side and the shape of the pseudo-pressure chambers 26 on the nozzle plate-bonded side became similar to the shape of the pressure chambers 6 on the diaphragm-bonded side. Furthermore, it became possible to prevent the faulty bonding due to the expansion of the air within the pseudo-pressure chambers at the heat-bonding operation, because the communicating channel(s) were formed so as to allow the respective pseudo-pressure chambers to communicate with the outside.

Further, it became possible to form the pressure chambers with great accuracy and thus minimize the variation in the ink discharge characteristic, because the spacer was made from the silicon substrate and the ink channels such as the pressure chambers and the nozzle communicating channels were formed by a combination of dry etching (for deeply etched portions) and wet anisotropic etching.

Further, since the wet etching process was performed using the silicon nitride film as a mask, only one wet etching process was required to form the spacer in this example. This improved the throughput and reduced the manufacturing cost in comparison with the case of forming the nozzle communicating channels only by dry etching. Furthermore, since only the silicon nitride film was utilized as a mask when forming pressure chambers 6, it became possible to reduce the film thickness of the mask and thus control the dimensions with higher accuracy.

In this example, the etching depth H2 (see FIG. 29) for the pseudo-pressure chamber was substantially equal to the etching depth H1 for the pressure chamber, since both the pseudo-pressure chamber and the pressure chamber were subjected to wet etching twice.

Further, the spacer of the ink jet printhead was formed such that the thickness of the silicon substrate between the pressure chambers 6 and the pseudo-pressure chambers 26 was greater than or equal to 100 μm and the height of the pressure chambers 6 (the depth of the concave portions 146*a*) was greater than or equal to 85 μm. Accordingly, by making the thickness of the silicon substrate between the pressure chambers 6 and the pseudo-pressure chambers 26 greater than or equal to 100 μm, it became possible to equalize the ink drop speed between a single-injection and a multi-injection and thus control the ink drop placement with great accuracy. Further, by making the height of the pressure chambers 6 greater than or equal to 85 μm, it became possible to sufficiently supply the ink even at a high discharging frequency in the case of using a high-viscosity fluid to print high quality images on ordinary paper.

Figure 53:
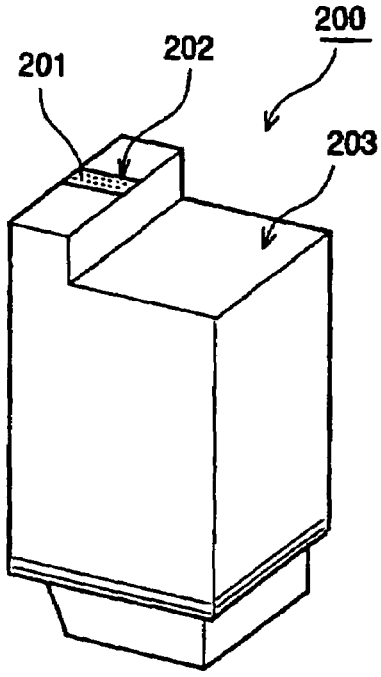
FIG. 53 shows a perspective view of an ink tank integral-type ink cartridge.

Next, the description will be directed to an ink cartridge according to the present invention with reference to FIG. 53. FIG. 53 shows a perspective view of an ink tank integral-type ink cartridge. The ink cartridge 200 according to the present invention includes an ink tank 203 integral with the ink jet printhead 202 as a drop discharge head according to the present invention. The ink jet printhead 202 may be one of the ink jet printheads (having the nozzle bores 201) according to the aforementioned embodiments. The ink tank 203 supplies the ink to the ink jet printhead 202.

In the case of the ink tank integral-type ink cartridge as such, the reliability of the ink jet printhead directly affects the reliability of the overall ink cartridge. Because the ink jet printhead according to the present invention has the capability to discharge the ink drops with high stability and without problems, as has been discussed, it becomes possible to improve the reliability and the yield of the ink cartridge.

Figure 54:
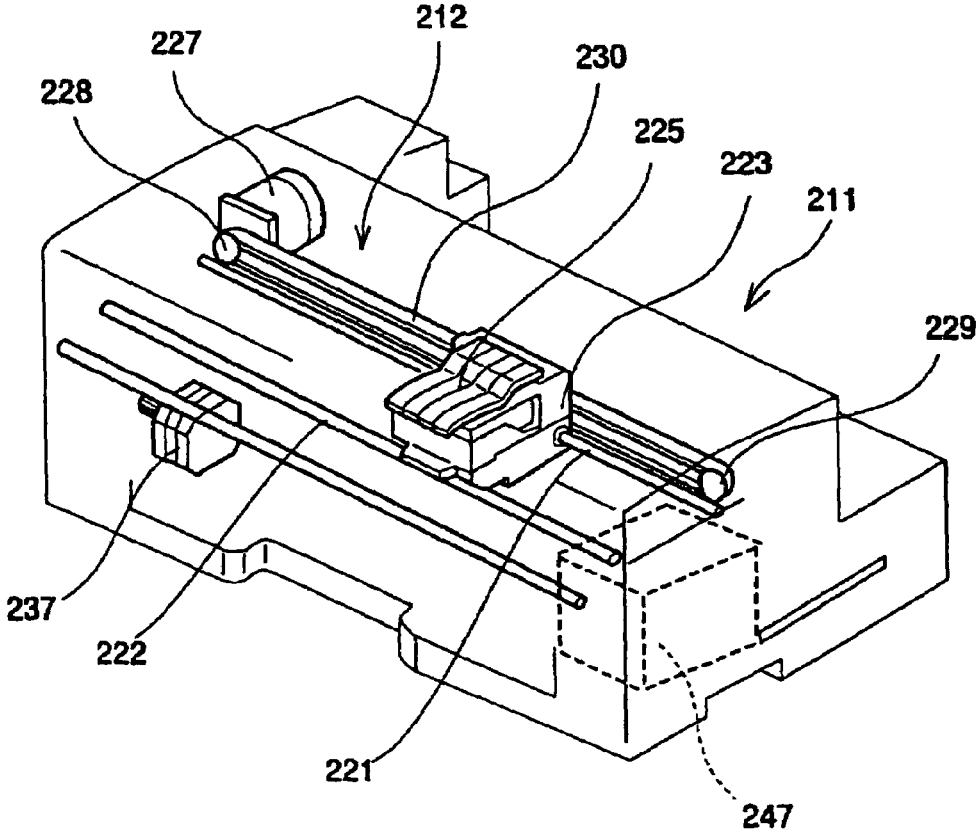
FIG. 54 shows a perspective view of an ink jet printing device.
Figure 55:
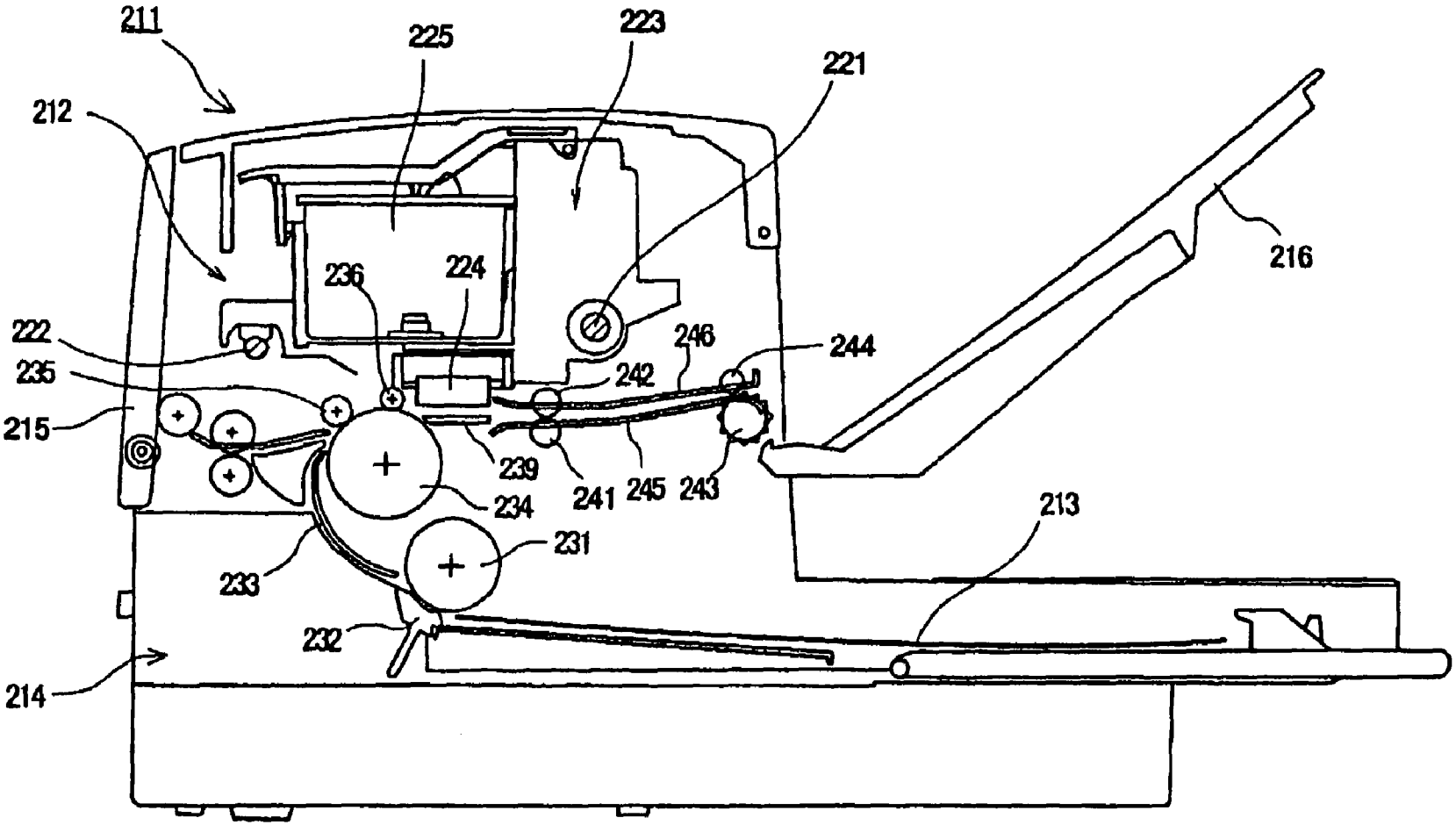
FIG. 55 shows a diagrammatical side view of the mechanical parts of the ink jet printing device.

Next, the description will be directed to an embodiment of an ink jet printing device equipped with the ink jet printheads (including the ink tanks) according to the aforementioned embodiments with reference to FIGS. 54, 55. FIG. 54 shows a perspective view of the ink jet printing device and FIG. 55 shows a diagrammatical side view of the mechanical parts of the ink jet printing device.

The ink jet printing device includes a main body 211. The main body 211 accommodates a carriage 223 movable in a main scanning direction, the ink jet printheads according to the present invention mounted on the carriage 223, a printing mechanism 212 comprising the ink cartridges 225 for supplying the ink to the ink jet printheads, and the like. A feeder cassette 214 (input tray) to which a number of sheets 213 can be loaded from front side is detachably attached to the lower portion of the main body 211. A manual feeder tray 215 is hung on a hinge. The sheets fed from the feeder cassette 214 or the manual feeder tray 215 are ejected through the back of the main body 211 into an output tray 216 after the formation of printed images is achieved with the aid of the printing mechanism 212.

The printing mechanism 212 holds the carriage 223 slidably in a main scanning direction with the aid of a main guide rod 221 and a sub guide rod 222. The main guide rod 221 and the sub guide rod 222 extend laterally to both sides of the main body 211. The ink jet printheads 224 according to the present invention, which inject the color ink drops of yellow (Y), cyan (C), magenta (M), and black (B), are mounted on the carriage 223 such that the rows of the nozzle bores cross transversely to the main scanning direction and are directed in the downward direction. Each of the ink cartridges 225 for supplying the respective color ink is mounted on the carriage 223 such as to be replaceable. It is noted that the ink tank integral-type ink cartridge as described above may be mounted on the carriage 223.

The openings (not shown) communicating with the atmosphere are formed on the upper side of the ink cartridges 225 and the feed openings (not shown) out of which the ink therein is supplied to the ink jet printheads 224 are formed on the lower side of the ink cartridges 225. A porous element is provided inside the ink cartridges 225. The ink cartridges 225 maintain the ink to be supplied to the ink jet printheads 224 with a negative pressure by capillary action of the porous element.

Although a plurality of the ink jet printheads 224 are provided according to the ink colors in this embodiment, only one ink jet printhead having the nozzles for discharging the respective color ink is also applicable.

The back portion (a rearward portion in a sheet delivering direction) of the carriage 223 is slidably fitted on the main guide rod 221 and the front portion (a forward portion in a sheet delivering direction) is slidably placed on the sub guide rod 222. A timing belt 230, which is routed around a drive pulley 228 and a driven pulley 229, is secured to the carriage 223. The rotation of a main motor 227 in normal and reverse directions causes a reciprocating motion of the carriage 223.

A feed roller 231 and a friction pad 213 are provided to separately deliver the sheets 213 in the feeder cassette 214. A first guide member 233 for guiding the sheets 213 and a delivery roller 234 for delivering sheets 213 after turning the sheets 213 upside down is provided. Further, a roller 235 is arranged such as to be pressed against the periphery of the delivery roller 234. A roller 236 is provided to limit the feeding angle of the sheets 213. A sub motor 237 drives the delivery roller 234 via a gear system.

A second guide member 239 is provided below the ink jet printheads 224 in relation to the moving range of the carriage 223 in the main scanning direction. The second guide member 239 guides the sheet delivered from the delivery roller 234 below the ink jet printheads 224. Rollers 241, 242 are provided on the rearward side of the second guide member 239 in a sheet delivering direction. Further, output rollers 243, 244 for delivering the sheet 213 into the output tray 216 and third guide members 245, 246 defining the output path of the sheet 213 are provided.

In the printing operation, the ink jet printheads 224 are actuated according the drive signal under the condition of the movement of the carriage 223. At that time, the ink jet printheads 224 discharge the ink drops to form a line of an image on the stopped sheet 213. Likewise, the next line of an image is printed when the sheet advances by a predetermined distance in a stepwise manner. The signal, which instructs the termination of the printing operation or indicates that the rear end of the sheet passes out of the printing area, causes the termination of the printing operation and the output of the printed sheet. In this printing operation, high quality of the printed image is guaranteed with high stability, because the ink jet printheads 224 according to the present invention can discharge the ink drops with high efficiency.

As shown in FIG. 54, a recovery apparatus 247 is disposed outwardly on the right side of the moving area of the carriage 223. A discharge malfunction can be recovered from through use of the recovery apparatus 247. For this purpose, the recovery apparatus 247 is provided with a capping member, a vacuum means and a cleaning device. The carriage 223 is moved toward the recovery apparatus 247 so that the ink jet printheads 224 are covered with the capping member during standby. This keeps the discharging portions (i.e., nozzle bores) of the ink jet printheads 224 in a damp state and thereby prevents a discharge malfunction due to dried ink. Further, in order to keep a stable discharge performance, the viscosity of the ink is kept constant over all the discharging portions of the ink jet printheads 224 by discharging ink drops not used for printing.

In the case of trouble such as a discharge malfunction, the discharging portions (i.e., nozzle bores) of the ink jet printheads 224 are enclosed with the capping member so that the air bubbles and the ink are evacuated up through a tube with the aid of a vacuum means. The ink and the particles accumulated along the surfaces of the discharging portions are removed with the aid of the cleaning device. As such, the recovery apparatus 247 recovers from trouble such as a discharge malfunction. Further, the evacuated ink is delivered to an ink removal catcher (not shown) where the ink absorbent material within the ink removal catcher absorbs and retains the removed ink.

In this way, the ink jet printing device can perform a stable ink drops discharge operation with a high degree of reliability over the long run and improve the image quality with the aid of the ink jet printheads (including an ink tank integral-type ink cartridge) according to the present invention.

Further, the present invention is not limited to these embodiments, and variations and modifications may be made without departing from the scope of the present invention.

For example, the description of the present invention has been directed to the ink jet printhead as a drop discharge head, however, the present invention is equally applicable to a drop discharge head that discharges a drop other than the ink drops such as a resist drop and a drop for DNA analysis. Further, the description of the present invention has been directed to the piezoelectric type ink jet printhead, however, the present invention is equally applicable to thermal or electrostatic type ink jet printheads.

Further, the aforementioned examples of processes for producing the spacer may be combined in various manners. For example, the special process for making the surface roughness (Ra) less than 2 μm can be added to any of the examples of processes.

The present application is based on Japanese priority application No. 2001-376884 filed on Dec. 11, 2001, Japanese priority application No. 2002-073465 filed on Mar. 18, 2002, Japanese priority application No. 2002-081288 filed on Mar. 22, 2002, and Japanese priority application No. 2002-139953 filed on May 15, 2002 the entire contents of which are hereby incorporated by reference.

The invention claimed is:

1. A drop discharge head comprising:

a channel-forming element that has a channel formed therein trough which a fluid is conducted to a nozzle and has a first surface on one side and a second surface on the other side;

wherein there is substantially no difference in surface area, excluding concave portions, between the first surface and the second surface, wherein the ratio, excluding concave portions, between the surface area of the first surface and the surface area of the second surface is between 0.5-2.0.

2. The drop discharge head as claimed in claim 1, further comprising;

a nozzle plate that is bonded to the first surface of the channel-forming element and has the nozzle formed therein; and a diaphragm that is bonded to the second surface of the channel-forming element and defines at least one surface of the channel.

3. The drop discharge head as claimed in claim 1, further comprising;

a cover member that is bonded to the first surface or the second surface of the channel-forming element and defines the wall surface of the channel.

4. The drop discharge head as claimed in claim 1, wherein the channel of the channel-forming element is formed on the second surface side.

5. The drop discharge head as claimed in claim 4, wherein a pseudo-channel is formed on the first surface side at substantially opposed position with respect to the channel.

6. The drop discharge head as claimed in claim 5, wherein the pseudo-channel is connected in fluid communication to the outside of the channel-forming element.

7. The drop discharge head as claimed in claim 1, wherein a fluid-proof film is at least partially formed on a surface of the channel.

8. The drop discharge head as claimed in claim 7, wherein the fluid-proof film is an oxide film or a titanium nitride film.

9. The drop discharge head as claimed in claim 1, wherein the channel-forming element is made from a silicon substrate.

10. An inkjet printing apparatus comprising:

an inkjet cartridge configured to store ink and including a feed opening through which the ink is supplied; and a drop discharge head including a channel-forming element made from a silicon substrate, the channel-forming element having a channel formed therein through which the ink supplied by the inkjet cartridge is conducted to a nozzle and having a first surface on one side and a second surface on the other side, wherein the ratio between the surface area of the first surface to the surface area of the second surface, excluding concave portions, is between 0.5-2.0.

* * * * *